US010492579B1

(12) United States Patent
Volin

(10) Patent No.: US 10,492,579 B1
(45) Date of Patent: Dec. 3, 2019

(54) ARTHRITIC-AIDING TRIPLE-SAIL WIND-ROTATING WIND-ALIGNING UMBRELLA

(71) Applicant: Dee Volin, Gresham, OR (US)

(72) Inventor: Dee Volin, Gresham, OR (US)

( * ) Notice: Subject to any disclaimer, the term of this patent is extended or adjusted under 35 U.S.C. 154(b) by 0 days.

(21) Appl. No.: 16/547,581

(22) Filed: Aug. 22, 2019

(51) Int. Cl.
*A45B 23/00* (2006.01)
*A45B 25/14* (2006.01)
*A45B 25/18* (2006.01)

(52) U.S. Cl.
CPC ..... *A45B 23/00* (2013.01); *A45B 25/14* (2013.01); *A45B 25/18* (2013.01); *A45B 2023/0012* (2013.01)

(58) Field of Classification Search
CPC . A45B 23/00; A45B 25/14; A45B 2023/0012; A45B 25/18
See application file for complete search history.

(56) References Cited

U.S. PATENT DOCUMENTS 4,567,907 A 2/1986 Dubinsky
D350,643 S 9/1994 De Marco
5,555,903 A 9/1996 Rizzotti
5,601,103 A 2/1997 Dubinsky
D383,900 S 9/1997 Bart
5,711,333 A 1/1998 Vanderminden
5,752,534 A 5/1998 Becher
5,823,215 A 10/1998 Chou
6,082,383 A 7/2000 Wilson
6,129,101 A 10/2000 Dubinsky
6,173,721 B1 1/2001 Mery
6,276,380 B1 8/2001 Edelmann
6,302,124 B1 10/2001 Demarco
6,374,840 B1 4/2002 Ma
(Continued)

*Primary Examiner* — David R Dunn
*Assistant Examiner* — Danielle Jackson

(57) ABSTRACT

An arthritic-aiding triple-sail wind-rotating wind-aligning auditory-pin-snap-locking-and-centering umbrella comprising: first and second and third arthritic-aiding canopy-rotating-and-aligning sails, a canopy attached to the first and second and third arthritic-aiding sails and having tension-adjusting oval openings, a pole having a fixed hub and a movable hub and at least one pin opening, an adjustable hub-rotation-preventing slot formed in the pole, an adjustable hub-rotation-preventing peg attached to the fixed hub and inserted into the adjustable hub-rotation-preventing slot, an arthritic-aiding ring elevator attached to the movable hub, tension-adjusting rods, rod-locking screws respectively screwed through the tension-adjusting oval openings and into the tension-adjusting rod, three pulleys respectively screwed to the fixed and movable hubs, a pulley cord threaded on the three pulleys and attached to the movable hub, two oval cord-locking gear cams attached to the movable hub, at least one pin opening drilled through the pole, a locking pin having an arthritic-aiding ergonomic grip ring, a recess molded on the locking pin, at least one pin-centering-and-guiding plug and tube having built-in auditorily-snap-locking leaf springs and leaf-spring towers inserted into the pole and aligned with the at least one pin opening, and a tower-locking screw screwed between the leaf-spring towers for locking the towers inside the pole.

20 Claims, 52 Drawing Sheets

(56) References Cited

U.S. PATENT DOCUMENTS

| | | | | |
|---|---|---|---|---|
| 6,941,959 | B2 | 9/2005 | Kung-Tai | |
| 7,293,573 | B2 | 11/2007 | Clarke | |
| 7,318,444 | B2 | 1/2008 | Clarke | |
| 7,334,591 | B2 | 2/2008 | Aloi | |
| 7,412,985 | B2 | 8/2008 | Ma | |
| 7,604,015 | B2 | 10/2009 | Fraser | |
| D609,453 | S | 2/2010 | Liu | |
| 7,806,131 | B1 | 10/2010 | Seiler | |
| 7,882,846 | B2 | 2/2011 | Harbaugh | |
| 8,302,616 | B2 | 11/2012 | Vanderminden, Sr. | |
| 8,656,937 | B1 | 2/2014 | Minasi | |
| D704,428 | S | 5/2014 | Akin | |
| 8,714,511 | B2 * | 5/2014 | Zoeteman | A45B 23/00 135/16 |
| 9,554,630 | B1 | 1/2017 | Patel | |
| 9,615,673 | B2 | 4/2017 | Burns | |
| 10,016,033 | B2 * | 7/2018 | Volin | A45B 25/02 |
| 10,149,523 | B2 * | 12/2018 | Cooley | E04H 12/2238 |
| 10,357,087 | B2 | 7/2019 | Mullet | |
| 10,376,027 | B1 | 8/2019 | Kuelbs | |
| 2006/0278261 | A1 * | 12/2006 | Marcelli | A45B 25/18 135/98 |
| 2014/0109942 | A1 | 4/2014 | Ma | |
| 2015/0245692 | A1 | 9/2015 | Ma | |
| 2017/0099919 | A1 | 4/2017 | Mullet | |
| 2017/0340075 | A1 | 11/2017 | Volin | |

* cited by examiner

FIG. 15
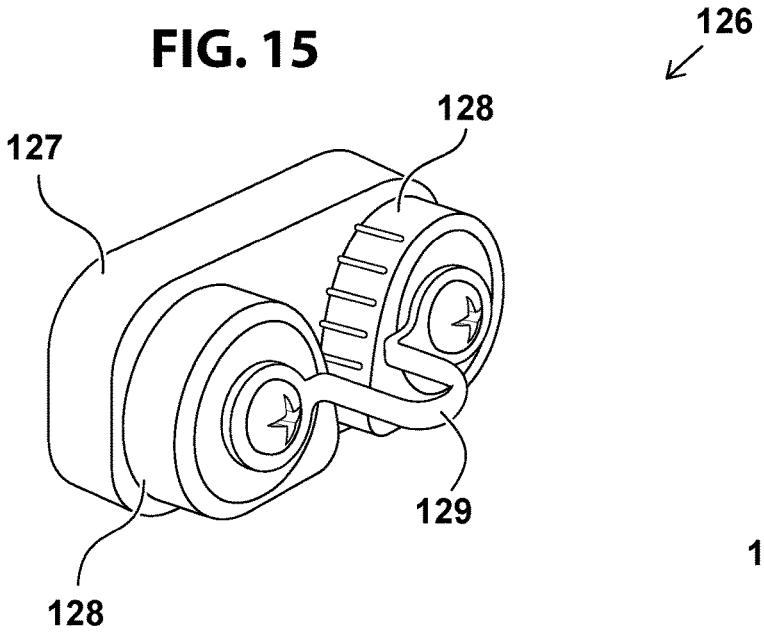
FIG. 16A
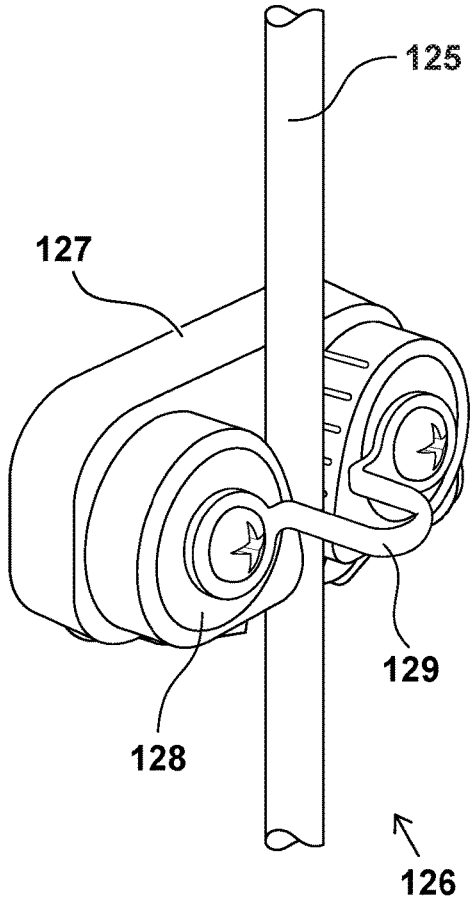
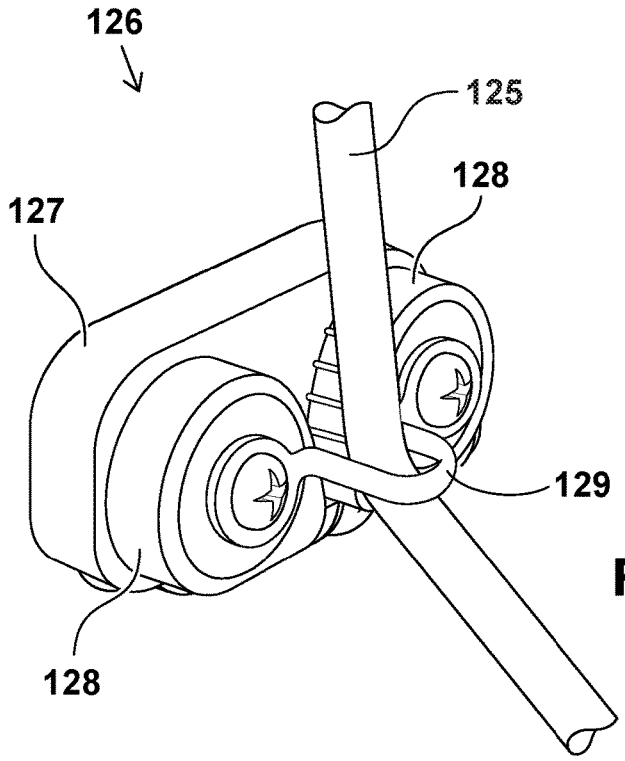
FIG. 16B

FIG. 24A
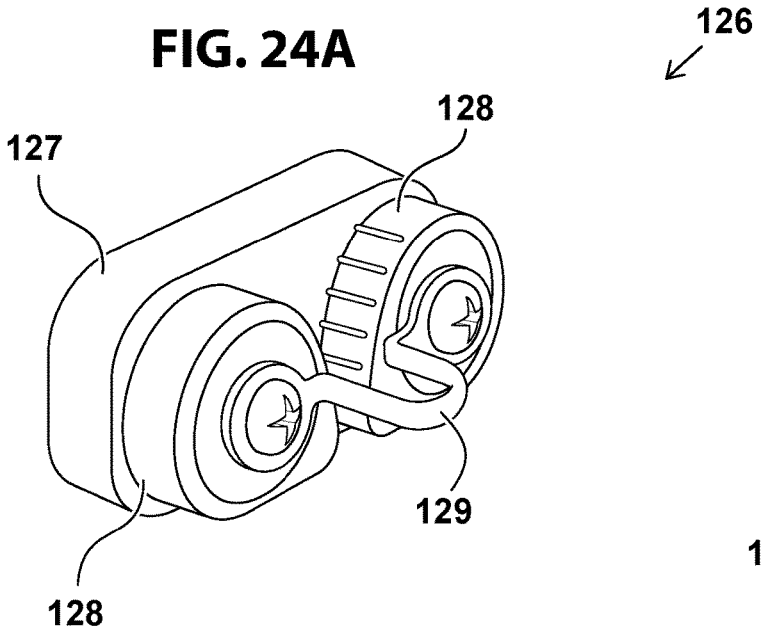
FIG. 24B
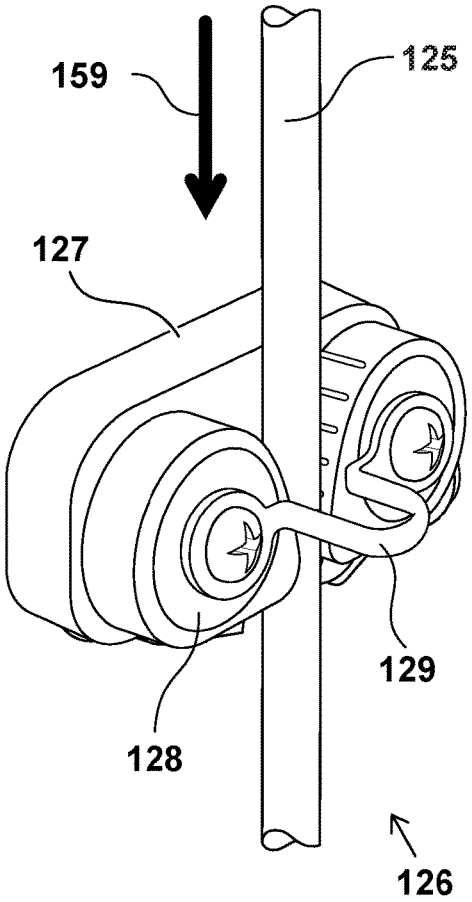
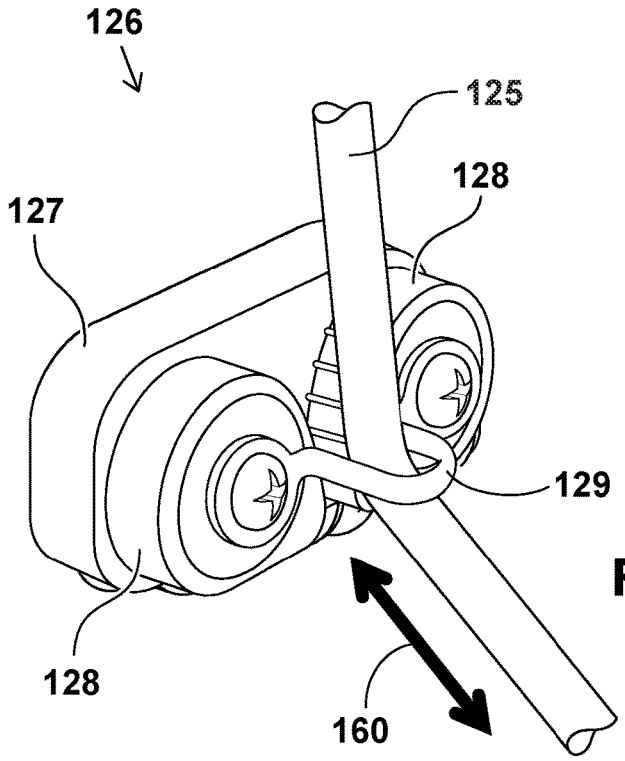
FIG. 24C

ARTHRITIC-AIDING TRIPLE-SAIL WIND-ROTATING WIND-ALIGNING UMBRELLA

1. FIELD OF THE INVENTION

The present invention relates to a foldable umbrella, which is cheap to produce, is easy to ship as one unit, can be quickly and easily assembled, and can be quickly and easily unfolded. Particularly, the present invention relates to an arthritic-aiding triple-sail wind-rotating wind-aligning auditory-pin-snap-locking-and-centering umbrella, comprising:

1) An arthritic-aiding triple-sail-canopy and pole system,
2) An arthritic-aiding canopy-tension-adjusting system,
3) An arthritic-aiding rib-hub system,
4) An arthritic-aiding tri-pulley system,
5) An anti-cable-fraying cable-locking gear-cam system,
6) An arthritic-aiding pin-centering pin-guiding auditorily-snap-locking tower-locking system, and
7) An adjustable-friction base system.

2. DESCRIPTION OF THE PRIOR ART

A number of foldable umbrellas have been introduced.

U.S. Pat. No. 4,567,907, issued 1986 Feb. 4, to Emanuel Dubinsky, describes a pulley system for opening and closing an umbrella which has a ribholder adapted for slidable movement along an umbrella pole. A pulley wheel is mounted in the umbrella pole below its top portion with one end of a pulley cord fixedly attached to the ribholder while the other end of the pulley cord extends below the closed umbrella cover with a first cord handle adapted for being grasped by an operator.

U.S. Pat. No. 5,555,903, issued 1996 Sep. 17, to Salvatore A. Rizzotti, refers to an aerodynamic umbrella having a curved canopy mounted on a horizontally disposed extension shaft which is rotatably mounted on a vertical mast, such canopy having a stabilizer member on the top thereof and being able to rotate the umbrella into the wind.

U.S. Pat. No. 5,601,103, issued 1997 Feb. 11, to Emanuel Dubinsky, outlines a garden umbrella with a partial top canopy covering the central area of the umbrella and located on the upper side of the canopy ribs, and an underside outer canopy secured to the underside of the canopy ribs and covering at least the outer ring portion of the canopy ribs not covered by such partial top canopy. The underside outer canopy has canopy rib sleeves formed on its top side and adapted for receiving therein the middle and end tip portions of the canopy ribs. The partial top canopy is secured at its outer ends to the upper side of the canopy ribs and the canopy sleeves such that a deep vent is formed between the partial top canopy and the underside outer canopy for venting wind through the space between the two canopies.

U.S. Pat. No. 5,711,333, issued 1998 Jan. 27, to Robert D. Vanderminden, relates to an umbrella frame is provided with a movable yoke at the upper end and a stationary yoke at an intermediate point. Ribs are pivotally mounted on the movable yoke and struts are pivotally mounted on the fixed yoke while being pivotally mounted to intermediate points on the ribs. A downward movement of the upper yoke causes the ribs to splay outwardly so as to open the umbrella.

U.S. Pat. No. 5,752,534, issued 1998 May 19, to Karl Klaus Becher, details an umbrella, particularly a standing umbrella, sunshade, garden umbrella or similar, with a frame, a roof structure and a canopy, where the roof rods are linked to a pole element bearing a cap and moveable in a telescopic manner relative to the vertical pipe, and a slide, on which stretchers linked to the roof rods act flexibly, is moveable along the vertical pipe, the cap and the slide moving in opposite directions during opening and closing of the umbrella, and with at least one additional stretcher arranged flexibly above the slide between the umbrella pipe and a roof rod, the slide being fitted with a locking device with which it can be locked in its upper position and the canopy can be tensioned, it is envisaged that the locking device works in conjunction with a retaining device located on the cap or the moveable pole element to enable simple manual opening of the umbrella and stretching of the canopy, particularly for umbrellas with large diameters.

U.S. Pat. No. 5,823,215, issued 1998 Oct. 20, to Lung-Chiao Chou, outlines an umbrella in automatic opening and closing manner with its rod in the middle, which has multiple sections, and it is in variable dynamic process including the umbrella's skeleton mechanism, spring, locating device, shuttle arrow, control mechanism, handle, change-over device and pulling rig. Its main novelty is that within the middle rod of the umbrella's skeleton, a contrivance to change is installed. At the ends of the pulling rope in the contrivance to make changes, they respectively reach the lower nest and shuttle arrow. The control mechanism is manipulated by the pressing of of the button to release the umbrella's skeleton in particular position for closing and folding and the reserve energy of the spring.

U.S. Pat. No. 6,082,383, issued 2000 Jul. 4, to Robert Joe Wilson, demonstrates an operating mechanism for "patio type" umbrellas uses an actuator sleeve in order to open and close the canopy. The sleeve is in connection an inner rod on the inside of the main shaft that in turn is used to open and close the ribs that support the canopy of the umbrella. Movement of the actuator sleeve upward will move the inner rod upward as well as pull the ribs downward so as to close the canopy. Movement of the actuator sleeve downward will pull the ribs away from the central shaft and hence open the canopy.

U.S. Pat. No. 6,129,101, issued 2000 Oct. 10, to Emanuel Dubinsky, demonstrates a garden umbrella of a generally large size, having a ribholder runner notch adapted for movement along a hollow umbrella pole for operating the canopy ribs to open and close the umbrella canopy. A pulley wheel is mounted in the umbrella pole below its top portion, with one end of a pulley cord being attached to the ribholder runner notch while the other end of the pulley cord extends down through the hollow pole where it connects to a ballast weight. The ballast weight is adapted to travel vertically in the pole in synchronism with movement of the runner notch.

U.S. Pat. No. 6,173,721, issued 2001 Jan. 16, to Johni Mery, describes a patio umbrella that has a pole which has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

U.S. Pat. No. 6,276,380, issued 2001 Aug. 21, to Toshio Okuda, demonstrates a wind-resistant umbrella. The wind-resistant umbrella includes a holder cord that is arranged offset with the stretcher so that the cord does not contact with the stretcher, thus avoiding any friction that may occur on an interface therebetween during the closing or opening of the umbrella. The wind-resistant umbrella includes an upper catch that is selectable from designs that vary in resistance to wind. The wind-resistant umbrella includes a runner having an enlarged pushing body provided with guide grooves that allow the runner to pass therethrough downwardly along the shaft, thereby preventing the runner from hitting against the upper catch.

U.S. Pat. No. 6,302,124, issued 2001 Oct. 16, to Joseph H. Demarco, outlines an open spaced apart patio sun umbrella which, when the top thereof is raised, undergoes a reshaping into an inverted v-shape closed condition and makes, to the extent it is raised, the location of an unlatching mechanism within convenient reach of a user making unobserved unlatching contact therewith through the bottom opening of the v-shape, even though the unlatching mechanism is masked from view.

U.S. Pat. No. 6,302,124, issued 2001 Oct. 16, to Joseph H. Demarco, describes an open spaced apart patio sun umbrella which, when the top thereof is raised, undergoes a reshaping into an inverted v-shape closed condition and makes, to the extent it is raised, the location of an unlatching mechanism within convenient reach of a user making unobserved unlatching contact therewith through the bottom opening of the v-shape, even though the unlatching mechanism is masked from view.

U.S. Pat. No. 6,374,840, issued 2002 Apr. 23, to Oliver Joen-An Ma, pertains to a patio umbrella has a pole, a plurality of primary ribs extending from the pole, a hub slidably supported on the pole, and a plurality of secondary ribs, each secondary rib having a first end pivotally coupled to the hub and a second end pivotally coupled to one of the primary ribs. The patio umbrella has a ledge positioned on the pole, and a spring slidably supported on the pole between the hub and the ledge. The patio umbrella can also have at least one stretcher having a first end pivotally coupled to one of the secondary ribs, and a second end pivotally coupled to the ledge.

U.S. Pat. No. 6,941,959, issued 2005 Sep. 13, to Liang Kung-Tai, demonstrates an umbrella includes a shaft with a runner movably mounted thereto and a first cap and a second cap are respectively connected to a top end of the shaft. The first cap is located closer than the second cap to the second end of the shaft. A plurality of first ribs pivotably connected to the second end cap and a main panel is mounted to the first ribs. The main panel has a hole with a center at the shaft.

U.S. Pat. No. 7,293,573, issued 2007 Nov. 13, to Dougan H. Clarke, defines an improved, durable and versatile umbrella frame assembly and is provided to more readily endure abusive weather conditions and that may be quickly, easily and inexpensively repaired. In addition, the assembly is also easily modified to accommodate umbrella canopies of different sizes and shapes. In addition, an improved umbrella operating system is provided to permit simple opening, positioning, and locking of an umbrella while allowing the frame to freely rotate about the pole regardless of the degree to which it is opened, while the pole is held in a stationary position.

U.S. Pat. No. 7,318,444, issued 2008 Jan. 15, to Dougan H. Clarke, relates to an umbrella frame provides a stable and enduring support for an umbrella canopy while also allowing canopies of varying shapes and sizes to be mounted thereto. The umbrella frame includes a hub assembly, namely, a main hub member mounted about a central pole member of the umbrella frame which offers improved means for attaching brackets thereto which are structured to pivotally receive a plurality of strut members therein, which strut members are, in turn, pivotally secured to a plurality of rib members interconnected with an upper, secondary hub.

U.S. Pat. No. 7,334,591, issued 2008 Feb. 26, to Vincenzo Aloi, demonstrates an umbrella which comprises improved ribs for engaging with the strip portions of the cover. Each rib includes a metal structural shape or component and a plurality of saw-tooth components engaged with said structural shape/component and capable of fixing strip portions of the cover thereto.

U.S. Pat. No. 7,412,985, issued 2008 Aug. 19, to Oliver Joen-an Ma, demonstrates an umbrella is provided that includes a lower pole portion, an upper pole portion, a canopy coupled with the upper pole portion, a crank, and a rotation mechanism. The upper pole portion is rotatably coupled with the lower pole portion. The crank is configured to articulate the canopy. The rotation mechanism is configured to apply a force to the upper pole portion.

U.S. Pat. No. 7,604,015, issued 2009 Oct. 20, to Joseph Fraser, refers to an umbrella has a first support member, a plurality of ribs supported by the first support member, and a canopy supported by the plurality of ribs. At least one of the plurality of ribs has, in cross section, a bottom wall, first and second upstanding side walls extending upward from the bottom wall, and a web extending between the first and second side walls at a location intermediate the bottom wall and the upper side wall ends. The web and upper portions of the first and second side walls form a channel. A first hole extends through the web, and a second hole extends through the bottom wall generally in coaxial alignment with the first hole.

U.S. Pat. No. 7,806,131, issued 2010 Oct. 5 to Emily M. Seiler, describes a reversible deck umbrella apparatus having reversible fabric coverings and changeable trim pieces, is herein disclosed. The umbrella comprises a textile product covering of a reversible design thus allowing for multiple fashion statements while prolonging the useful lifetime of the umbrella. The invention is configured on both sides with a variety of pockets and attachment points for the umbrella frame and interchangeable trim areas with various versions such as a solid flap, a pendant design, a scalloped design, a tassel design, and the like.

U.S. Pat. No. 7,882,846, issued 2011 Feb. 8, to Kenneth A. Harbaugh, describes an umbrella comprises a vertical support member and a plurality of ribs operatively associated with the vertical support member and extending generally radially outward from a central location. The umbrella further includes a plurality of elongated, laterally flexible members, one of the flexible members being operatively associated with each of the plurality of ribs and extending outward therefrom. A canopy is supported by the plurality of ribs and has a periphery extending beyond the ribs. Receptacles are disposed on the inner surface of the canopy at points proximate the periphery of the canopy and in substantial alignment with a corresponding rib. The outer end of each flexible member engages a corresponding one of the receptacles.

U.S. Pat. No. 8,302,616, issued 2012 Nov. 6, to Robert D. Vanderminden, refers to an umbrella is constructed with a frame that allows one rib to be manually lifted in order to open the umbrella and allows a manually applied force to be placed on the cover between two adjacent ribs in order to close the umbrella. Mechanical cranks and the like are eliminated. In one embodiment, the upper yoke is movable relative to a fixed lower yoke and the tension in the cover maintains the upper movable yoke in the open condition of the umbrella.

U.S. Pat. No. 8,656,937, issued 2014 Feb. 25, to Connie Minasi, details an outdoor umbrella stabilizer system for preventing wind damage to an outdoor umbrella having a plurality of cords, a plurality of clips and a means of securing the cords to a weighted object. The stabilizer system flexibly maintains the canopy in position, preventing strong winds from catching the canopy and twisting, warping, contorting, buckling or deforming the umbrella, thereby stabilizing the outdoor umbrella. The stabilizer system installs on many styles of outdoor umbrellas, including a cantilever, a beach umbrella, a deck or patio umbrella, a center pole or vertical pole of the umbrella unnecessary for installation.

U.S. Pat. No. 9,554,630, issued 2017 Jan. 31, to Vinod Patel, relates to an umbrella that has a lower pole and an upper pole and a fabric. The lower pole includes screw threads. A spring clip in an inverted V-shaped configuration has outwardly extending projections removably coupling together the upper pole and the lower pole. A handle is removably coupled to the lower pole to twist the lower pole. Each rib of a plurality of ribs has an interior end and an exterior end.

U.S. Pat. No. 9,615,637, issued 2017 Apr. 11, to Benson Tung, refers to an umbrella includes a fixing tube and a coupling member mounted on an end of the fixing tube. A positioning ring is mounted around and not rotatable relative to the coupling member. A rotational sleeve is rotatably mounted to the coupling member and is spaced from the positioning ring. A driving jacket is mounted around the connecting ring and the positioning ring. The driving jacket is fixed to the positioning ring and is movable between an engagement position in which the positioning ring engages with the connecting ring and a disengagement position in which the positioning ring disengages from the connecting ring.

U.S. Pat. No. 10,357,087, issued 2019 Jul. 23, to Willis Jay Mullet, pertains to an umbrella system includes a support pole connected to a rotating tube positioned around a center tube that extends between the support pole and a center support that is connected to an umbrella frame. The rotating tube has one or more helical grooves therein that are engaged by teeth of a hub which is connected to the umbrella frame. As the rotating tube is rotated, the hub is driven along the length of the rotating tube thereby opening and closing the umbrella frame. In one arrangement system includes a motor housing assembly including a plurality of batteries and a motor that includes a driven gear that meshes with a stationary gear which causes rotation of the rotating tube.

U.S. Pat. No. 10,376,027, issued 2019 Aug. 13, to Gregory G. Kuelbs, demonstrates an umbrella apparatus having a canopy portion hingedly coupled to a pole portion. The umbrellas apparatus includes a rechargeable electrical power system that provides electrical power to an electromechanical opening and closing system and a light assembly and an entertainment system. A solar energy system is conductively coupled to the rechargeable electrical power system and is utilized to collect and convert solar energy to electrical energy for recharging the electrical power system.

U.S. Pat. No. D350,643, issued 1994 Sep. 20, to Sarah Akin, depicts the ornamental design for an outdoor umbrella, as shown and described.

U.S. Pat. No. D383,900, issued 1997 Sep. 23, to Robert M. Bart, depicts the ornamental design for an outdoor umbrella, as shown and described.

U.S. Pat. No. D609,453, issued 2010 Feb. 9, to Kai Liu, depicts the ornamental design for a patio umbrella, as shown and described.

U.S. Pat. No. D704,428, issued 2014 May 13, to Sarah Akin, depicts the ornamental design for an umbrella cap, as shown and described.

U.S. Publication No 20140109942, issued 2014 Apr. 24, to Oliver Joen-an Ma, refers to an umbrella assembly described herein, which is advantageously configured with simple yet robust arrangements for securing an umbrella in an open configuration, e.g., with a runner in an elevated position.

U.S. Publication No 20150245692, issued 2010 Nov. 18, to Mark J. S. MA, relates to an umbrella having a support arm, a canopy having a support hub defining a first axis, and a pivot joint coupling the support hub to the support structure. The pivot joint is rotatable with respect to the support structure, about a second axis at a fixed angle with respect to the support structure. The pivot joint has a rotatable joint axle rotatably coupled to the support structure, and a tilt joint axle having a first end rotatably coupled to the rotatable joint axle along an interface plane at an angle, and a second end coupled to the support hub, wherein the tilt joint axle defines a longitudinal third axis.

U.S. Publication No 20170099919, issued 2017 Apr. 13, to Willis Jay Mullet, demonstrates an umbrella system includes a support pole connected to a rotating tube positioned around a center tube that extends between the support pole and a center support that is connected to an umbrella frame. The rotating tube has one or more helical grooves therein that are engaged by teeth of a hub which is connected to the umbrella frame.

U.S. Publication No 20170340075, issued 2017 Nov. 30, to DEE VOLIN, demonstrates an arthritic-aiding pin-centering-and-guiding auditorily-snap-locking umbrella comprising: a canopy having tension-adjusting oval openings, a pole having a fixed hub and a movable hub, tension-adjusting rods, rod-locking screws respectively screwed through the tension-adjusting oval openings and into the tension-adjusting rod, three pulleys respectively screwed to the fixed hub and the movable hub, a pulley cord threaded on the three pulleys and attached to the movable hub, a cord hook, two gear cams attached to the movable hub, a cord blocker attached to the two gear cams, at least one pin opening drilled through the pole, an arthritic-aiding grip ring attached to the cord hook, a locking pin attached to the arthritic-aiding grip ring, a recess molded on the locking pin, at least one pin-centering-and-guiding plug and tube having built-in auditorily-snap-locking leaf springs and leaf-spring towers inserted into the pole and aligned with the at least one pin opening, and a tower-locking screw screwed between the leaf-spring towers for locking the plug inside the pole.

DISADVANTAGES OF THE PRIOR ART

The prior art have failed to solve many problems associated with such foldable umbrellas, as follows (for example, wind from all directions blew away paper napkin, paper plates, paper cup, paper table mats, paper table cloths) (see FIG. 1 (Prior Art):

1) No prior art mention or disclose any foldable umbrella, having
   - first arthritic-aiding canopy-rotating-and-aligning sail 103,
   - second arthritic-aiding canopy-rotating-and-aligning sail 104, and
   - third arthritic-aiding canopy-rotating-and-aligning sail 105.

Therefore, the prior art of foldable umbrella:

a) Cannot catch wind to use wind to automatically rotate canopy 102 and umbrella pole 109 to align with the direction of wind
in the directions of arrows 151*a*, 151*b*, 151*c*, 151*d*, 151*e*, 151*f*, 152*a*, 152*b*, 152*c*, and 152*e*
(see FIG. 21A, FIG. 21B, FIG. 21C, FIG. 21D, FIG. 21E, and FIG. 21F), b) Cannot automatically align canopy 102 with the direction of wind to block wind from occupants (using the extended section of canopy 102)
to protect occupants and belongings
in the directions of arrows 151*a*, 151*b*, 151*c*, 151*d*, 151*e*, 151*f*, 152*a*, 152*b*, 152*c*, and 152*e*
(see FIG. 21A, FIG. 21B, FIG. 21C, FIG. 21D, FIG. 21E, and FIG. 21F), c) Cannot assist those with arthritis by automatically aligning canopy 102 with the direction of wind to block wind from occupants
to prevent arthritic from having to use hands to adjust canopy 102
in the directions of arrows 151*a*, 151*b*, 151*c*, 151*d*, 151*e*, 151*f*, 152*a*, 152*b*, 152*c*, and 152*e*
(see FIG. 21A, FIG. 21B, FIG. 21C, FIG. 21D, FIG. 21E, and FIG. 21F), d) Cannot prevent canopy 102 from blowing over by automatically aligning canopy 102 to the direction of wind
to prevent injury to occupants and damage to property
in the directions of arrows 151*a*, 151*b*, 151*c*, 151*d*, 151*e*, 151*f*, 152*a*, 152*b*, 152*c*, and 152*e*
(see FIG. 21A, FIG. 21B, FIG. 21C, FIG. 21D, FIG. 21E, and FIG. 21F), e) Cannot automatically and repeatedly adjust canopy 102 to the direction of wind when the direction of wind changes
to provide ease of use for user
in the directions of arrows 151*a*, 151*b*, 151*c*, 151*d*, 151*e*, 151*f*, 152*a*, 152*b*, 152*c*, and 152*e*
(see FIG. 21A, FIG. 21B, FIG. 21C, FIG. 21D, FIG. 21E, and FIG. 21F).

2) No prior art mention or disclose any foldable umbrella, having
adjustable hub-rotation-preventing slot 110, and
adjustable hub-rotation-preventing peg 119.
Therefore, the prior art of foldable umbrella:

a) Cannot secure adjustable hub-rotation-preventing peg 119 in adjustable hub-rotation-preventing slot 110
to prevent fixed hub 118 from turning radially
(see FIG. 9 and FIG. 10);

b) Cannot secure fixed hub 118 from spinning radially (see FIG. 9 and FIG. 10).

3) No prior art mention or disclose any foldable umbrella, having
arthritic-aiding ring elevator 121.
Therefore, the prior art of foldable umbrella:

a) Cannot provide an arthritic-aiding slidable handle to push up and pull down movable hub 120 to deploy and retract upper ribs 106 and lower ribs 107, respectively
to allow and assist those with arthritic hands to erect and retract umbrella without to need to bend the fingers or wrist
in the directions of arrows 153*a*, 153*b*, 154, 155*a*, 155*b*, and 156
(see FIG. 3, FIG. 22A, and FIG. 22B);

b) Cannot medicinally beneficially allow those with arthritic hands to keep their hands straight and to match the curvature of arthritic-aiding ring elevator 121 with the natural curvature of their hands
to eliminate the needs for bending fingers and/or wrist, and
to eliminate hand pain when operating arthritic-aiding ring elevator 121
in the directions of arrows 154 and 156
(see FIG. 22A, and FIG. 22B); and c) Cannot conveniently hook and store pulley cord 125 thereon
(see FIG. 17)

4) No prior art mention or disclose any foldable umbrella, having
arthritic-aiding ergonomic cord-hook grip ring 132 and
anti-finger-pinching spacer 133.
Therefore, the prior art of foldable umbrella:

a) Cannot encircle the broad surface of the metacarpals of the palm of the hand or the broad surface of the union of the metacarpals with the base of the phalanges,
to provide an enlarged surface area to engage with the palm of an open hand to insert a locking pin, providing greater comfort and availability to an arthritic suffering person
(FIG. 18B, FIG. 25A, FIG. 25B, and FIG. 26A);

b) Cannot encircle the broad surface of the metacarpals of the back of the hand or the broad surface of the union of the metacarpals with the base of the phalanges,
to provide an enlarged surface area; to engage with the back of an open hand; to extract a locking pin, providing greater comfort and availability to an arthritic suffering person
(FIG. 18B, FIG. 25A, FIG. 25B, and FIG. 26A);

c) Cannot allow a user with an arthritic hand to keep his/her hand straight,
to eliminate the needs to bend ones' fingers and wrist when holding and operating arthritic-aiding cord-hook grip ring
(FIG. 18B, FIG. 25A, FIG. 25B, and FIG. 26A); and d) Cannot allow a user with an arthritic hand to keep his/her hand straight, to render access to the interior of the hook section, for conveniently storing a coiled excess portion of a pulley cord
(FIG. 18B, FIG. 25A, FIG. 25B, and FIG. 26A).

5) No prior art mention or disclose any foldable umbrella, having
auditorily-snap-locking recess 135,
four auditorily-snap-locking leaf springs 138, and
four auditorily-snap-locking nipples 139.
Therefore, the prior art of foldable umbrella:

a) Cannot emit a snapping sound loud enough
to allow a person to hear the sound and recognize the moment that a locking pin is fully engaged
(FIG. 26A, FIG. 26B, FIG. 26C, and FIG. 26D);

b) Cannot transmit a vibration-emitting movement, projected by an interaction between two of four auditorily-snap-locking nipples,
to allow a person, utilizing their tactile senses, to recognize the moment a locking pin has fully engaged
(FIG. 26A, FIG. 26B, FIG. 26C, and FIG. 26D);

c) Cannot Can lock with one action,
to eliminate the need to secondarily insert a cotter key, or split-wire ring, to secure pin in vertical post (FIG. 26A, FIG. 26B, FIG. 26C, and FIG. 26D); and d) Cannot easily and instantly be inserted and extracted with minimal effort,
to eliminate pain experienced by an arthritic person (FIG. 26A, FIG. 26B, FIG. 26C, and FIG. 26D).

6) No prior art mention or disclose any foldable umbrella, having
arthritic-aiding canopy-tension-adjusting system 111.
Therefore, the prior art of foldable umbrella:

a) Cannot easily adjust,
to compensate for conditions resulting in canopy fabric being too small or too tight (FIG. 23A, FIG. 23B, FIG. 23C, and FIG. 23D);

b) Cannot easily adjust,
to compensate for conditions which loosen the canopy fabric causing sagging (FIG. 23A, FIG. 23B, FIG. 23C, and FIG. 23D); and c) Cannot provide internally-threaded tension-adjusting knobs whose flat surface can be easily rotated open-handed, by an arthritic hand
to eliminate the need to curl fingers to rotate, causing pain to an arthritic suffering person (FIG. 23A, FIG. 23B, FIG. 23C, and FIG. 23D).

7) No prior art mention or disclose any foldable umbrella, having
two pin-centering pin-guiding tubes 137.
Therefore, the prior art of foldable umbrella:

a) Cannot provide two tapered cone-shaped receiving apertures, on opposing ends, acting as a funnel while an arthritic suffering person inserts a locking pin,
to aid shaky arthritic hand to easily locate the tip of a locking pin to the inwardly tapered cone-shaped receiving apertures (FIG. 25A, FIG. 25B, FIG. 26A, FIG. 26B, FIG. 26C and FIG. 26D);

b) Cannot provide a conduit between two umbrella-pole pin openings,
to eliminate difficulty lining up common pin holes on either side for an arthritic hand (FIG. 25A, FIG. 25B, FIG. 26A, FIG. 26B, FIG. 26C and FIG. 26D);

c) Cannot provide a very low-friction material and low-friction internal surface,
to aid a shaky arthritic hand to effortlessly slide a locking pin into and through the two pin-centering pin-guiding tubes (FIG. 25A, FIG. 25B, FIG. 26A, FIG. 26B, FIG. 26C and FIG. 26D); and d) Cannot provide two inwardly tapered cone-shaped receiving apertures, on opposing ends,
to provide greater access to, and increase comfort for a painful arthritic hand (FIG. 25A, FIG. 25B, FIG. 26A, FIG. 26B, FIG. 26C and FIG. 26D).

8) No prior art mention or disclose any foldable umbrella, having
four internally-taperedly-threaded flexible towers 140.
Therefore, the prior art of foldable umbrella:

a) Cannot simply be inserted from the top or bottom of an umbrella pole,
to overcome the need to have special tooling and reduce costs, materials, and labor (FIG. 19A, FIG. 19B, FIG. 19C, and FIG. 19D);

b) Cannot secure within an umbrella pole, by the turn of a tower-locking screw,
to lock them in position, using a simple method, designed to reduce costs, materials, and labor (FIG. 19A, FIG. 19B, FIG. 19C, and FIG. 19D);

c) Cannot provide a cost-saving manufacturing method by being molded into a one-piece unit,
to reduce manufacturing costs and conserve molding materials (FIG. 19A, FIG. 19B, FIG. 19C, and FIG. 19D); and d) Cannot provide a cost-saving manufacturing method by being molded into a one-piece unit,
to reduce labor during assembly (FIG. 19A, FIG. 19B, FIG. 19C, and FIG. 19D).

9) No prior art mention or disclose any foldable umbrella, having
twelve triangular tower leaf springs 141.
Therefore, the prior art of foldable umbrella:

a) Cannot create a low-pressure friction fit within an umbrella pole, with respectively evenly-distributed pressure around the perimeter,
to securely position the arthritic-aiding pin-centering pin-guiding auditorily-snap-locking tower-locking system with minimal pressure being exerted against the internal structure of an umbrella pole (FIG. 19A, FIG. 19B, FIG. 19C, and FIG. 19D);

b) Cannot create a low-pressure friction fit within an umbrella pole,
to prevent over-tightening of the four internally-taperedly-threaded flexible towers during assembly (FIG. 19A, FIG. 19B, FIG. 19C, and FIG. 19D);

c) Cannot provide a cost-saving manufacturing technique,
to reduce manufacturing costs and conserve molding materials (FIG. 19A, FIG. 19B, FIG. 19C, and FIG. 19D); and d) Cannot provide arched leaf springs, creating an evenly-distributed-pressure friction fit within an umbrella pole,
to exert adequate outward pressure, without exerting excessive pressure, and self-adjust as needed in response to environmental conditions (FIG. 19A, FIG. 19B, FIG. 19C, and FIG. 19D).

10) No prior art mention or disclose any foldable umbrella, having
anti-cable-fraying cable-locking gear-cam system 126.
Therefore, the prior art of foldable umbrella:

a) Cannot overcome common impediments of prior art,
to allow an arthritic sufferer to utilize the umbrella system (FIG. 24A, FIG. 24B, and FIG. 24C);

b) Cannot overcome the need required by prior art, to curl thumb and fingers of a single hand around a pole to engage the locking pin,
to insert or compress a spring activated pin, or a manually inserted pin, into vertical umbrella center pole pin hole (FIG. 24A, FIG. 24B, and FIG. 24C);

c) Cannot allow opposing pressure from between thumb and fingers of a single hand around a pole to engage the locking pin,
to insert or compress a spring activated pin, or a manually inserted pin, into vertical umbrella center pole pin hole (FIG. 24A, FIG. 24B, and FIG. 24C); and d) Cannot allow opposing pressure from another hand, such as an opposing left hand or an opposing right hand,
to insert or compress a spring activated pin, or a manually inserted pin, into vertical umbrella center pole pin hole
(FIG. 24A, FIG. 24B, and FIG. 24C).

OBJECTS AND ADVANTAGES OF THE INVENTION

The present invention substantially departs from the conventional concepts and designs of the prior art. In doing so, the present invention provides a (or an) arthritic-aiding triple-sail wind-rotating wind-aligning auditory-pin-snap-locking-and-centering umbrella, having many unique and significant features, functions, and advantages, which overcome all the disadvantages of the prior art, as follows:

1) It is an object of the new invention to provide an arthritic-aiding triple-sail wind-rotating wind-aligning auditory-pin-snap-locking-and-centering umbrella, having
first arthritic-aiding canopy-rotating-and-aligning sail 103,
second arthritic-aiding canopy-rotating-and-aligning sail 104, and
third arthritic-aiding canopy-rotating-and-aligning sail 105.
Therefore, the arthritic-aiding triple-sail wind-rotating wind-aligning auditory-pin-snap-locking-and-centering umbrella:
a) Can catch wind to use wind to automatically rotate canopy 102 and umbrella pole 109 to align with the direction of wind
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F),
b) Can automatically align canopy 102 with the direction of wind to block wind from occupants (using the extended section of canopy 102)
to protect occupants and belongings
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F),
c) Can assist those with arthritis by automatically aligning canopy 102 with the direction of wind to block wind from occupants
to prevent arthritic from having to use hands to adjust canopy 102
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F),
d) Can prevent canopy 102 from blowing over by automatically aligning canopy 102 to the direction of wind
to prevent injury to occupants and damage to property
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F),
e) Can automatically and repeatedly adjust canopy 102 to the direction of wind when the direction of wind changes
to provide ease of use for user
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F)

2) It is an object of the new invention to provide an arthritic-aiding triple-sail wind-rotating wind-aligning auditory-pin-snap-locking-and-centering umbrella, having
adjustable hub-rotation-preventing slot 110, and
adjustable hub-rotation-preventing peg 119.
Therefore, the arthritic-aiding triple-sail wind-rotating wind-aligning auditory-pin-snap-locking-and-centering umbrella:
a) Can secure adjustable hub-rotation-preventing peg 119 in adjustable hub-rotation-preventing slot 110 to prevent fixed hub 118 from turning radially
(see FIG. 9 and FIG. 10);
b) Can secure fixed hub 118 from spinning radially
(see FIG. 9 and FIG. 10).

3) It is an object of the new invention to provide an arthritic-aiding triple-sail wind-rotating wind-aligning auditory-pin-snap-locking-and-centering umbrella, having
arthritic-aiding ring elevator 121.
Therefore, the arthritic-aiding triple-sail wind-rotating wind-aligning auditory-pin-snap-locking-and-centering umbrella:
a) Can provide an arthritic-aiding slidable handle to push up and pull down movable hub 120 to deploy and retract upper ribs 106 and lower ribs 107, respectively
to allow and assist those with arthritic hands to erect and retract umbrella without to need to bend the fingers or wrist
in the directions of arrows 153*a*, 153*b*, 154, 155*a*, 155*b*, and 156 (see FIG. 3, FIG. 22A, and FIG. 22B);
b) Can medicinally beneficially allow those with arthritic hands to keep their hands straight and to match the curvature of arthritic-aiding ring elevator 121 with the natural curvature of their hands
to eliminate the needs for bending fingers and/or wrist, and
to eliminate hand pain when operating arthritic-aiding ring elevator 121
in the directions of arrows 154 and 156
(see FIG. 22A, and FIG. 22B); and
c) Can conveniently hook and store pulley cord 125 thereon
(see FIG. 17)

4) It is another object of the new invention to provide an arthritic-aiding triple-sail wind-rotating wind-aligning auditory-pin-snap-locking-and-centering umbrella, having
arthritic-aiding ergonomic cord-hook grip ring 132 and anti-finger-pinching spacer 133.
Therefore, the arthritic-aiding triple-sail wind-rotating wind-aligning auditory-pin-snap-locking-and-centering umbrella:
a) Can encircle the broad surface of the metacarpals of the palm of the hand or the broad surface of the union of the metacarpals with the base of the phalanges,
to provide an enlarged surface area to engage with the palm of an open hand to insert a locking pin, providing greater comfort and availability to an arthritic suffering person
(FIG. 18B, FIG. 25A, FIG. 25B, and FIG. 26A);

b) Can encircle the broad surface of the metacarpals of the back of the hand or the broad surface of the union of the metacarpals with the base of the phalanges,
to provide an enlarged surface area; to engage with the back of an open hand; to extract a locking pin, providing greater comfort and availability to an arthritic suffering person
(FIG. 18B, FIG. 25A, FIG. 25B, and FIG. 26A);

c) Can allow a user with an arthritic hand to keep his/her hand straight,
to eliminate the needs to bend ones' fingers and wrist when holding and operating arthritic-aiding cord-hook grip ring
(FIG. 18B, FIG. 25A, FIG. 25B, and FIG. 26A); and d) Can allow a user with an arthritic hand to keep his/her hand straight,
to render access to the interior of the hook section, for conveniently storing a coiled excess portion of a pulley cord
(FIG. 18B, FIG. 25A, FIG. 25B, and FIG. 26A).

5) It is another object of the new invention to provide an arthritic-aiding triple-sail wind-rotating wind-aligning auditory-pin-snap-locking-and-centering umbrella, having
auditorily-snap-locking recess 135,
four auditorily-snap-locking leaf springs 138, and
four auditorily-snap-locking nipples 139.
Therefore, the arthritic-aiding triple-sail wind-rotating wind-aligning auditory-pin-snap-locking-and-centering umbrella:

a) Can emit a snapping sound loud enough
to allow a person to hear the sound and recognize the moment that a locking pin is fully engaged
(FIG. 26A, FIG. 26B, FIG. 26C, and FIG. 26D);

b) Can transmit a vibration-emitting movement, projected by an interaction between two of four auditorily-snap-locking nipples,
to allow a person, utilizing their tactile senses, to recognize the moment a locking pin has fully engaged
(FIG. 26A, FIG. 26B, FIG. 26C, and FIG. 26D);

c) Can lock with one action,
to eliminate the need to secondarily insert a cotter key, or split-wire ring, to secure pin in vertical post
(FIG. 26A, FIG. 26B, FIG. 26C, and FIG. 26D); and d) Can easily and instantly be inserted and extracted with minimal effort,
to eliminate pain experienced by an arthritic person
(FIG. 26A, FIG. 26B, FIG. 26C, and FIG. 26D).

6) It is still another object of the new invention to provide an arthritic-aiding triple-sail wind-rotating wind-aligning auditory-pin-snap-locking-and-centering umbrella, having
arthritic-aiding canopy-tension-adjusting system 111.
Therefore, the arthritic-aiding triple-sail wind-rotating wind-aligning auditory-pin-snap-locking-and-centering umbrella:

a) Can easily adjust,
to compensate for conditions resulting in canopy fabric being too small or too tight
(FIG. 23A, FIG. 23B, FIG. 23C, and FIG. 23D);

b) Can easily adjust,
to compensate for conditions which loosen the canopy fabric causing sagging
(FIG. 23A, FIG. 23B, FIG. 23C, and FIG. 23D); and c) Can provide internally-threaded tension-adjusting knobs whose flat surface can be easily rotated open-handed, by an arthritic hand
to eliminate the need to curl fingers to rotate, causing pain to an arthritic suffering person
(FIG. 23A, FIG. 23B, FIG. 23C, and FIG. 23D).

7) It is yet still another object of the new invention to provide an arthritic-aiding triple-sail wind-rotating wind-aligning auditory-pin-snap-locking-and-centering umbrella, having
two pin-centering pin-guiding tubes 137.
Therefore, the arthritic-aiding triple-sail wind-rotating wind-aligning auditory-pin-snap-locking-and-centering umbrella:

a) Can provide two tapered cone-shaped receiving apertures, on opposing ends, acting as a funnel while an arthritic suffering person inserts a locking pin,
to aid shaky arthritic hand to easily locate the tip of a locking pin to the inwardly tapered cone-shaped receiving apertures
(FIG. 25A, FIG. 25B, FIG. 26A, FIG. 26B, FIG. 26C and FIG. 26D);

b) Can provide a conduit between two umbrella-pole pin openings,
to eliminate difficulty lining up common pin holes on either side for an arthritic hand
(FIG. 25A, FIG. 25B, FIG. 26A, FIG. 26B, FIG. 26C and FIG. 26D);

c) Can provide a very low-friction material and low-friction internal surface,
to aid a shaky arthritic hand to effortlessly slide a locking pin into and through the two pin-centering pin-guiding tubes
(FIG. 25A, FIG. 25B, FIG. 26A, FIG. 26B, FIG. 26C and FIG. 26D); and d) Can provide two inwardly tapered cone-shaped receiving apertures, on opposing ends,
to provide greater access to, and increase comfort for a painful arthritic hand
(FIG. 25A, FIG. 25B, FIG. 26A, FIG. 26B, FIG. 26C and FIG. 26D).

8) It is a further object of the new invention to provide an arthritic-aiding triple-sail wind-rotating wind-aligning auditory-pin-snap-locking-and-centering umbrella, having
four internally-taperedly-threaded flexible towers 140.
Therefore, the arthritic-aiding triple-sail wind-rotating wind-aligning auditory-pin-snap-locking-and-centering umbrella:

a) Can simply be inserted from the top or bottom of an umbrella pole,
to overcome the need to have special tooling and reduce costs, materials, and labor
(FIG. 19A, FIG. 19B, FIG. 19C, and FIG. 19D);

b) Can secure within an umbrella pole, by the turn of a tower-locking screw,
to lock them in position, using a simple method, designed to reduce costs, materials, and labor
(FIG. 19A, FIG. 19B, FIG. 19C, and FIG. 19D);

c) Can provide a cost-saving manufacturing method by being molded into a one-piece unit,
to reduce manufacturing costs and conserve molding materials
(FIG. 19A, FIG. 19B, FIG. 19C, and FIG. 19D); and d) Can provide a cost-saving manufacturing method by being molded into a one-piece unit,
to reduce labor during assembly
(FIG. 19A, FIG. 19B, FIG. 19C, and FIG. 19D).

9) It is still a further object of the new invention to provide an arthritic-aiding triple-sail wind-rotating wind-aligning auditory-pin-snap-locking-and-centering umbrella, having
twelve triangular tower leaf springs 141.
Therefore, the arthritic-aiding triple-sail wind-rotating wind-aligning auditory-pin-snap-locking-and-centering umbrella:
a) Can create a low-pressure friction fit within an umbrella pole, with respectively evenly-distributed pressure around the perimeter,
to securely position the arthritic-aiding pin-centering pin-guiding auditorily-snap-locking tower-locking system with minimal pressure being exerted against the internal structure of an umbrella pole
(FIG. 19A, FIG. 19B, FIG. 19C, and FIG. 19D);
b) Can create a low-pressure friction fit within an umbrella pole,
to prevent over-tightening of the four internally-taperedly-threaded flexible towers during assembly
(FIG. 19A, FIG. 19B, FIG. 19C, and FIG. 19D);
c) Can provide a cost-saving manufacturing technique,
to reduce manufacturing costs and conserve molding materials
(FIG. 19A, FIG. 19B, FIG. 19C, and FIG. 19D); and
d) Can provide arched leaf springs, creating an evenly-distributed-pressure friction fit within an umbrella pole,
to exert adequate outward pressure, without exerting excessive pressure, and self-adjust as needed in response to environmental conditions
(FIG. 19A, FIG. 19B, FIG. 19C, and FIG. 19D).

10) It is yet still a further object of the new invention to provide an arthritic-aiding triple-sail wind-rotating wind-aligning auditory-pin-snap-locking-and-centering umbrella, having
anti-cable-fraying cable-locking gear-cam system 126.
Therefore, the arthritic-aiding triple-sail wind-rotating wind-aligning auditory-pin-snap-locking-and-centering umbrella:
a) Can overcome common impediments of prior art,
to allow an arthritic sufferer to utilize the umbrella system
(FIG. 24A, FIG. 24B, and FIG. 24C);
b) Can overcome the need required by prior art, to curl thumb and fingers of a single hand around a pole to engage the locking pin,
to insert or compress a spring activated pin, or a manually inserted pin, into vertical umbrella center pole pin hole
(FIG. 24A, FIG. 24B, and FIG. 24C);
c) Can allow opposing pressure from between thumb and fingers of a single hand around a pole to engage the locking pin,
to insert or compress a spring activated pin, or a manually inserted pin, into vertical umbrella center pole pin hole
(FIG. 24A, FIG. 24B, and FIG. 24C); and
d) Can allow opposing pressure from another hand, such as an opposing left hand or an opposing right hand,
to insert or compress a spring activated pin, or a manually inserted pin, into vertical umbrella center pole pin hole
(FIG. 24A, FIG. 24B, and FIG. 24C).

Other objects and advantages of the present invention will become apparent from the consideration of the accompanying drawings and ensuing description.

SUMMARY OF THE INVENTION

An arthritic-aiding triple-sail wind-rotating wind-aligning auditory-pin-snap-locking-and-centering umbrella comprising: first and second and third arthritic-aiding canopy-rotating-and-aligning sails, a canopy attached to the first and second and third arthritic-aiding sails and having tension-adjusting oval openings, a pole having a fixed hub and a movable hub and at least one pin opening, an adjustable hub-rotation-preventing slot formed in the pole, an adjustable hub-rotation-preventing peg attached to the fixed hub and inserted into the adjustable hub-rotation-preventing slot, an arthritic-aiding ring elevator attached to the movable hub, tension-adjusting rods, rod-locking screws respectively screwed through the tension-adjusting oval openings and into the tension-adjusting rod, three pulleys respectively screwed to the fixed and movable hubs, a pulley cord threaded on the three pulleys and attached to the movable hub, two oval cord-locking gear cams attached to the movable hub, at least one pin opening drilled through the pole, a locking pin having an arthritic-aiding ergonomic grip ring, a recess molded on the locking pin, at least one pin-centering-and-guiding plug and tube having built-in auditorily-snap-locking leaf springs and leaf-spring towers inserted into the pole and aligned with the at least one pin opening, and a tower-locking screw screwed between the leaf-spring towers for locking the towers inside the pole.

BRIEF DESCRIPTION OF THE DRAWINGS

FIG. 15, FIG. 16A, and FIG. 16B illustrate perspective views of an anti-cable-fraying cable-locking gear-cam system and its varying components.

FIG. 24A, FIG. 24B, and FIG. 24C illustrate perspective views of an anti-cable-fraying cable-locking gear-cam system.

DETAILED DESCRIPTION OF THE INVENTION

Figure 1:
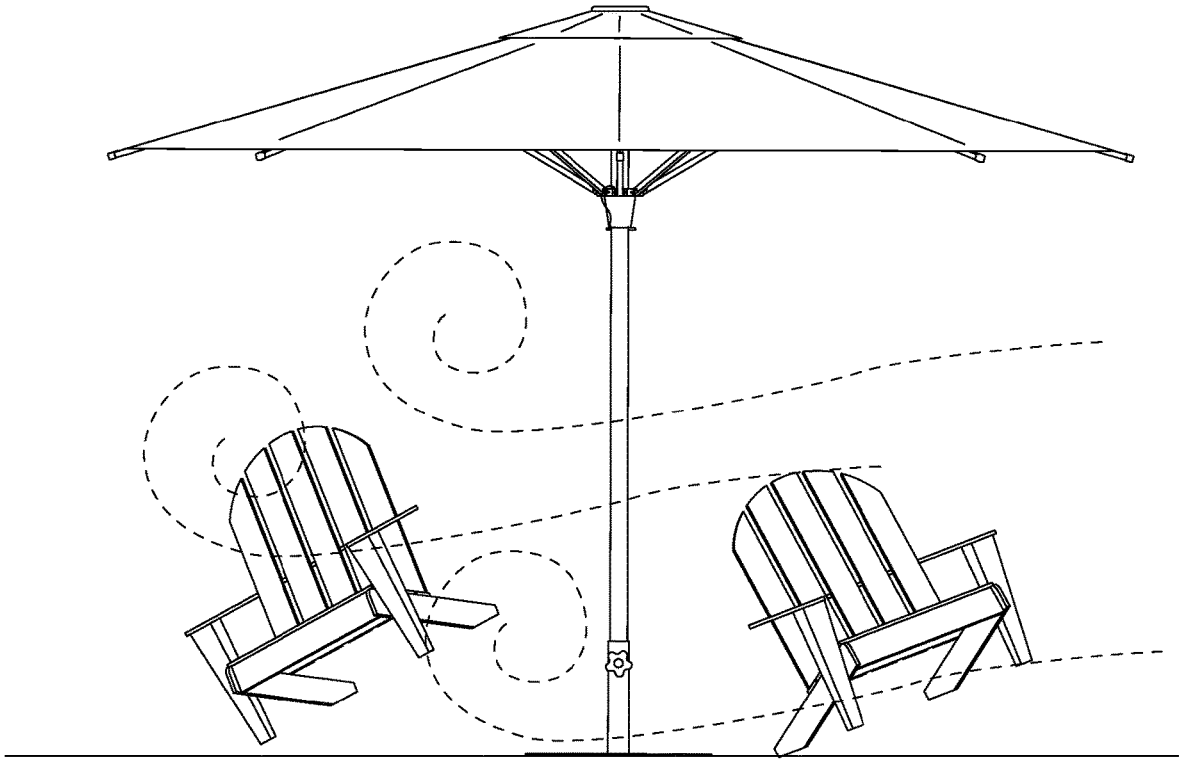
FIG. 1 (Prior Art)
FIG. 1 (Prior Art) illustrates a side view of the problem that can occur when the wind blows with prior art umbrellas that do not block the wind (for example, wind from all directions blew away paper napkin, paper plates, paper cup, paper table mats, paper table cloths).
Figure 2:
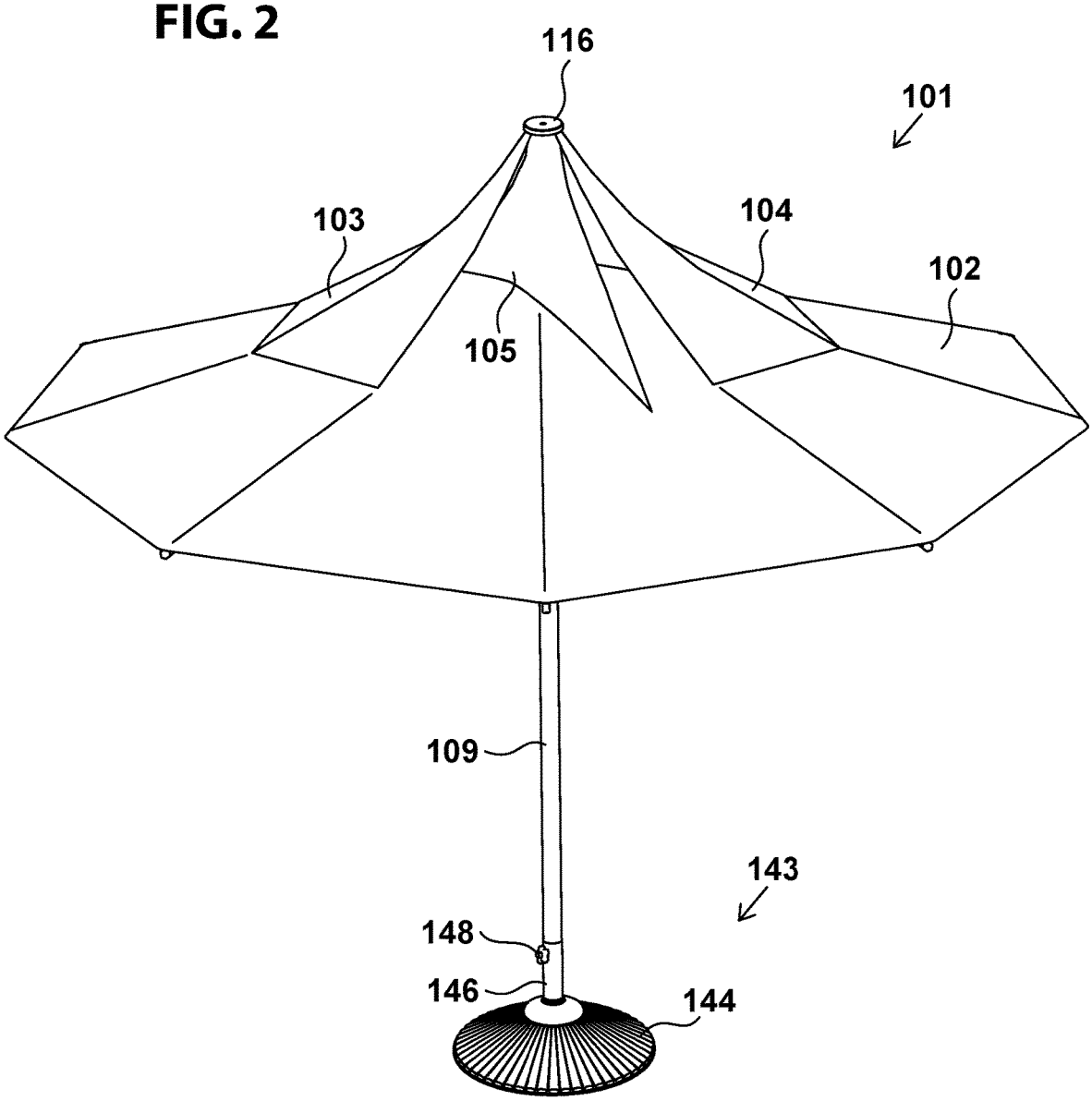
FIG. 2, FIG. 3, and FIG. 4 illustrate perspective, side, and top views of the arthritic-aiding triple-sail wind-rotating wind-aligning auditory-pin-snap-locking-and-centering umbrella.

The arthritic-aiding triple-sail wind-rotating wind-aligning auditory-pin-snap-locking-and-centering umbrella comprises:

1) An arthritic-aiding triple-sail-canopy and pole system,
2) An arthritic-aiding canopy-tension-adjusting system,
3) An arthritic-aiding rib-hub system,
4) An arthritic-aiding tri-pulley system,
5) An anti-cable-fraying cable-locking gear-cam system,
6) An arthritic-aiding pin-centering pin-guiding auditorily-snap-locking tower-locking system, and
7) An adjustable-friction base system.

Component

Referring to FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16A, FIG. 16B, FIG. 17, FIG. 18A, FIG. 18B, FIG. 19A, FIG. 19B, FIG. 19C, FIG. 19D, FIG. 19E, FIG. 20A, FIG. 20B, FIG. 20C, and FIG. 20D, the arthritic-aiding triple-sail wind-rotating wind-aligning auditory-pin-snap-locking-and-centering umbrella comprises:

1) Arthritic-aiding triple-sail-canopy and pole system 101, comprising:
2) Canopy 102,
3) First arthritic-aiding canopy-rotating-and-aligning sail 103,
4) Second arthritic-aiding canopy-rotating-and-aligning sail 104,
5) Third arthritic-aiding canopy-rotating-and-aligning sail 105,
6) Upper ribs 106,
7) Lower ribs 107,
8) Foldable rib joints 108, and
9) Umbrella pole 109,
10) Adjustable hub-rotation-preventing slot 110;
11) Arthritic-aiding canopy-tension-adjusting system 111, comprising:
12) Protracting-rod-locking screws 112,
13) Protracting-rod-locking washers 113, and
14) Tension-adjusting oval rib openings 114;
15) Arthritic-aiding rib-hub system 115, comprising:
16) Canopy-securing crown 116,
17) Crown-securing screw 117,
18) Fixed hub 118, and
19) Adjustable hub-rotation-preventing peg 119;
20) Movable hub 120, and
21) Arthritic-aiding ring elevator 121;
22) Arthritic-aiding tri-pulley system 122, comprising:
23) Two fixed-hub pulleys 123,
24) Movable-hub pulley 124, and
25) Pulley cord 125;
26) Anti-cable-fraying cable-locking gear-cam system 126, comprising:
27) Gear-cam mount 127,
28) Two gear cams 128, and
29) Cord blocker 129; and
30) Arthritic-aiding pin-centering pin-guiding auditorily-snap-locking tower-locking system 130, comprising:
31) Two umbrella-pole pin openings 131,
32) Arthritic-aiding ergonomic cord-hook grip ring 132,
33) Anti-finger-pinching spacer 133,
34) Locking pin 134,
35) Auditorily-snap-locking recess 135, 36) Two pin-centering pin-guiding plugs 136,
37) Two pin-centering pin-guiding tubes 137,
38) Four auditorily-snap-locking leaf springs 138,
39) Four auditorily-snap-locking nipples 139,
40) Four internally-taperedly-threaded flexible towers 140,
41) Twelve triangular tower leaf springs 141, and
42) Tower-locking screw 142,
43) Adjustable-wedging base system 143, comprising:
44) Base 144,
45) Wedging regulator 145,
46) Pole receiver 146,
47) Threaded screw-knob hole 147,
48) Pole-securing screw-knob 148,
49) Pole-receiver plate 149,
50) Plate bolt 150.

Material

Referring to FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16A, FIG. 16B, FIG. 17, FIG. 18A, FIG. 18B, FIG. 19A, FIG. 19B, FIG. 19C, FIG. 19D, FIG. 19E, FIG. 20A, FIG. 20B, FIG. 20C, and FIG. 20D:

1) Arthritic-aiding triple-sail-canopy and pole system 101 is made of the combined materials of its components.
2) Canopy 102 is made up of canvas, fabric, or nylon material.
3) First arthritic-aiding canopy-rotating-and-aligning sail 103 is made of fabric or nylon material.
4) Second arthritic-aiding canopy-rotating-and-aligning sail 104 is made of canvas, fabric, or nylon material.
5) Third arthritic-aiding canopy-rotating-and-aligning sail 105 is made of canvas, fabric, or nylon material.
6) Upper ribs 106 each are made of metallic material.
7) Lower ribs 107 each are made of metallic material.
8) Foldable rib joints 108 each are made of plastic material.
9) Umbrella pole 109 is made of metallic material.
10) Adjustable hub-rotation-preventing slot 110 is made of empty space.
11) Arthritic-aiding canopy-tension-adjusting system 111 is made of the combined materials of its components.
12) Protracting-rod-locking screws 112 each are made of metallic material.
13) Protracting-rod-locking washers 113 is made of rubber and/or plastic material.
14) Tension-adjusting oval rib openings 114 is made of empty space.
15) Arthritic-aiding rib-hub system 115 is made of the combined materials of its components.
16) Canopy-securing crown 116 each are made of metallic material.
17) Crown-securing screw 117 each are made of metallic material.
18) Fixed hub 118 is made of plastic material.
19) Adjustable hub-rotation-preventing peg 119 is made of plastic and/or metallic material.
20) Movable hub 120 is made of plastic material.
21) Arthritic-aiding ring elevator 121 is made of plastic material.
22) Arthritic-aiding tri-pulley system 122 is made of the combined materials of its components.
23) Two fixed-hub pulleys 123 each are made of plastic and/or metallic material.
24) Movable-hub pulley 124 is made of plastic and/or metallic material.
25) Pulley cord 125 is made of fabric and/or nylon material.
26) Anti-cable-fraying cable-locking gear-cam system 126 is made of the combined materials of its components.
27) Gear-cam mount 127 is made of plastic material.
28) Two gear cams 128 each are made of plastic material.
29) Cord blocker 129 is made of metallic material.
30) Arthritic-aiding pin-centering pin-guiding auditorily-snap-locking tower-locking system 130 is made of the combined materials of its components.
31) Two umbrella-pole pin openings 131 is made of empty space.
32) Arthritic-aiding ergonomic cord-hook grip ring 132 is made of metallic material.
33) Anti-finger-pinching spacer 133 is made of metallic material.
34) Locking pin 134 is made of metallic material.
35) Auditorily-snap-locking recess 135 is made of empty space.
36) Two pin-centering pin-guiding plugs 136 each are made of plastic material.
37) Two pin-centering pin-guiding tubes 137 each are made of plastic material.
38) Four auditorily-snap-locking leaf springs 138 each are made of plastic material.
39) Four auditorily-snap-locking nipples 139 each are made of plastic material.
40) Four internally-taperedly-threaded flexible towers 140 each are made of plastic material.
41) Twelve triangular tower leaf springs 141 each are made of plastic material.
42) Tower-locking screw 142 is made of metallic material.
43) Adjustable-wedging base system 143 is made of the combined materials of its components.
44) Base 144 is made of plastic material.
45) Wedging regulator 145 is made of plastic material.
46) Pole receiver 146 is made of metallic material.
47) Threaded screw-knob hole 147 is made of empty space.
48) Pole-securing screw-knob 148 is made of plastic and/or metallic material.
49) Pole-receiver plate 149 is made of metallic material.
50) Plate bolt 150 is made of metallic material.

Shape

Referring to FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16A, FIG. 16B, FIG. 17, FIG. 18A, FIG. 18B, FIG. 19A, FIG. 19B, FIG. 19C, FIG. 19D, FIG. 19E, FIG. 20A, FIG. 20B, FIG. 20C, and FIG. 20D:

1) Arthritic-aiding triple-sail-canopy and pole system 101 is formed into the combined shapes of its components.
2) Canopy 102 is formed into an octagon.
3) First arthritic-aiding canopy-rotating-and-aligning sail 103 is formed into a triangle.
4) Second arthritic-aiding canopy-rotating-and-aligning sail 104 is formed into a triangle.
5) Third arthritic-aiding canopy-rotating-and-aligning sail 105 is formed into a triangle.
6) Upper ribs 106 each are formed into a tubular shape.
7) Lower ribs 107 each are formed into a tubular shape.
8) Foldable rib joints 108 each are formed into a U shape.
9) Umbrella pole 109 is formed into a tubular shape.
10) Adjustable hub-rotation-preventing slot 110 is formed into an elongated oval empty space.
11) Arthritic-aiding canopy-tension-adjusting system 111 is formed into the combined shapes of its components.
12) Protracting-rod-locking screws 112 each are formed into a screw shape.
13) Protracting-rod-locking washers 113 is formed into a ring shape.
14) Tension-adjusting oval rib openings 114 is formed into an oval shape.

15) Arthritic-aiding rib-hub system 115 is formed into the combined shapes of its components.
16) Canopy-securing crown 116 each are formed into a mushroom shape.
17) Crown-securing screw 117 each are formed into a screw shape.
18) Fixed hub 118 is formed into a gear shape.
19) Adjustable hub-rotation-preventing peg 119 is formed into a stick shape.
20) Movable hub 120 is formed into a gear shape.
21) Arthritic-aiding ring elevator 121 is formed into a ring shape.
22) Arthritic-aiding tri-pulley system 122 is formed into the combined shapes of its components.
23) Two fixed-hub pulleys 123 each are formed into a pulley shape.
24) Movable-hub pulley 124 is formed into a pulley shape.
25) Pulley cord 125 is formed into a round-cord shape.
26) Anti-cable-fraying cable-locking gear-cam system 126 is formed into the combined shapes of its components.
27) Gear-cam mount 127 is formed into an oval shape.
28) Two gear cams 128 each are formed into an oval gear shape.
29) Cord blocker 129 is formed into a round-wire shape.
30) Arthritic-aiding pin-centering pin-guiding auditorily-snap-locking tower-locking system 130 is formed into the combined shapes of its components.
31) Two umbrella-pole pin openings 131 is formed into a circular shape.
32) Arthritic-aiding ergonomic cord-hook grip ring 132 is formed into an oval shape.
33) Anti-finger-pinching spacer 133 is formed into a round shape.
34) Locking pin 134 is formed into a round-bar shape.
35) Auditorily-snap-locking recess 135 is formed into a round-tubular shape.
36) Two pin-centering pin-guiding plugs 136 each are formed into a round tubular shape.
37) Two pin-centering pin-guiding tubes 137 each are formed into a round tubular shape.
38) Four auditorily-snap-locking leaf springs 138 each are formed into a long-flat shape.
39) Four auditorily-snap-locking nipples 139 each are formed into a round shape.
40) Four internally-taperedly-threaded flexible towers 140 each are formed into an elongated-L-bracket shape.
41) Twelve triangular tower leaf springs 141 each are formed into a triangular-flat shape.
42) Tower-locking screw 142 is formed into a screw shape.
43) Adjustable-wedging base system 143 is formed into the combined shapes of its components.
44) Base 144 is formed into a round-pyramid shape.
45) Wedging regulator 145 is formed into a C shape.
46) Pole receiver 146 is formed into a round-tubular shape.
47) Threaded screw-knob hole 147 is formed into a round shape.
48) Pole-securing screw-knob 148 is formed into a screw-knob shape.
49) Pole-receiver plate 149 is formed into a square shape.
50) Plate bolt 150 is formed into a bolt shape.

Connection

Referring to FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16A, FIG. 16B, FIG. 17, FIG. 18A, FIG. 18B, FIG. 19A, FIG. 19B, FIG. 19C, FIG. 19D, FIG. 19E, FIG. 20A, FIG. 20B, FIG. 20C, and FIG. 20D:

1) Arthritic-aiding triple-sail-canopy and pole system 101 has the combined connections of its components.
2) Canopy 102 is screwed to upper ribs 106.
3) First arthritic-aiding canopy-rotating-and-aligning sail 103 is sewn to canopy 102.
4) Second arthritic-aiding canopy-rotating-and-aligning sail 104 is sewn to canopy 102.
5) Third arthritic-aiding canopy-rotating-and-aligning sail 105 is sewn to canopy 102.
6) Upper ribs 106 respectively are pivotably screwed to fixed hub 118.
7) Lower ribs 107 respectively are pivotably screwed to movable hub 120.
8) Foldable rib joints 108 respectively are screwed to upper ribs 106.
9) Umbrella pole 109 is inserted through fixed hub 118 and movable hub 120.
10) Adjustable hub-rotation-preventing slot 110 is cut into umbrella pole 109.
11) Arthritic-aiding canopy-tension-adjusting system 111 has the combined connections of its components.
12) Protracting-rod-locking screws 112 respectively are screwed through protracting-rod-locking washers 113 and into tension-adjusting oval rib openings 114.
13) Protracting-rod-locking washers 113 slid on protracting-rod-locking screws 112.
14) Tension-adjusting oval rib openings 114 respectively are drilled in upper ribs 106.
15) Arthritic-aiding rib-hub system 115 has the combined connections of its components.
16) Canopy-securing crown 116 is screwed to crown-securing screw 117.
17) Crown-securing screw 117 is screwed to fixed hub 118.
18) Fixed hub 118 is screwed to umbrella pole 109.
19) Adjustable hub-rotation-preventing peg 119 is molded to fixed hub 118 and lockibly inserted into adjustable hub-rotation-preventing slot 110.
20) Movable hub 120 is slid onto adjustable hub-rotation-preventing slot 110.
21) Arthritic-aiding ring elevator 121 is molded to the bottom of movable hub 120.
22) Arthritic-aiding tri-pulley system 122 has the combined connections of its components.
23) Two fixed-hub pulleys 123 respectively are screwed to fixed hub 118.
24) Movable-hub pulley 124 is screwed to movable hub 120.
25) Pulley cord 125 is threaded through two fixed-hub pulleys 123, movable-hub pulley 124, and attached to movable hub 120.
26) Anti-cable-fraying cable-locking gear-cam system 126 has the combined connections of its components.
27) Gear-cam mount 127 is screwed to arthritic-aiding ring elevator 121.
28) Two gear cams 128 respectively are screwed to gear-cam mount 127.
29) Cord blocker 129 respectively are screwed to two gear cams 128.
30) Arthritic-aiding pin-centering pin-guiding auditorily-snap-locking tower-locking system 130 has the combined connections of its components.
31) Two umbrella-pole pin openings 131 respectively are drilled into umbrella pole 109.
32) Arthritic-aiding ergonomic cord-hook grip ring 132 is attached to locking pin 134.
33) Anti-finger-pinching spacer 133 is screwed to arthritic-aiding ergonomic cord-hook grip ring 132.

34) Locking pin 134 is molded to anti-finger-pinching spacer 133,

35) Auditorily-snap-locking recess 135 is molded in locking pin 134.

36) Two pin-centering pin-guiding plugs 136 respectively are molded to each other, and respectively are inserted into umbrella pole 109.

37) Two pin-centering pin-guiding tubes 137 respectively are molded in two pin-centering pin-guiding plugs 136, and respectively are aligned with two umbrella-pole pin openings 131.

38) Four auditorily-snap-locking leaf springs 138 respectively are molded on the opposite walls of two pin-centering pin-guiding tubes 137.

39) Four auditorily-snap-locking nipples 139 respectively are molded on four auditorily-snap-locking leaf springs 138.

40) Four internally-taperedly-threaded flexible towers 140 respectively are molded to one of two pin-centering pin-guiding plugs 136.

41) Twelve triangular tower leaf springs 141 respectively are molded to four internally-taperedly-threaded flexible towers 140.

42) Tower-locking screw 142 is screwed between and on four internally-taperedly-threaded flexible towers 140.

43) Adjustable-wedging base system 143 has the combined connections of its components.

44) Base 144 is slid around wedging regulator 145.

45) Wedging regulator 145 is inserted into base 144.

46) Pole receiver 146 is inserted into wedging regulator 145.

47) Threaded screw-knob hole 147 is drilled into the side of pole receiver 146.

48) Pole-securing screw-knob 148 is screwed into threaded screw-knob hole 147.

49) Pole-receiver plate 149 inserted into the bottom of base 144.

50) Plate bolt 150 is screwed through pole-receiver plate 149 into the bottom of pole receiver 146.

Function

Referring to FIG. 21A, FIG. 21B, FIG. 21C, FIG. 21D, FIG. 21E, FIG. 21F, FIG. 22A, FIG. 22B, FIG. 23A, FIG. 23B, FIG. 23C, FIG. 23D, FIG. 24A, FIG. 24B, FIG. 24C, FIG. 25A, FIG. 25B, FIG. 26A, FIG. 26B, FIG. 26C, and FIG. 26D:

1) Arthritic-aiding triple-sail-canopy and pole system 101 is for performing the combined functions of its components.

2) Canopy 102 is for:
providing shade.

3) First arthritic-aiding canopy-rotating-and-aligning sail 103 is for:

a) Catching wind to use wind to automatically rotate canopy 102 and umbrella pole 109 to align with the direction of wind
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), b) Automatically aligning canopy 102 with the direction of wind to block wind from occupants (using the extended section of canopy 102)
to protect occupants and belongings
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), c) Assisting those with arthritis by automatically aligning canopy 102 with the direction of wind to block wind from occupants
to prevent arthritic from having to use hands to adjust canopy 102
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), d) Preventing canopy 102 from blowing over by automatically aligning canopy 102 to the direction of wind to prevent injury to occupants and damage to property
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), e) Automatically and repeatedly adjusting canopy 102 to the direction of wind when the direction of wind changes
to provide ease of use for user
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F)

4) Second arthritic-aiding canopy-rotating-and-aligning sail 104 is for:

a) Catching wind to use wind to automatically rotate canopy 102 and umbrella pole 109 to align with the direction of wind
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), b) Automatically aligning canopy 102 with the direction of wind to block wind from occupants (using the extended section of canopy 102)
to protect occupants and belongings
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), c) Assisting those with arthritis by automatically aligning canopy 102 with the direction of wind to block wind from occupants
to prevent from having to use hands to adjust canopy 102
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), d) Preventing canopy 102 from blowing over by automatically aligning canopy 102 to the direction of wind to prevent injury to occupants and damage to property
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), e) Automatically and repeatedly adjusting canopy 102 to the direction of wind when the direction of wind changes
to provide ease of use for user
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F)

5) Third arthritic-aiding canopy-rotating-and-aligning sail 105 is for:

a) Catching wind to use wind to automatically rotate canopy 102 and umbrella pole 109 to align with the direction of wind
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), b) Automatically aligning canopy 102 with the direction of wind to block wind from occupants (using the extended section of canopy 102)
to protect occupants and belongings
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), c) Assisting those with arthritis by automatically aligning canopy 102 with the direction of wind to block wind from occupants
to prevent from having to use hands to adjust canopy 102
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), d) Preventing canopy 102 from blowing over by automatically aligning canopy 102 to the direction of wind to prevent injury to occupants and damage to property
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F), e) Automatically and repeatedly adjusting canopy 102 to the direction of wind when the direction of wind changes
to provide ease of use for user
in the directions of arrows 151*a*, 151*b*, 151*c*, 151*d*, 151*e*, 151*f*, 152*a*, 152*b*, 152*c*, 152*d* and 152*e*
(see FIG. 21A, FIG. 21B, FIG. 21C, FIG. 21D, FIG. 21E, and FIG. 21F).

6) Upper ribs 106 respectively are for:
Framingly bracing canopy 102.

7) Lower ribs 107 respectively are for:
Pivotably bracing upper ribs 106.

8) Foldable rib joints 108 respectively are for:
Pivotably securing upper ribs 106 to lower ribs 107
to allow upper ribs 106 and lower ribs 107
to fold and to deploy
in the directions of arrows 153*a*, 153*b*, 154, 155*a*, 155*b*, and 156 (see FIG. 22A and FIG. 22B).

9) Umbrella pole 109 is for:
Supporting arthritic-aiding rib-hub system 115 and housing arthritic-aiding pin-centering pin-guiding auditorily-snap-locking tower-locking system 130.

10) Adjustable hub-rotation-preventing slot 110 is for:
Securing adjustable hub-rotation-preventing peg 119
to prevent fixed hub 118 from turning radially.

11) Arthritic-aiding canopy-tension-adjusting system 111 is for performing the combined functions of its components.

12) Protracting-rod-locking screws 112 respectively are for:
Threadedly securing canopy 102 to upper ribs 116

13) Protracting-rod-locking washers 113 respectively are for:
Protecting canopy 102 from protracting-rod-locking screws 112.

14) Tension-adjusting oval rib openings 114 respectively are for:
Providing adjustable-tension space to protracting-rod-locking screws 112 in the directions of arrows 157 and 158
(see FIG. 23C and FIG. 23D).

15) Arthritic-aiding rib-hub system 115 is for performing the combined functions of its components.

16) Canopy-securing crown 116 is for:
Being screwed on crown screw 117.

17) Crown-securing screw 117 is for:
Securing canopy-securing crown 116 to umbrella pole 109.

18) Fixed hub 118 is for:
Pivotably securing upper ribs 106.

19) Adjustable hub-rotation-preventing peg 119 is for:
Securing fixed hub 118 from spinning radially.

20) Movable hub 120 is for:
Pivotably securing lower ribs 107.

21) Arthritic-aiding ring elevator 121 is for:
Providing an arthritic-aiding slidable handle to push up and pull down movable hub 120 to deploy and retract upper ribs 106 and lower ribs 107, respectively
to allow and assist those with arthritic hands to erect and retract umbrella without to need to bend the fingers or wrist
in the directions of arrows 153*a*, 153*b*, 154, 155*a*, 155*b*, and 156
(see FIG. 22A and FIG. 22B).

22) Arthritic-aiding tri-pulley system 122 is for performing the combined functions of its components.

23) Two fixed-hub pulleys 123 respectively are for:
Rotatably reducing the pulling force needed to hoist arthritic-aiding rib-hub system 115.

24) Movable-hub pulley 124 is for:
Rotatably reducing the pulling force needed to hoist arthritic-aiding rib-hub system 115.

25) Pulley cord 125 is for:
Hoisting and lowering arthritic-aiding rib-hub system 115.

26) Anti-cable-fraying cable-locking gear-cam system 126 is for performing the combined functions of its components.

27) Gear-cam mount 127 is for:
Mounting two gear cams 128 on arthritic-aiding ring elevator 121.

28) Two gear cams 128 respectively are for:
a) Centering pulley cord 125 to allow pulley cord 125 to move
in the direction of arrow 159
(see FIG. 24B), and
b) Clampingly securing pulley cord 125 therebetween
in the direction of arrow 160
(see FIG. 24C).

29) Cord blocker 129 is for:
a) Eliminating the problems of pulley cord 125 fraying and breaking,
b) Centering pulley cord 125, and
c) Preventing pulley cord 125 from going astray.

30) Arthritic-aiding pin-centering pin-guiding auditorily-snap-locking tower-locking system 130 is for performing the combined functions of its components.

31) Two umbrella-pole pin openings 131 respectively are for:
Inserting locking pin 134 therethrough.

32) Arthritic-aiding ergonomic cord-hook grip ring 132 is for:
a) Medicinally beneficially allowing those with arthritic hands to keep their hands straight and to match the curvature of arthritic-aiding ergonomic cord-hook grip ring 132 with the natural curvature of their hands with to eliminate the needs for bending fingers and/or wrist, and to eliminate hand pain when holding and operating arthritic-aiding ergonomic cord-hook grip ring 132 by inserting hand through arthritic-aiding ergonomic cord-hook grip ring 132 and inserting locking pin 134 into one of two pin-centering pin-guiding tubes 137 in the direction of arrow 161

Figure 17:
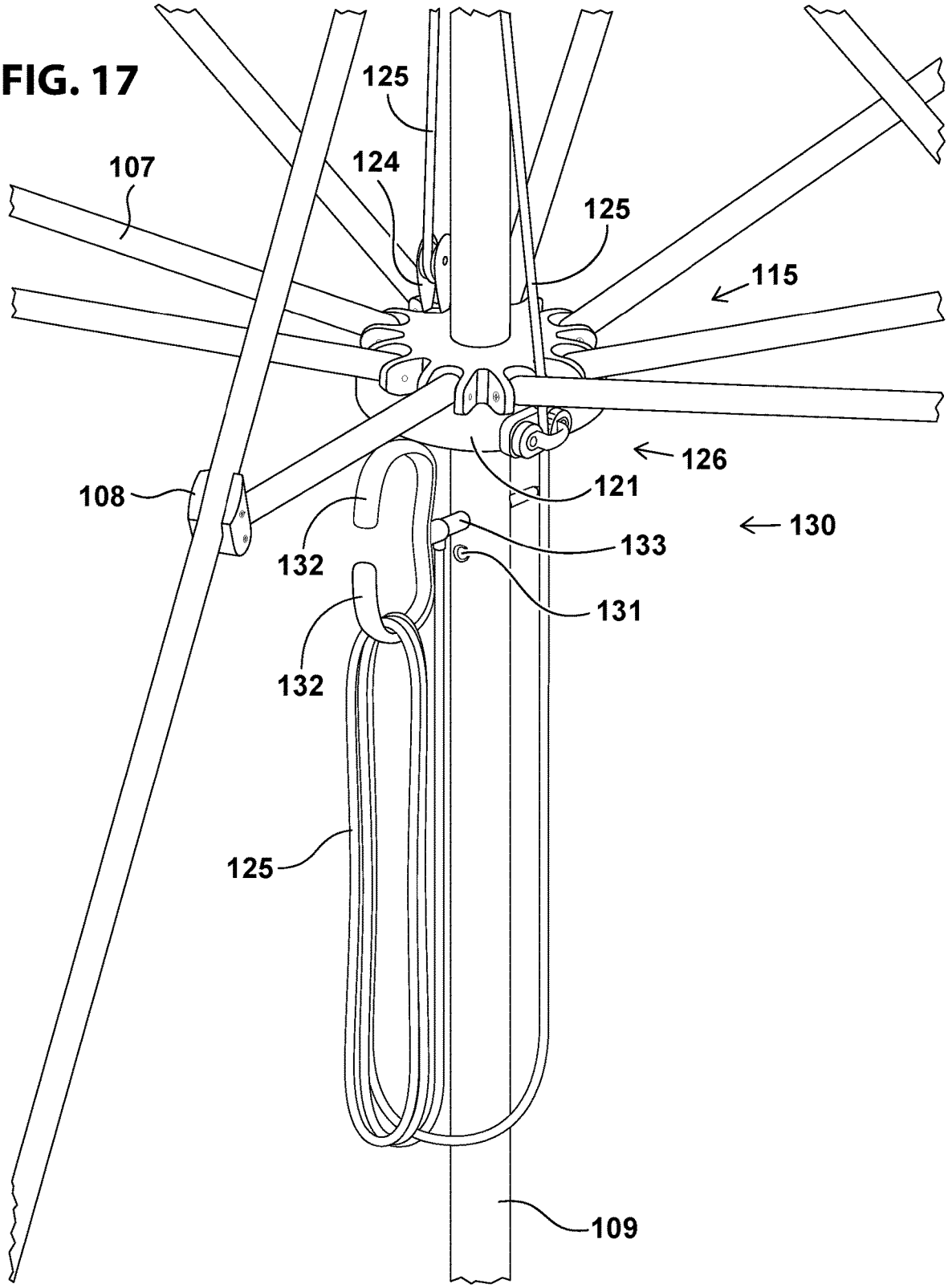
FIG. 17, FIG. 18A, FIG. 18B, FIG. 19A, FIG. 19B, FIG. 19C, FIG. 19D, and FIG. 19E illustrate perspective, side, top, and bottom views of an arthritic-aiding pin-centering pin-guiding auditorily-snap-locking tower-locking system and its varying components.
Figure 18A:
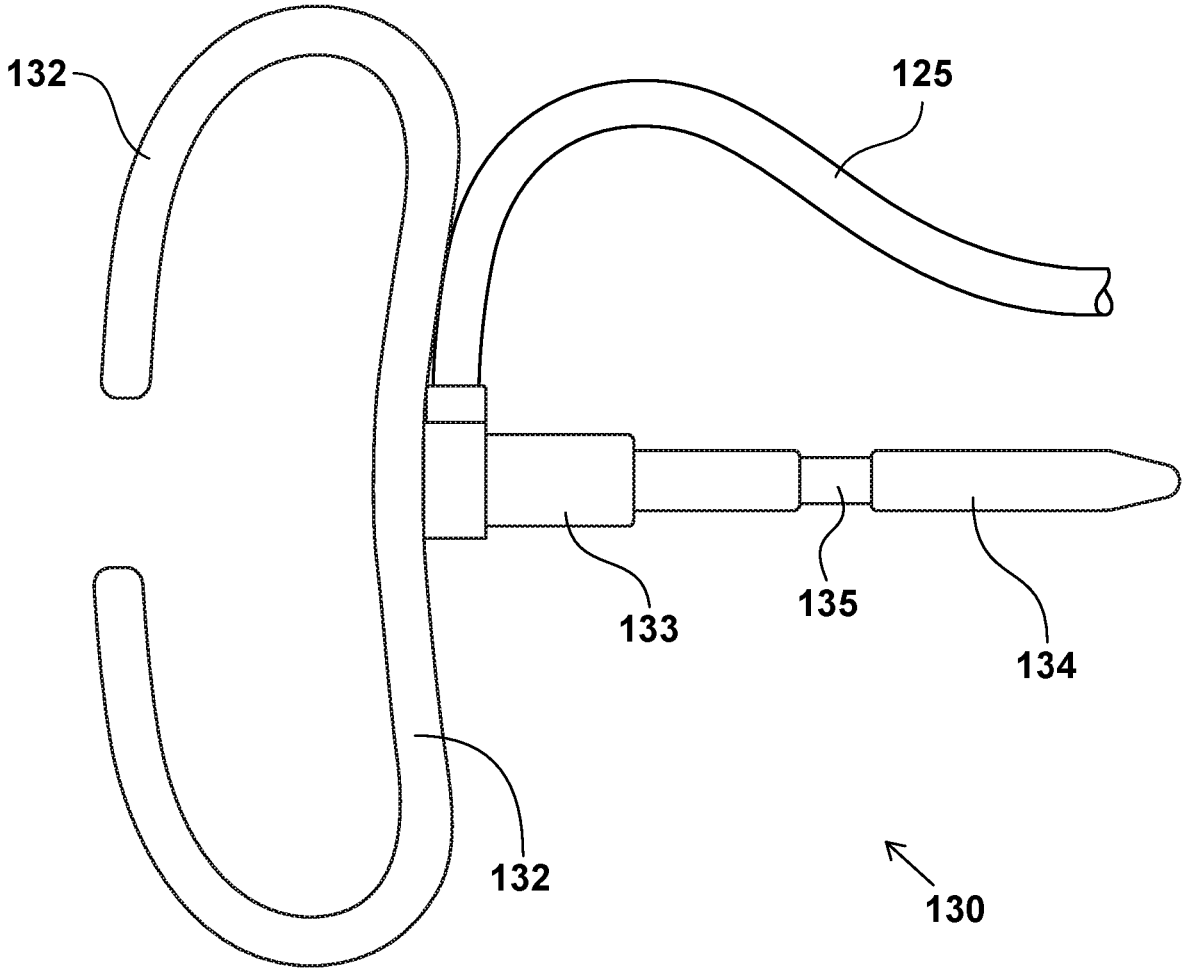
Figure 18B:
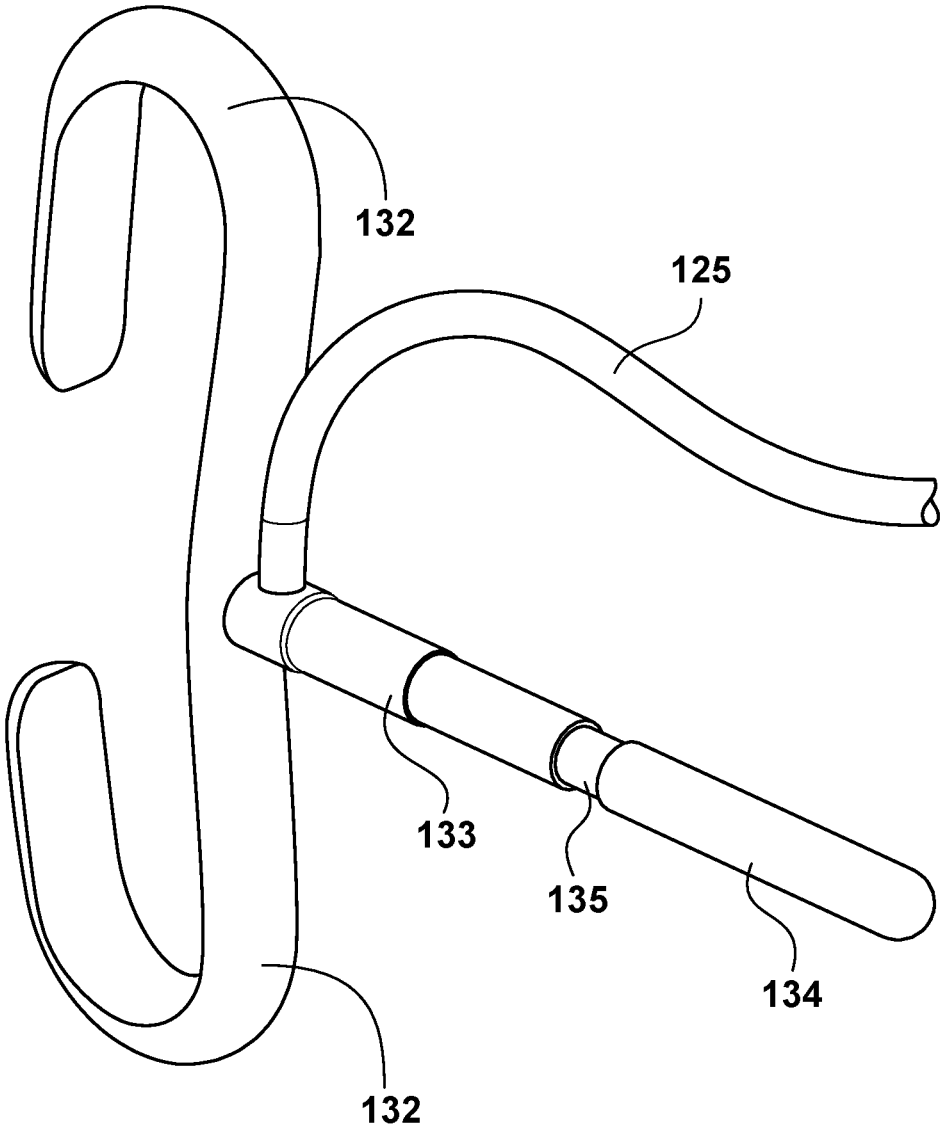
Figure 19A:
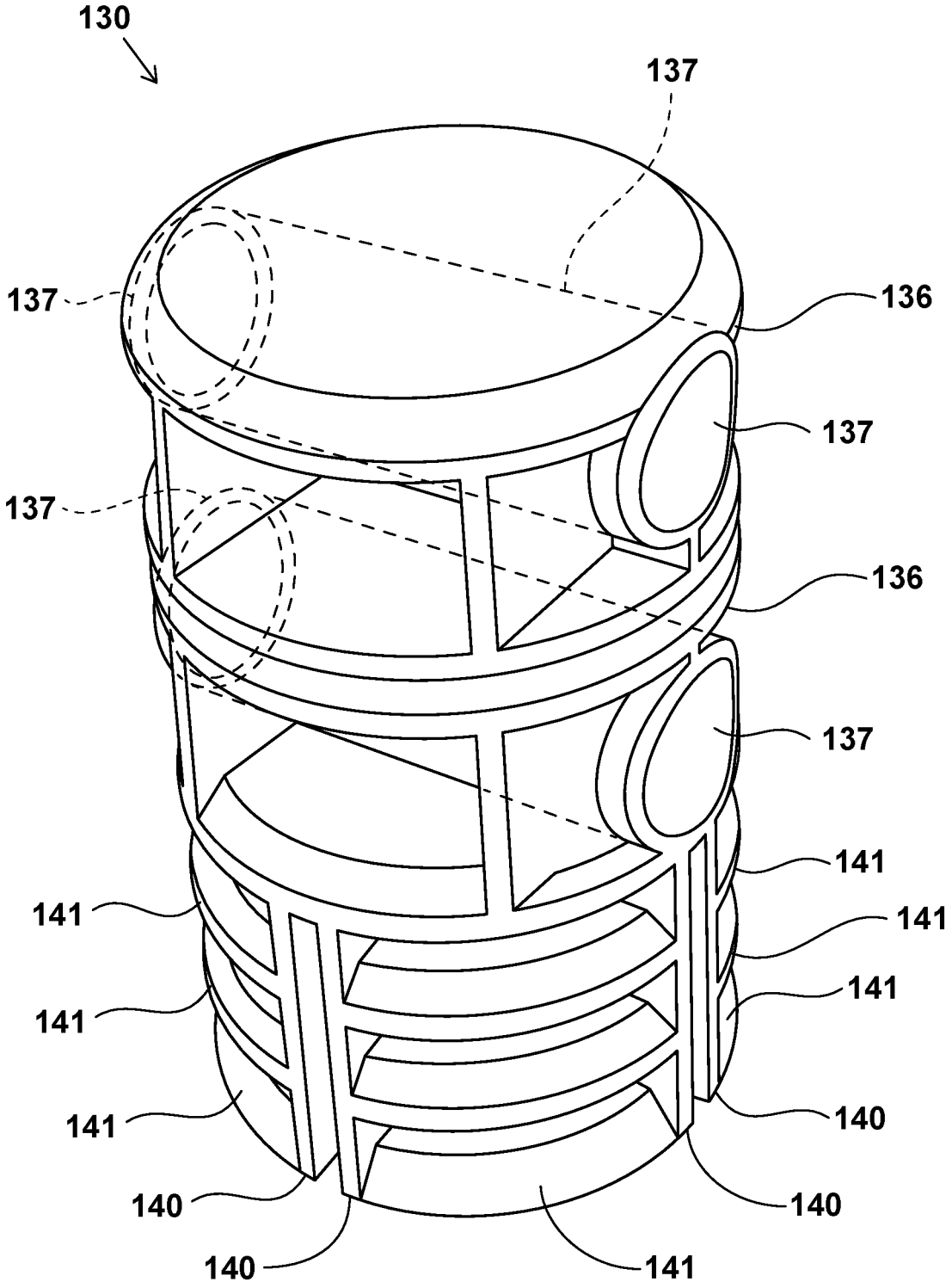
Figure 19B:
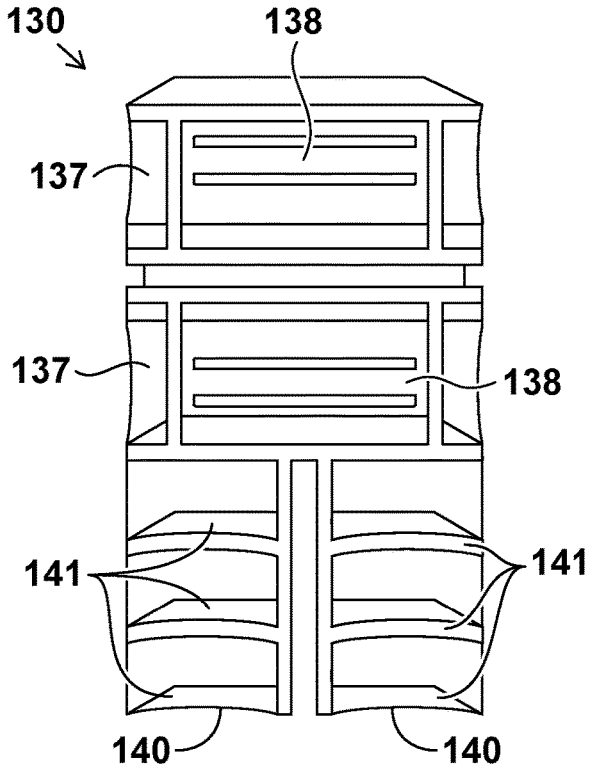
Figure 19C:
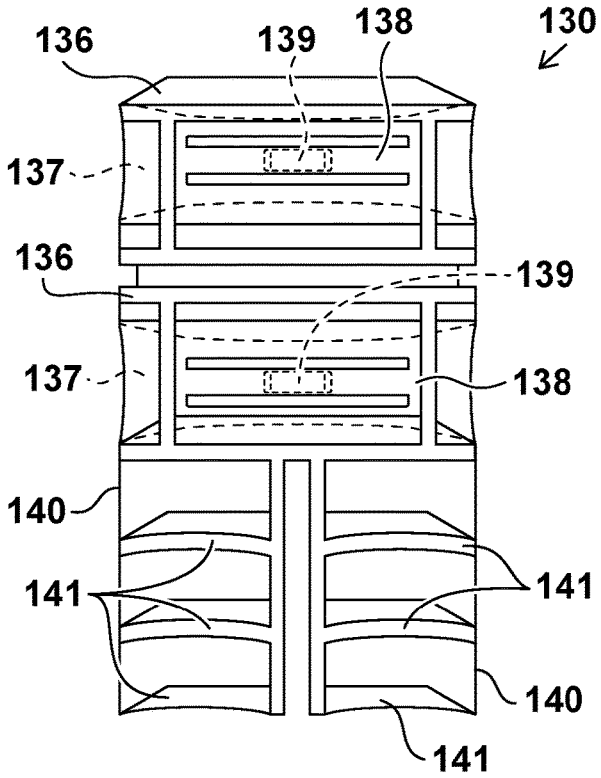
Figure 19D:
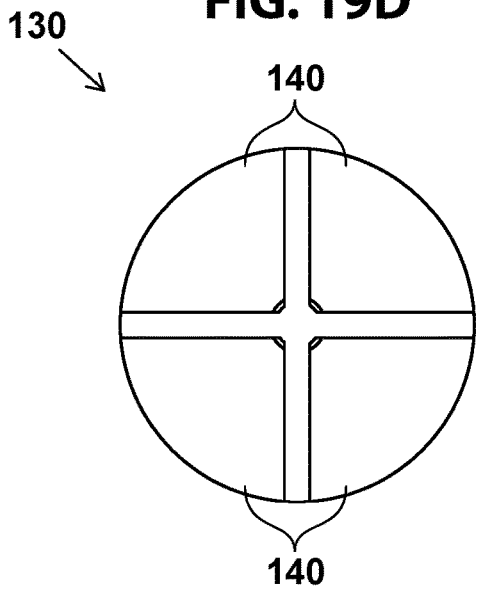
Figure 19E:
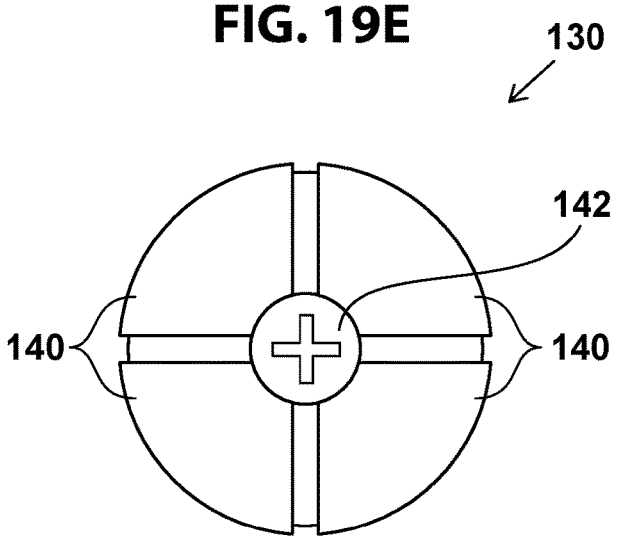
Figure 20A:
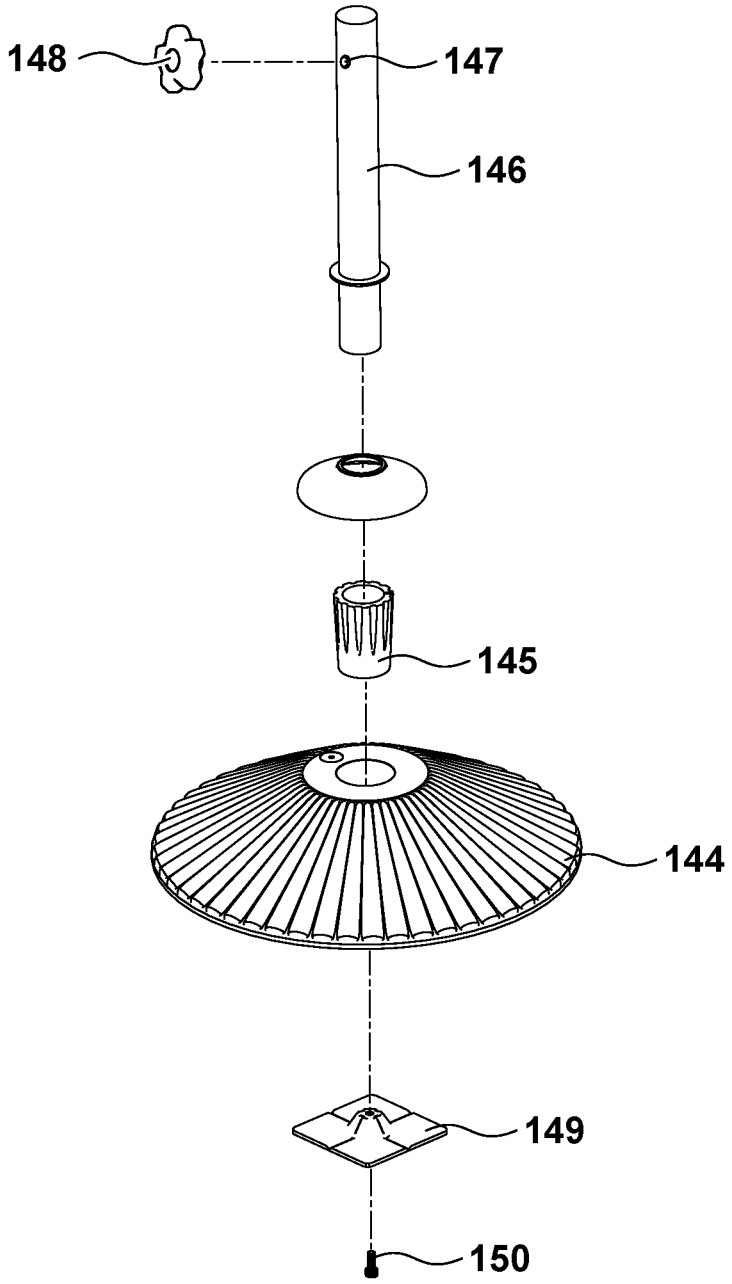
FIG. 20A, FIG. 20B, FIG. 20C, and FIG. 20D illustrate perspective, side, and top views of an adjustable-friction base system and its varying components.
Figure 20B:
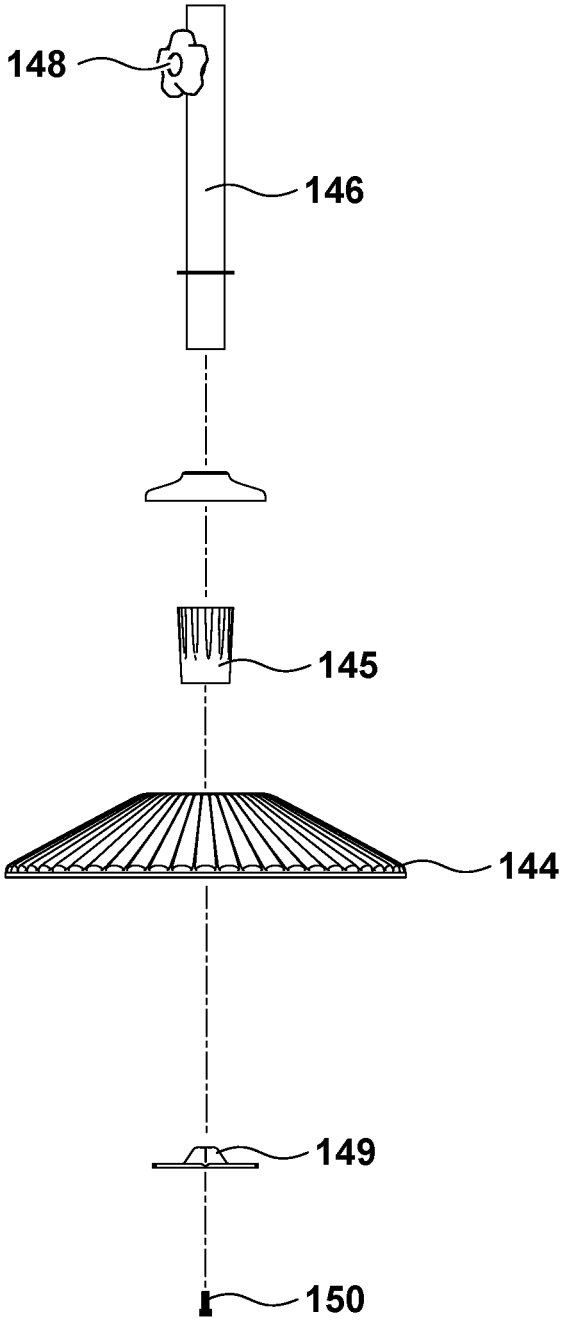
Figure 20C:
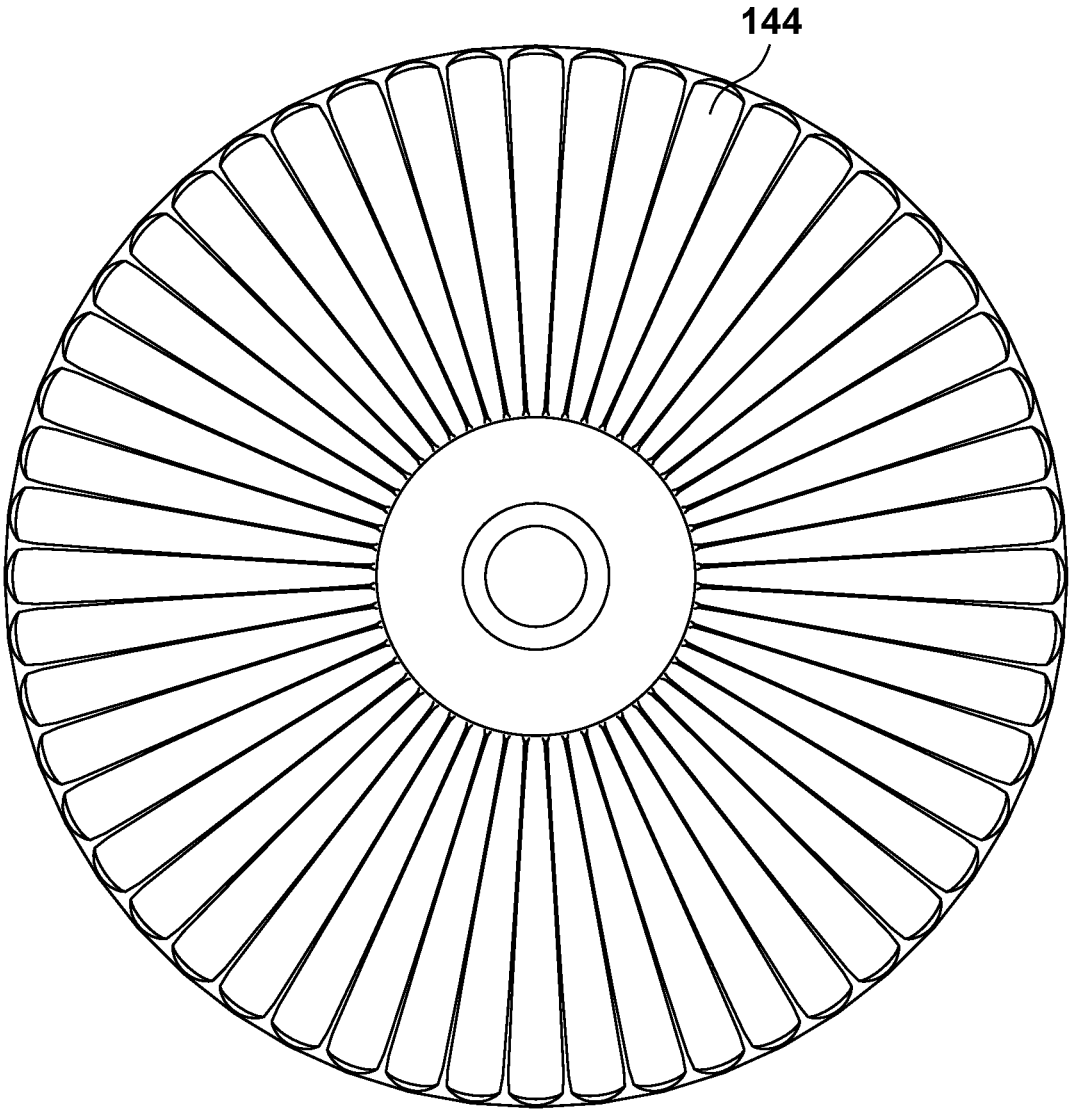
Figure 20D:
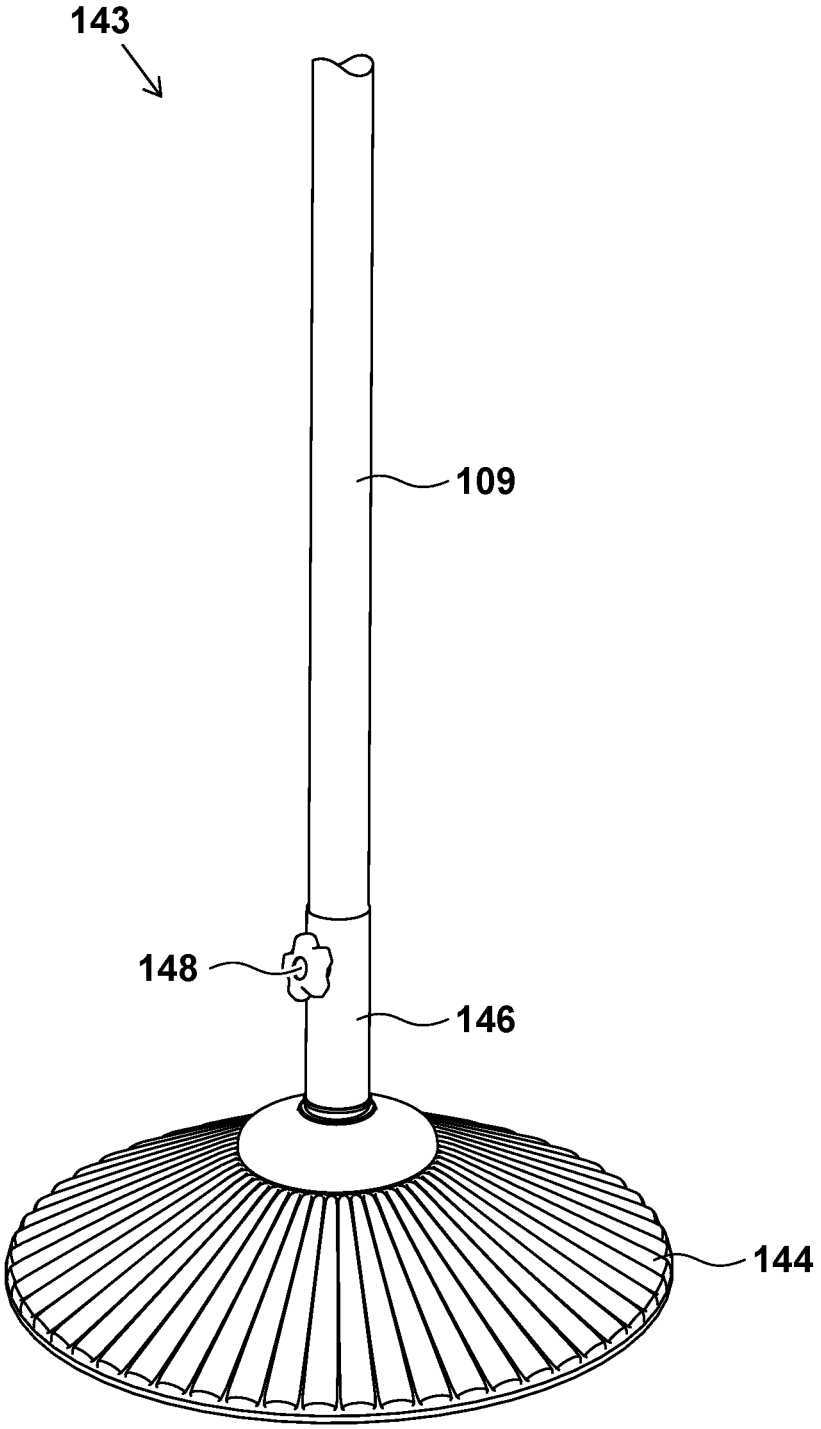
Figure 21A:
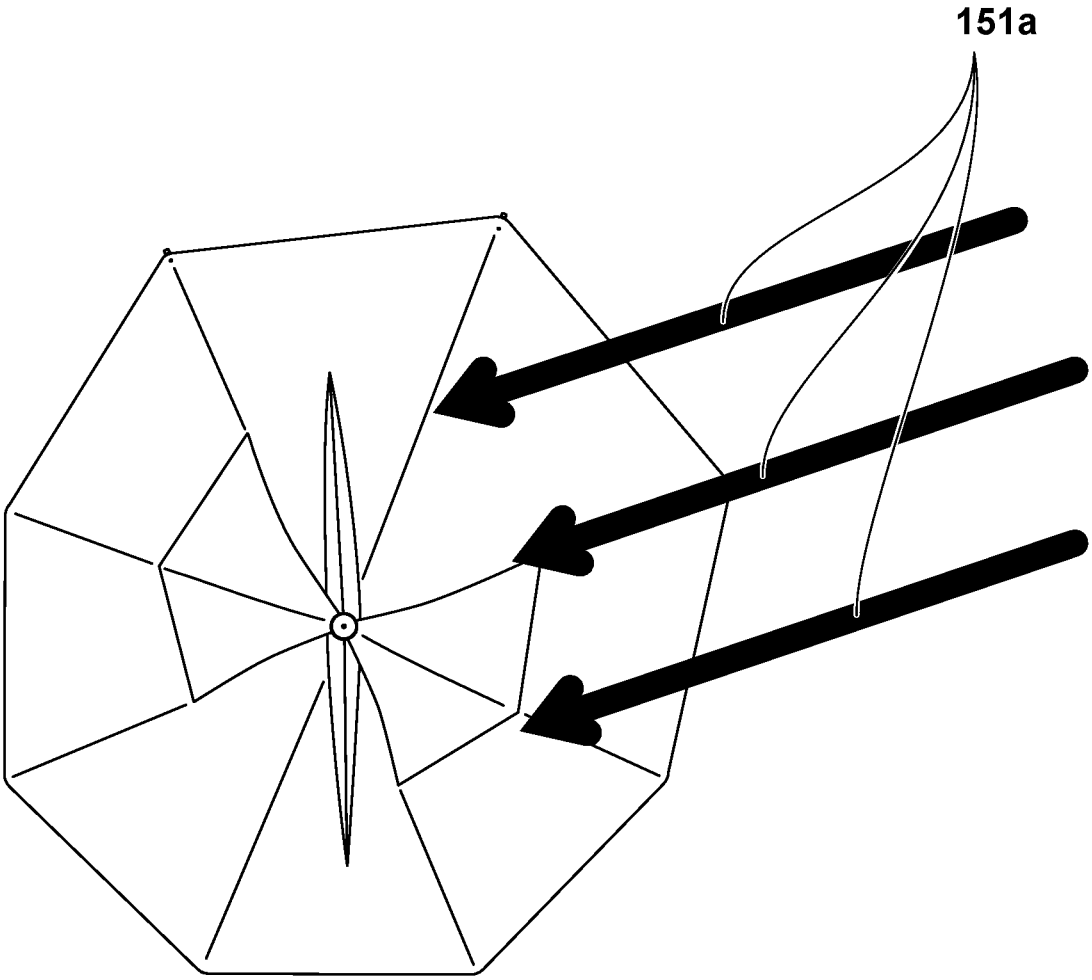
FIG. 21A, FIG. 21B, FIG. 21C, FIG. 21D, FIG. 21E, and FIG. 21F illustrate top and side views of a canopy having a first wind-speed-accelerating canopy-rotating-and-aligning sail, a second wind-speed-accelerating canopy-rotating-and-aligning sail, and a second wind-speed-accelerating canopy-rotating-and-aligning sail can automatically rotate and align with the wind flow.
Figure 21B:
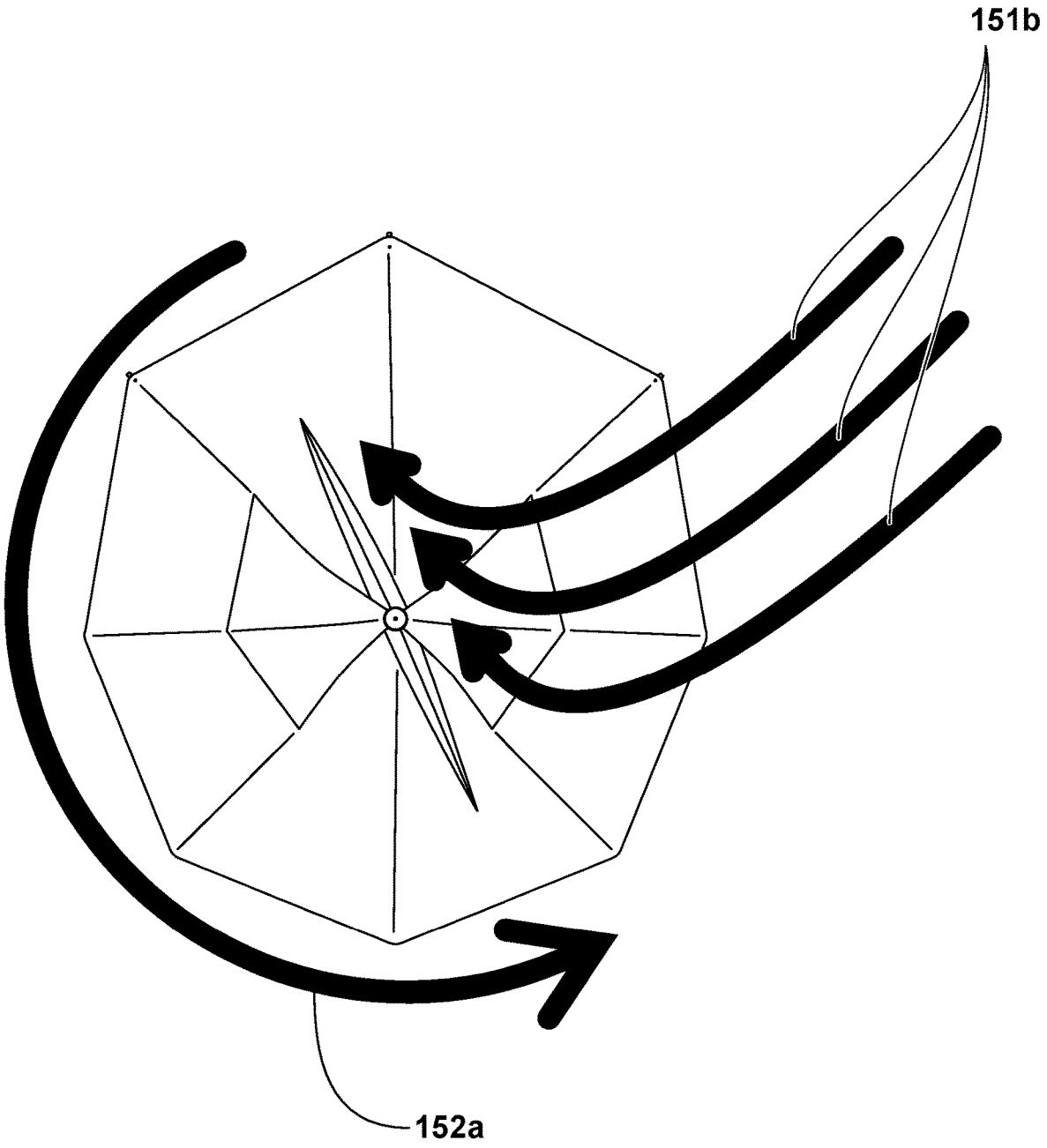
Figure 21C:
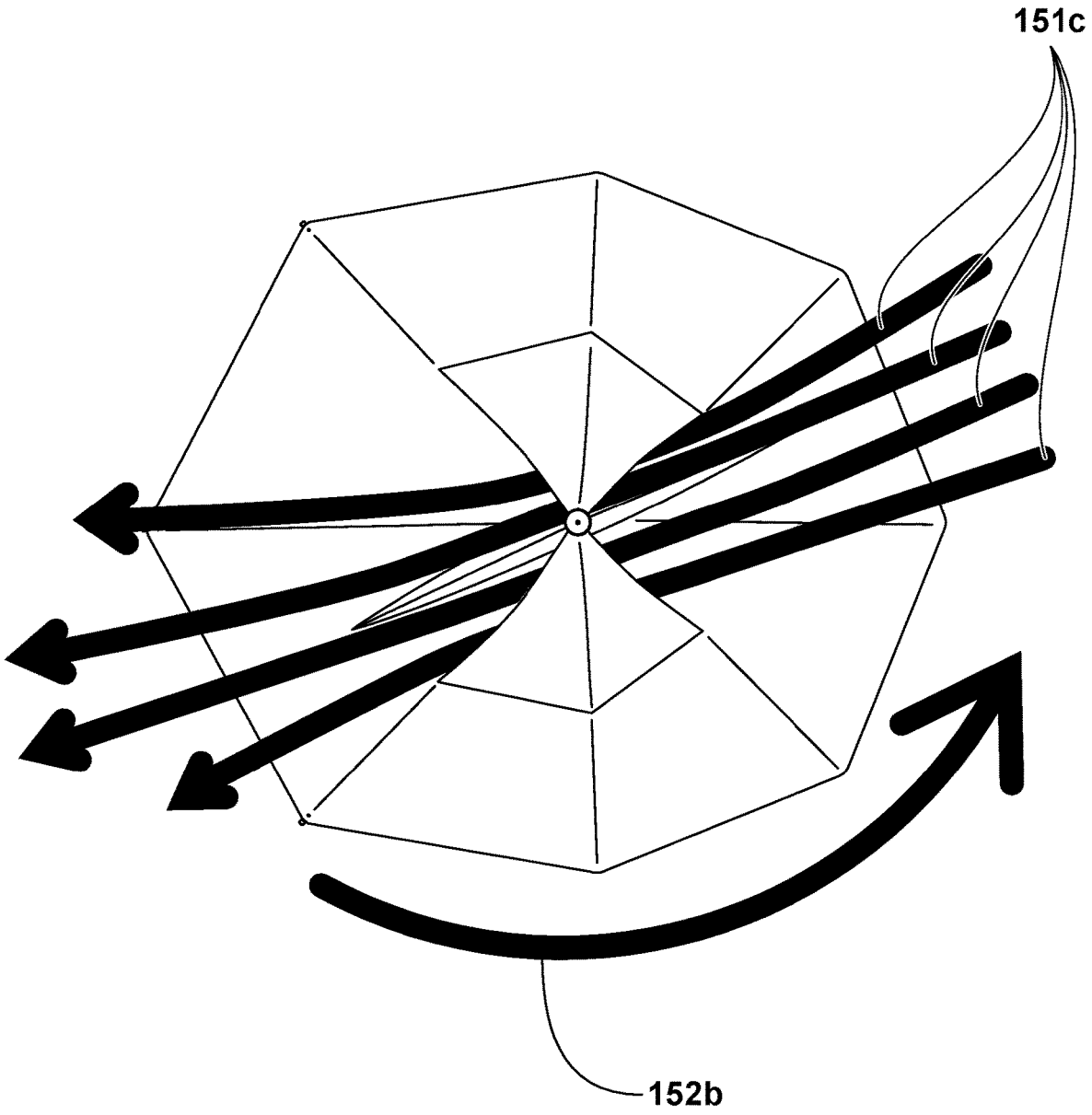
Figure 21D:
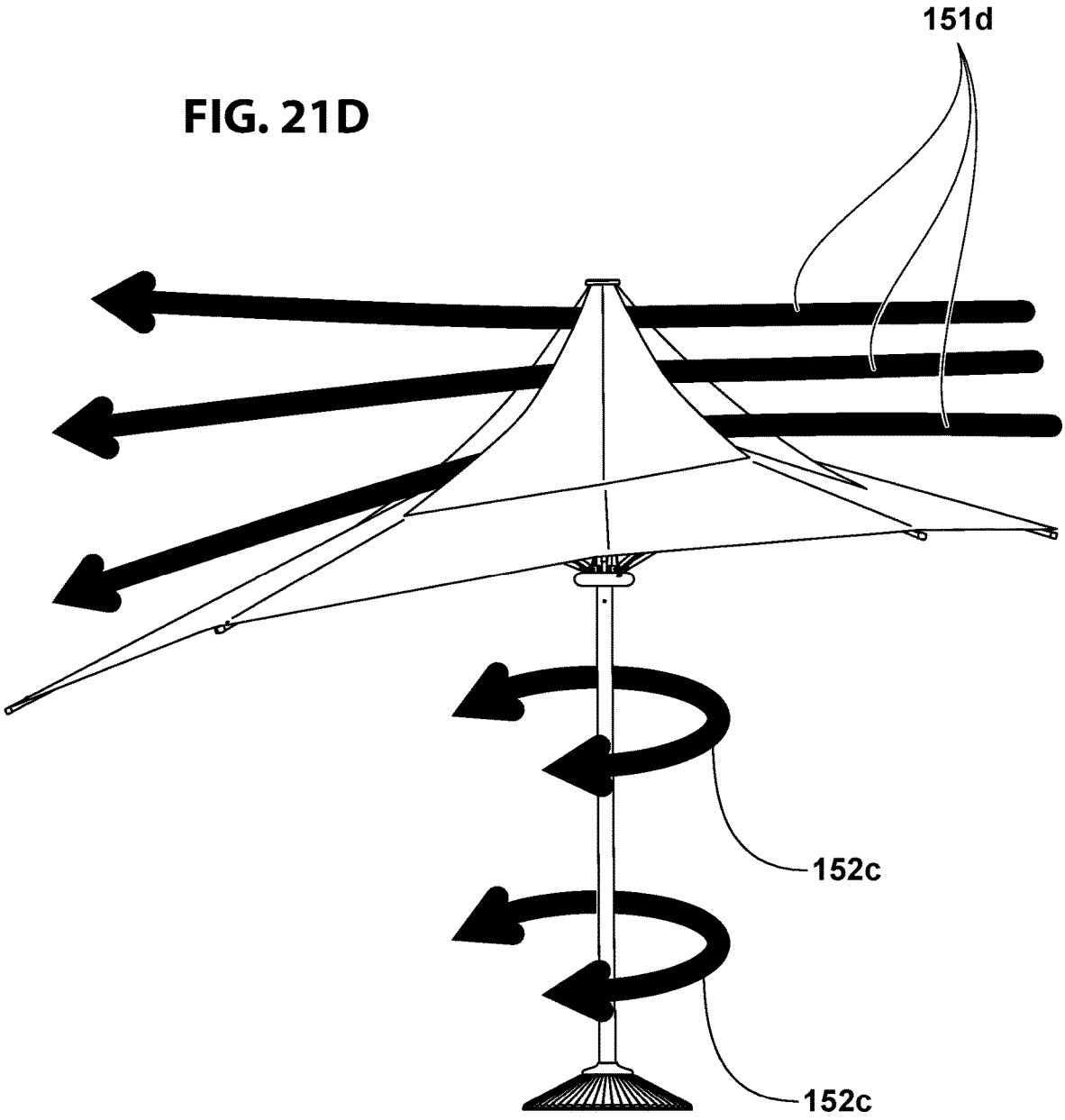
Figure 21E:
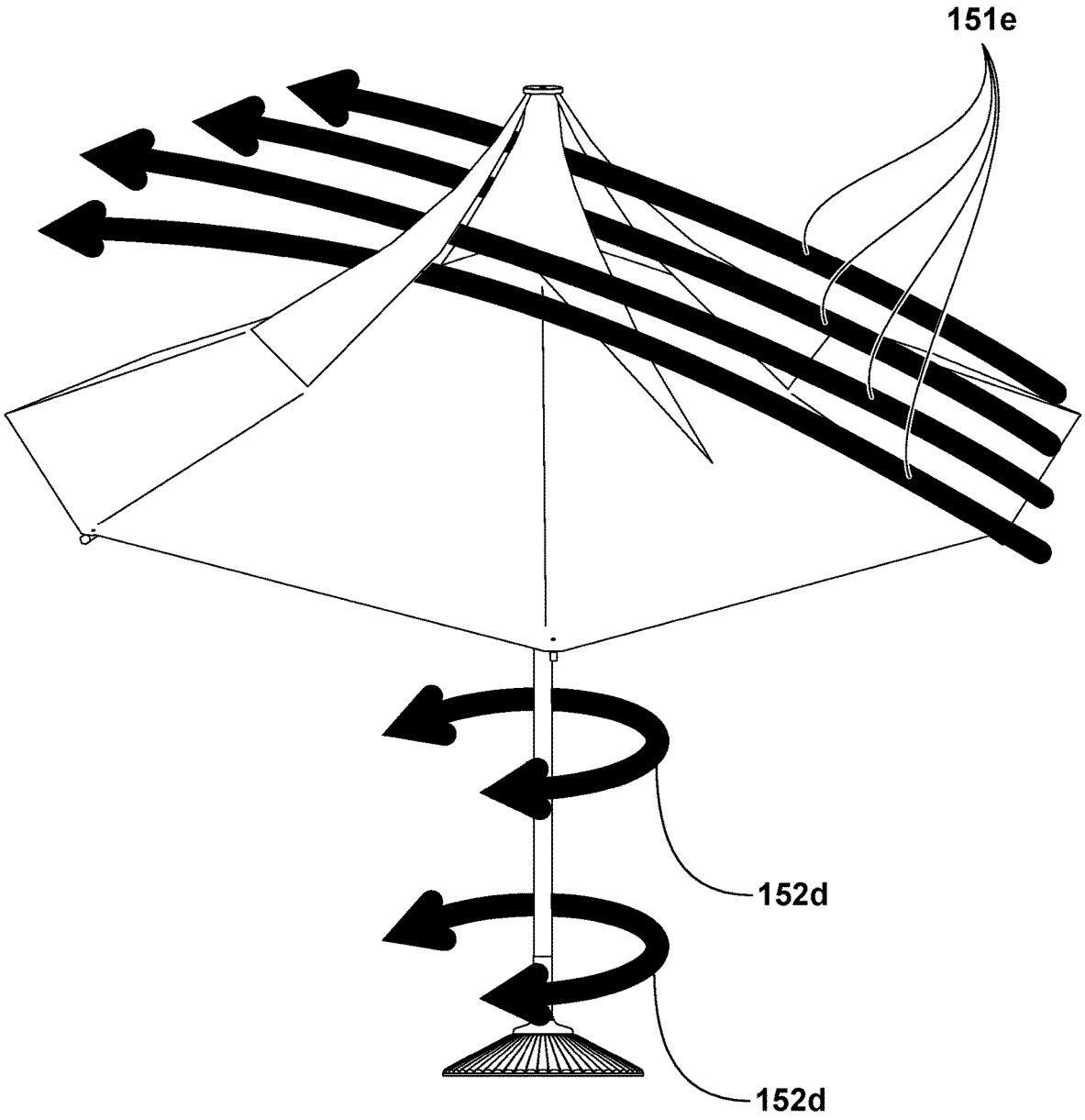
Figure 21F:
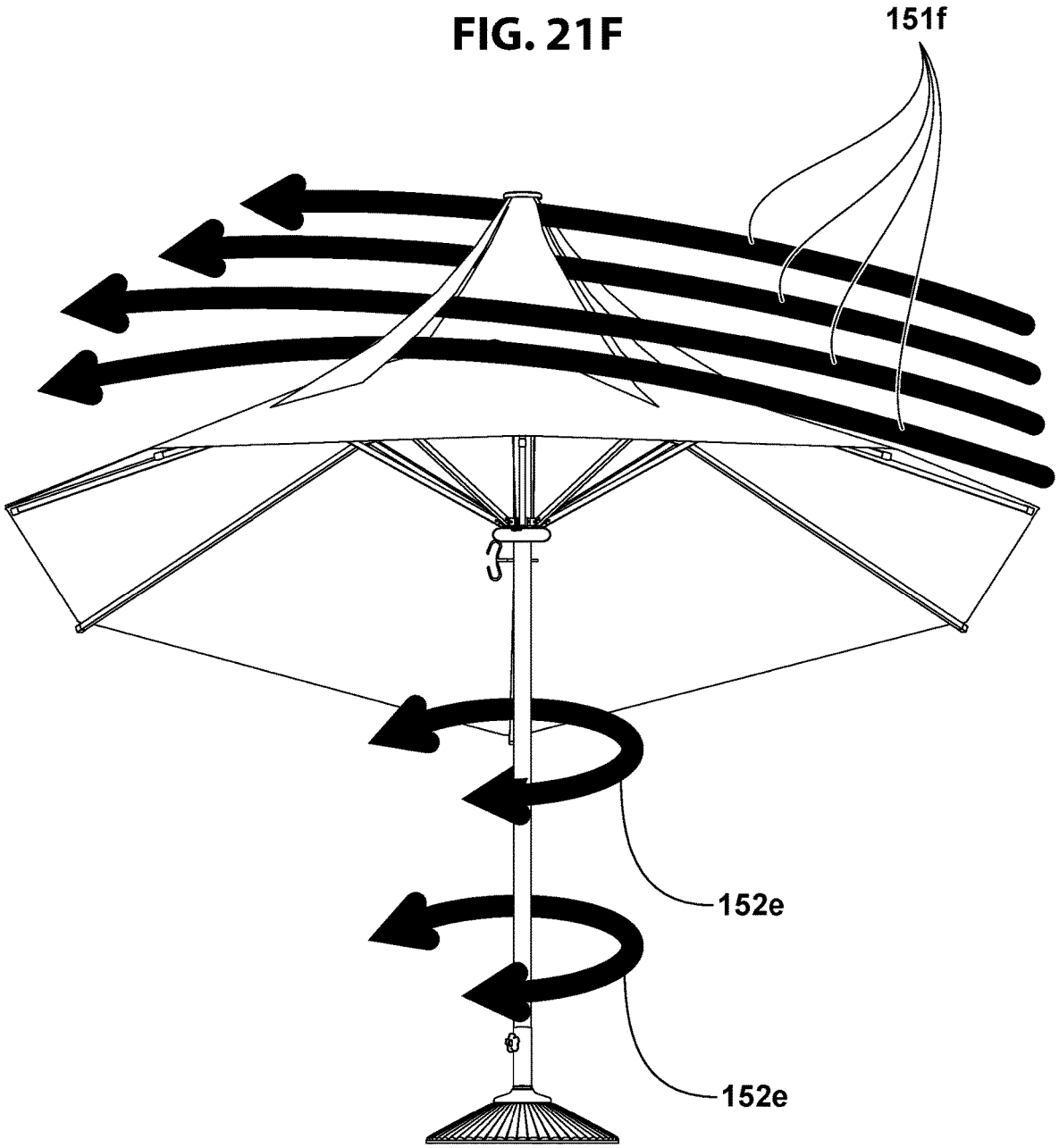

(see FIG. 25A, and FIG. 25B), and b) Conveniently hooking and storing pulley cord 125 thereon (see FIG. 17).

33) Anti-finger-pinching spacer 133 is for:

Safely keeping hand away from two umbrella-pole pin openings 131 to prevent skin from being pinched by locking pin 134.

34) Locking pin 134 is for:

Locking moveable hub 120 at one of two desired elevations of two umbrella-pole pin openings 131, respectively when being inserted into one of two pin-centering pin-guiding tubes 137 in the direction of arrow 161

Figure 25A:
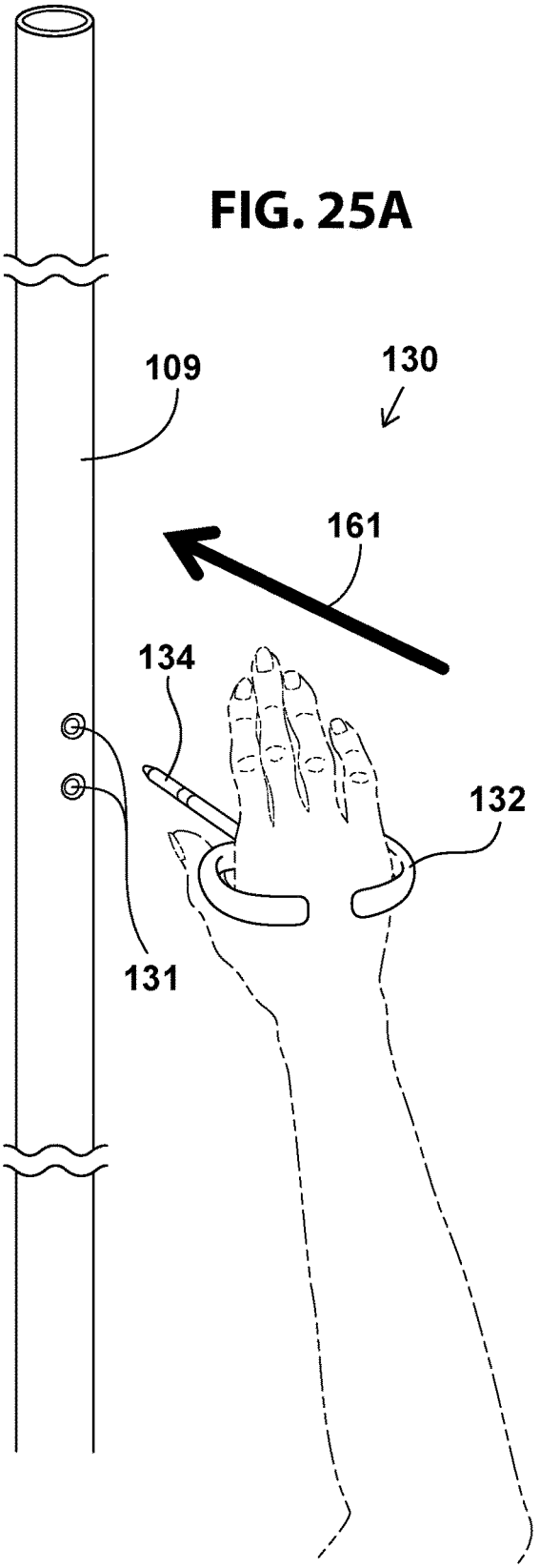
FIG. 25A, and FIG. 25B illustrate perspective views of an arthritic-aiding grip ring and how it is operated by a person with arthritic hands.
Figure 25B:
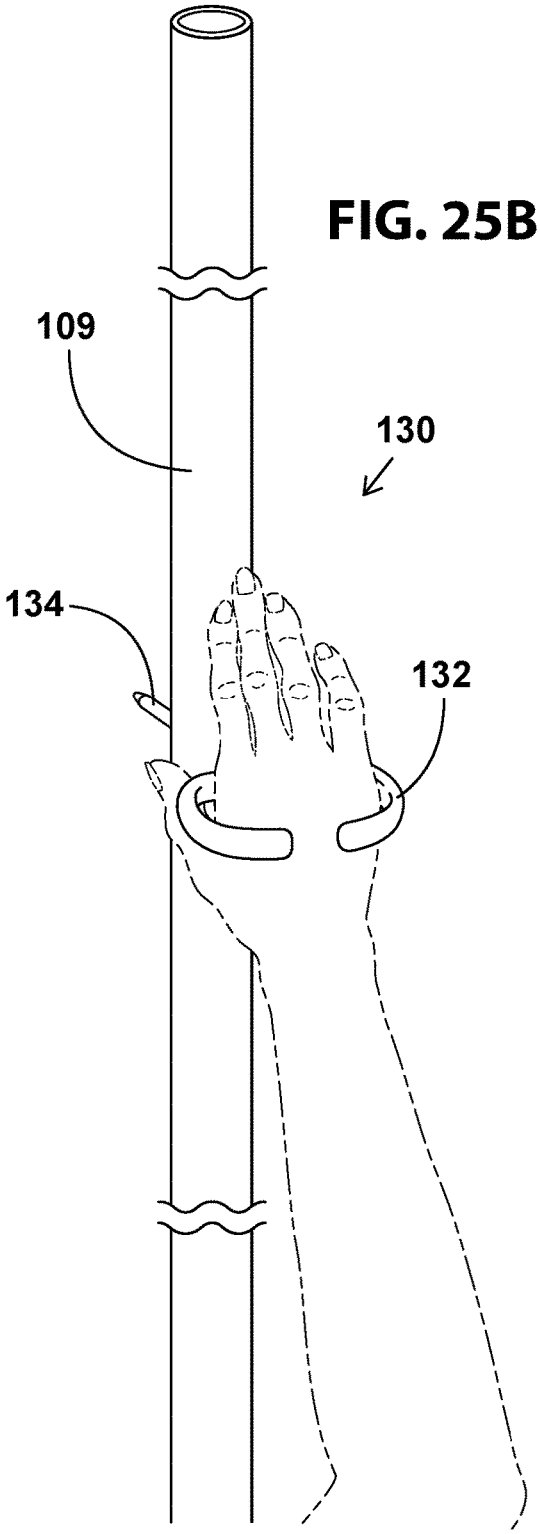
Figure 26A:
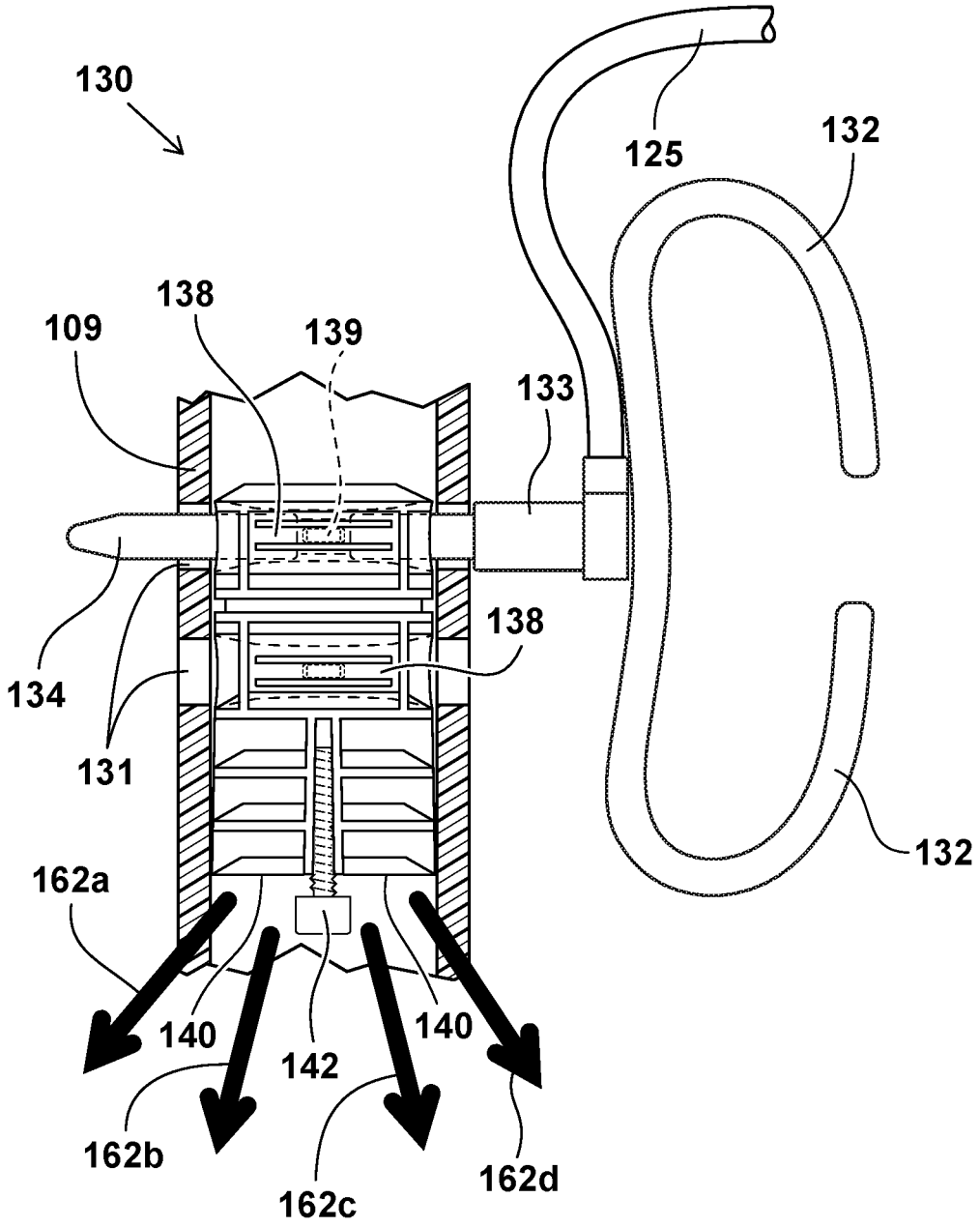
FIG. 26A, FIG. 26B, FIG. 26C, and FIG. 26D illustrate side views of how an arthritic-aiding pin-centering pin-guiding auditorily-snap-locking tower-locking system work with two pin-centering pin-guiding tubes, four auditorily-snap-locking leaf springs, and four auditorily-snap-locking nipples.
Figure 26B:
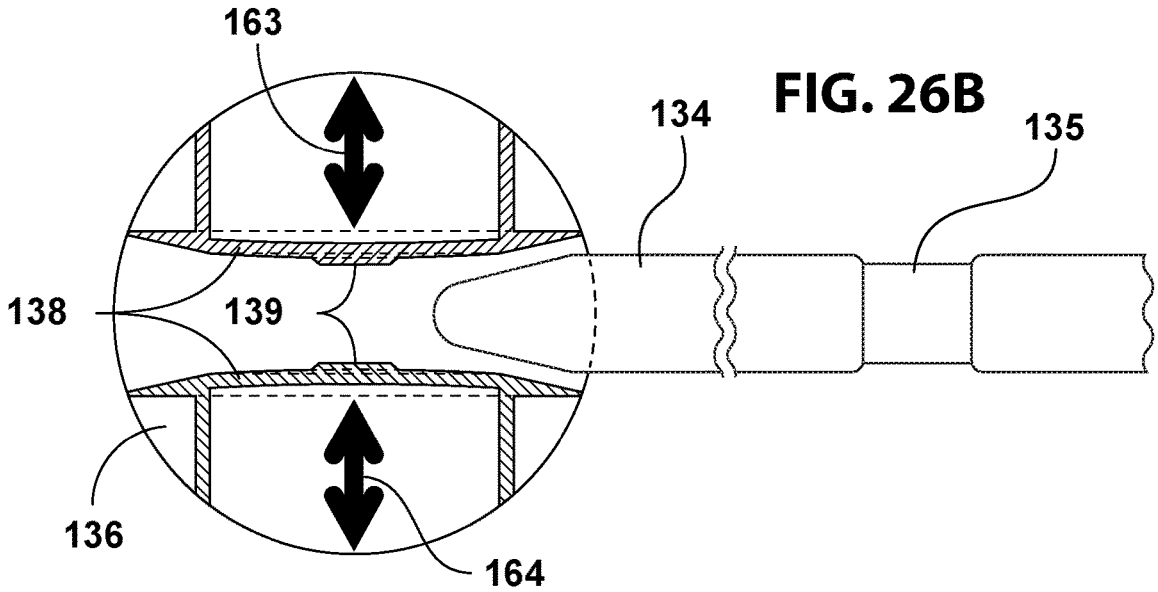
Figure 26C:
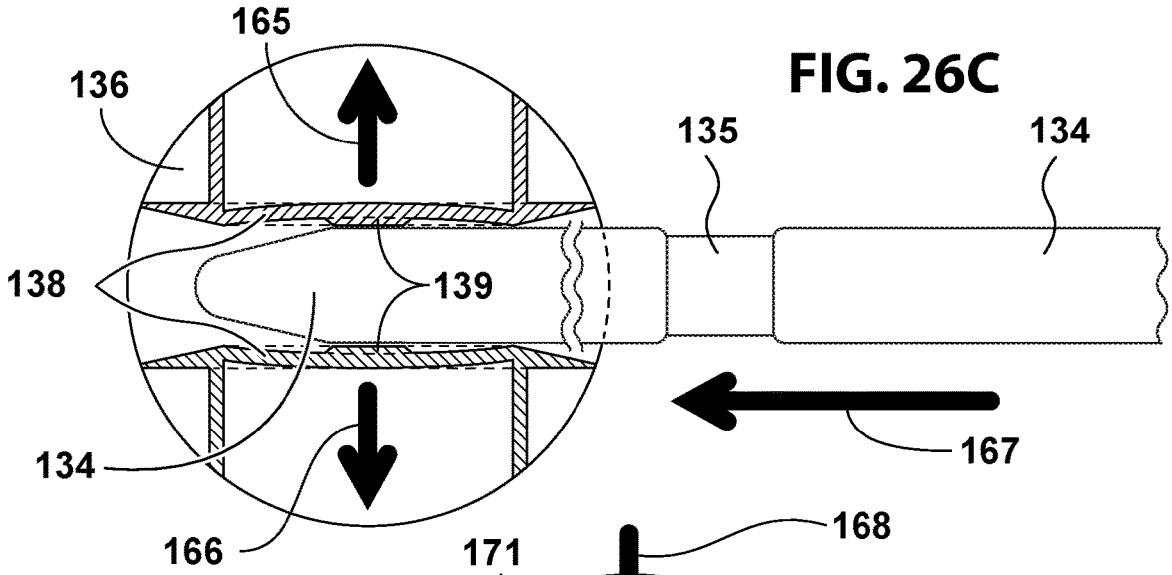

(see FIG. 25A and FIG. 25B)

to push two of four auditorily-snap-locking leaf springs 138 outward in the opposite directions of arrows 162*a*, 162*b*, 162*c*, 162*d*, 163, 164, 165, and 166 (see FIG. 26A, FIG. 26B, and FIG. 26C).

Locking pin 134 is being inserted further into one of two pin-centering pin-guiding tubes 137 in the direction of arrow 167 until two of four auditorily-snap-locking nipples 139 auditorily snap-lock in auditorily-snap-locking recess 135 in the directions of arrows 168 and 169

(with the tip of locking pin 134 poking through umbrella pole 109 in the direction of arrow 170)

to generate snap-locking sounds 171 and 172, and to lock locking pin 134 in one of two pin-centering pin-guiding tubes 137

Figure 26D:
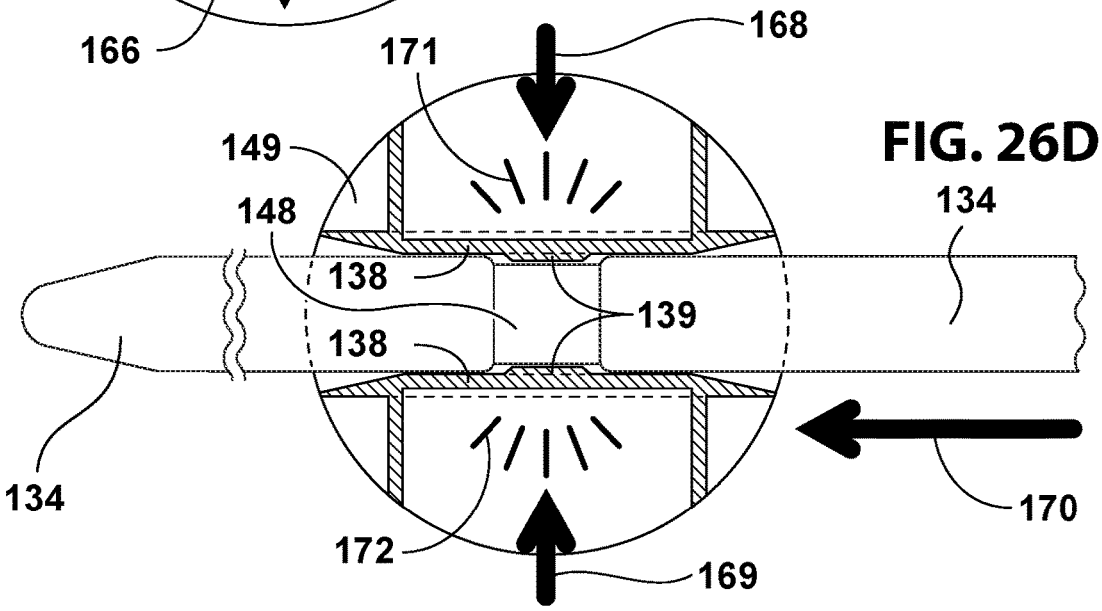
Figure 27A:
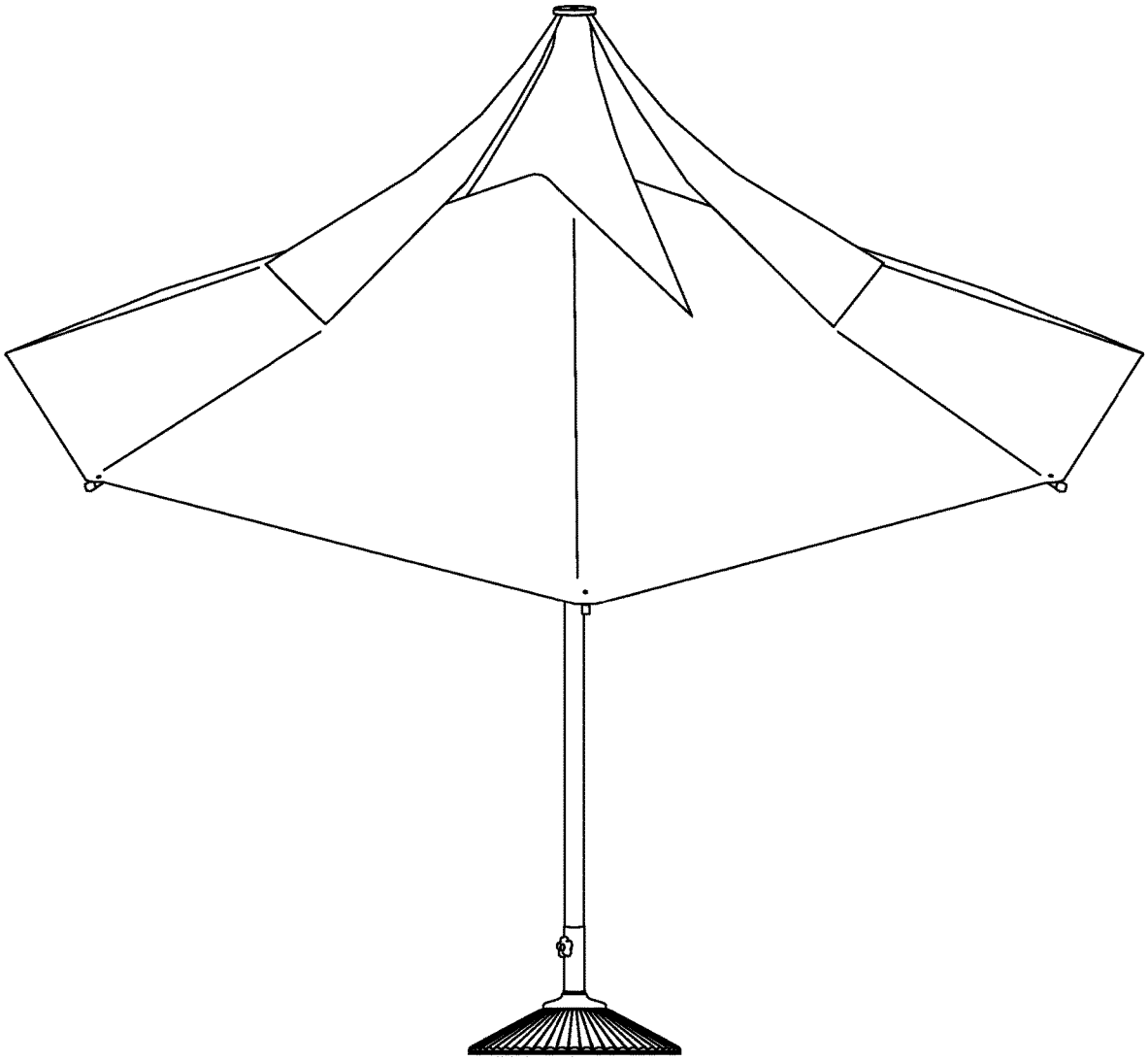
FIG. 27A, FIG. 27B, FIG. 27C, FIG. 27D, FIG. 27E, FIG. 27F, and FIG. 27G illustrate perspective, top, front, and side views of equivalent variations of the arthritic-aiding triple-sail wind-rotating wind-aligning auditory-pin-snap-locking-and-centering umbrella.
Figure 27B:
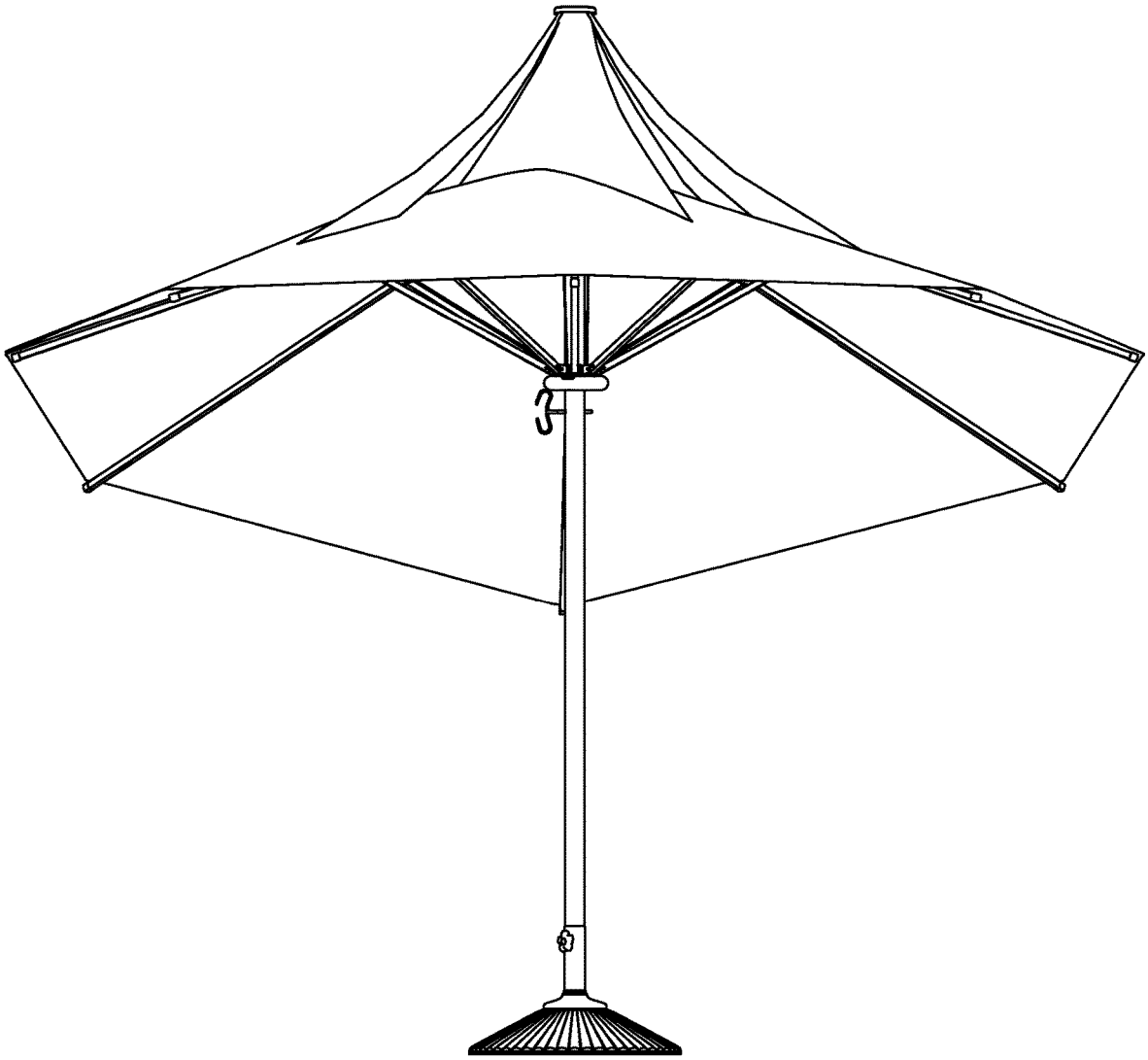
Figure 27C:
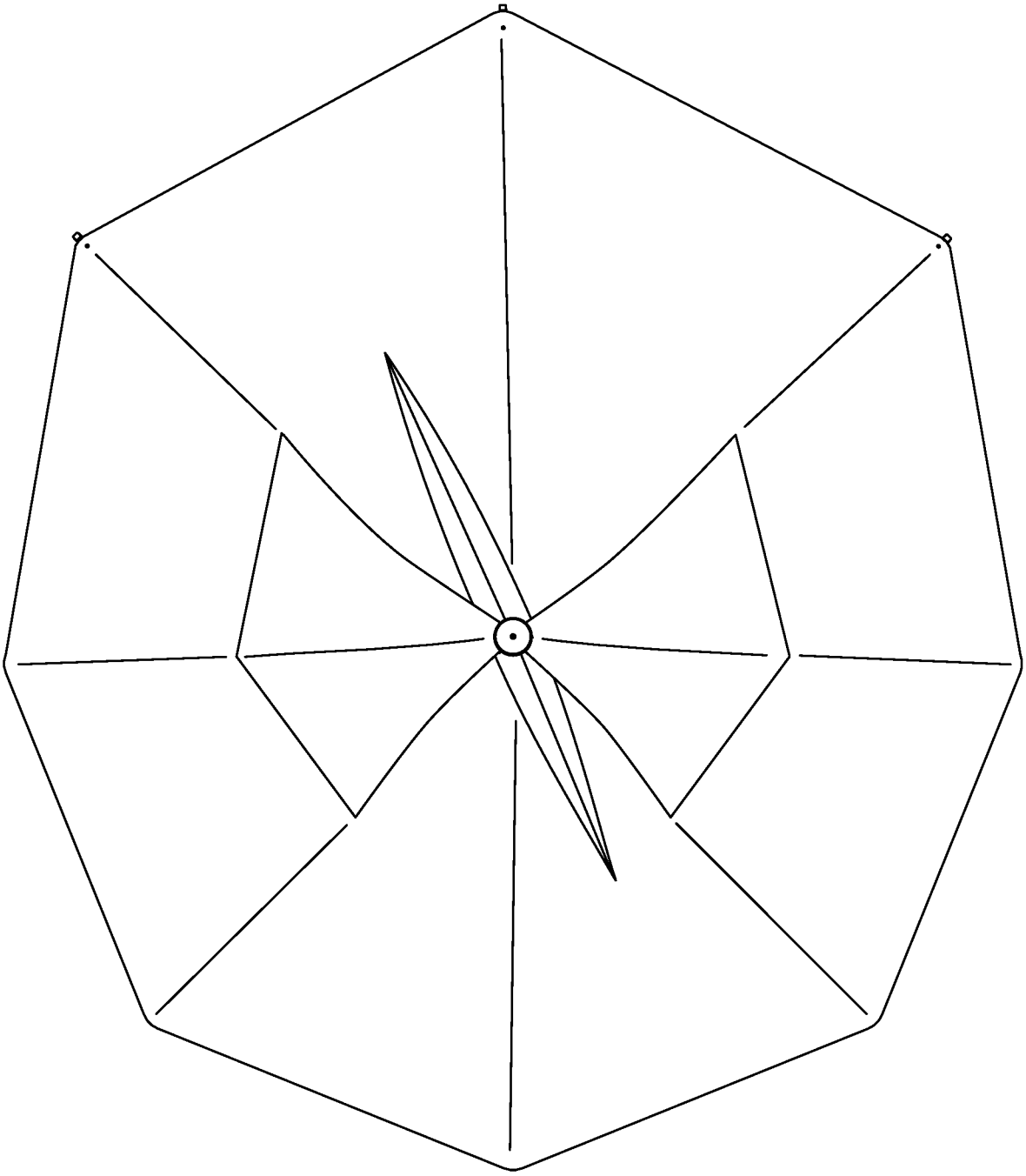
Figure 27D:
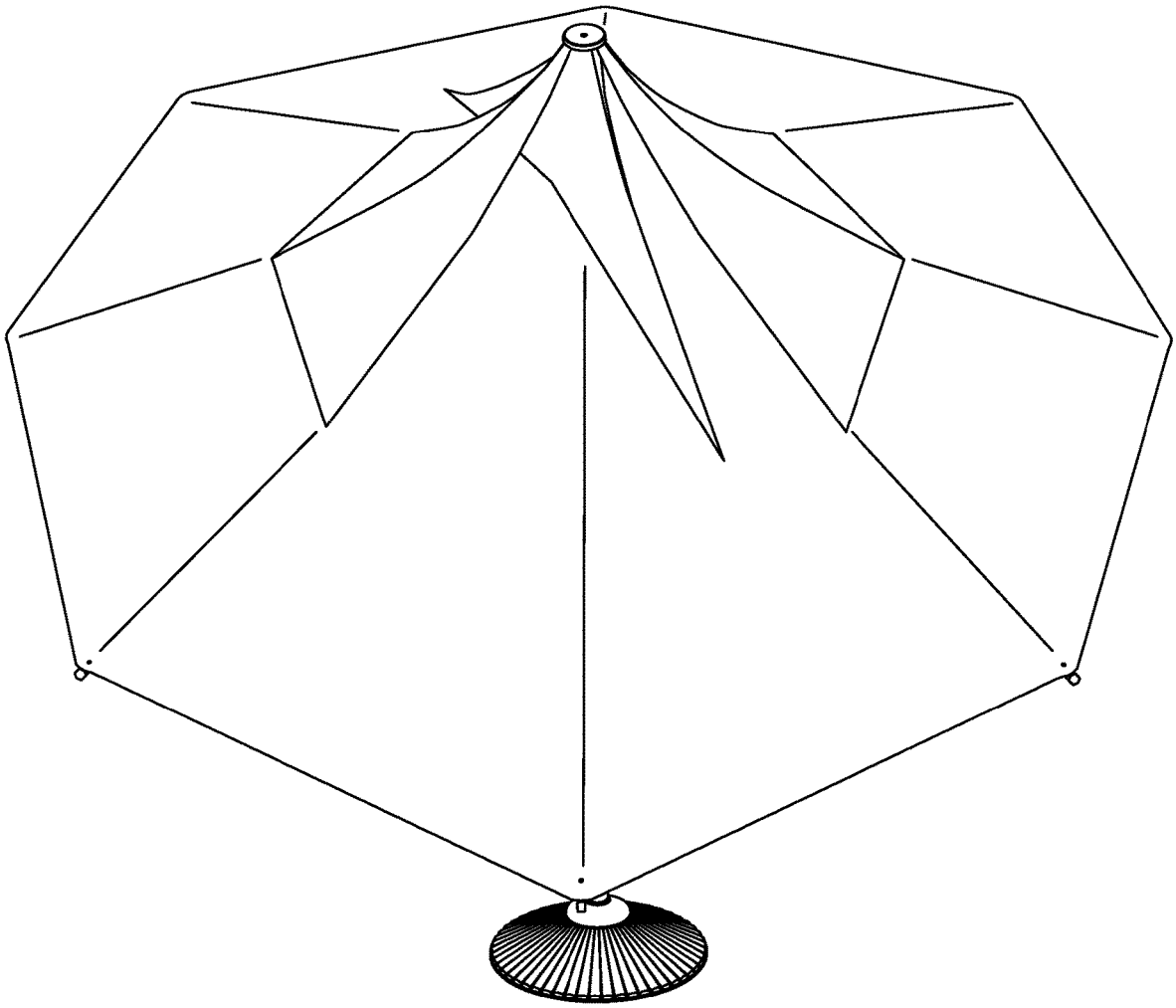
Figure 27E:
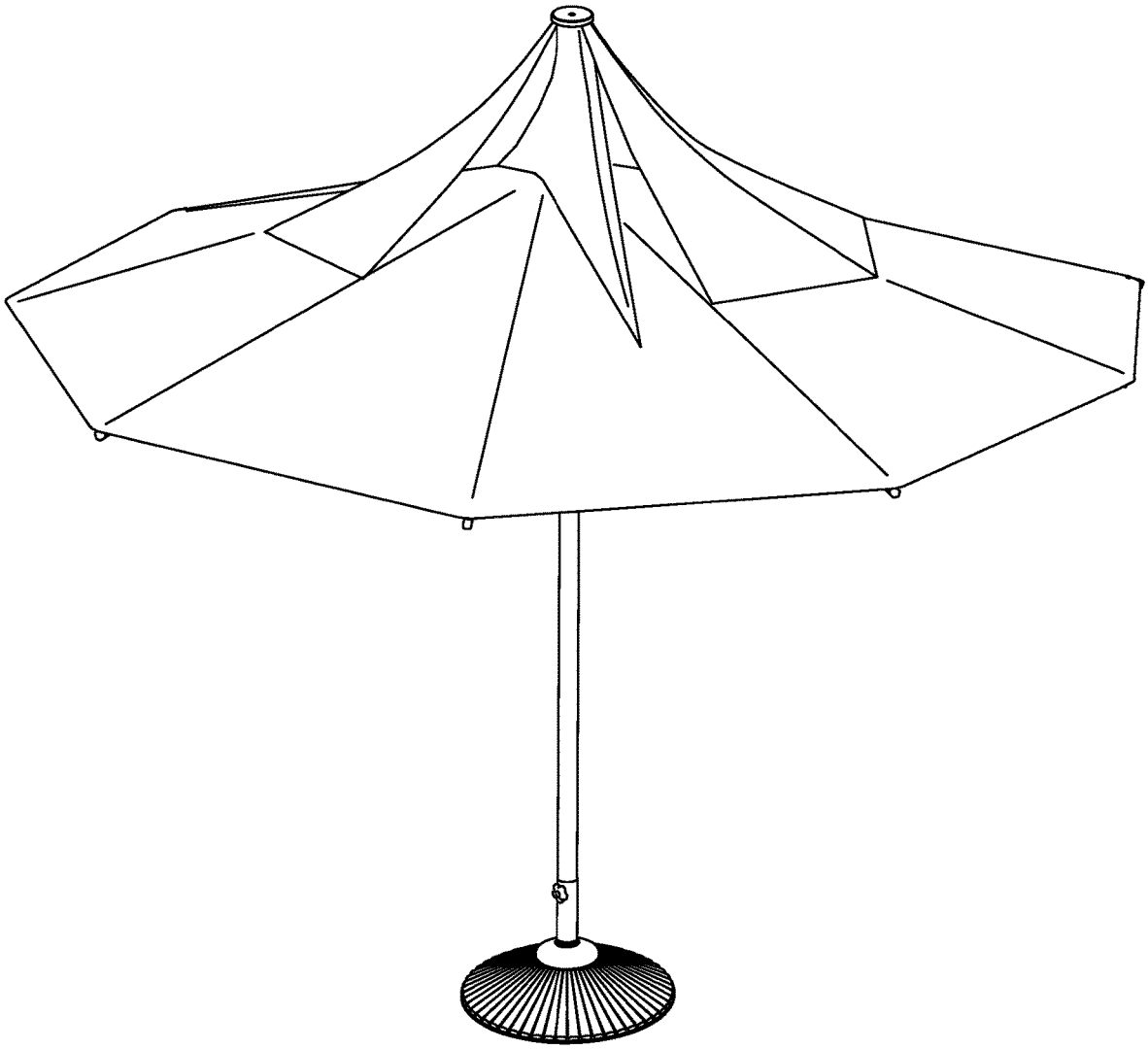
Figure 27F:
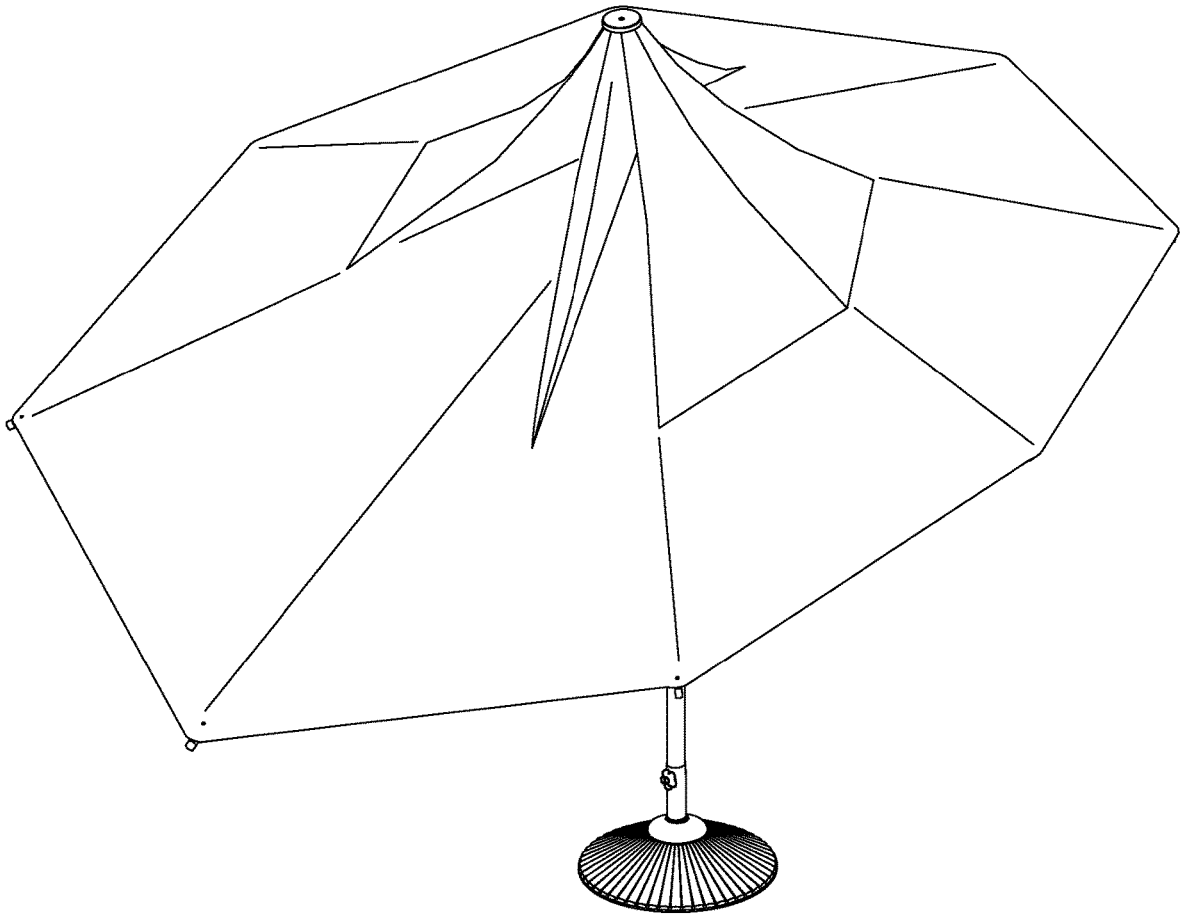
Figure 27G:
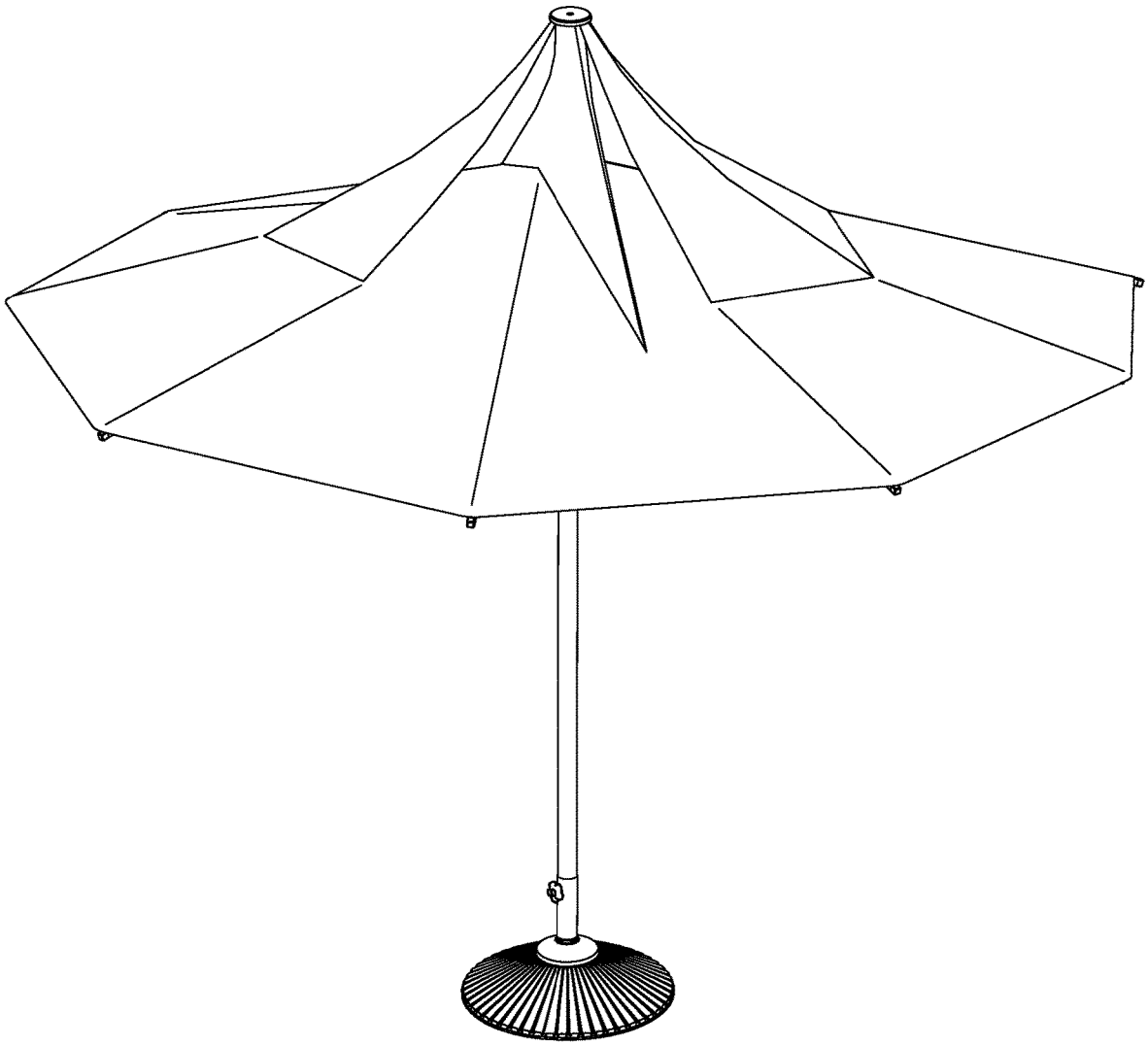
Figure 28A:
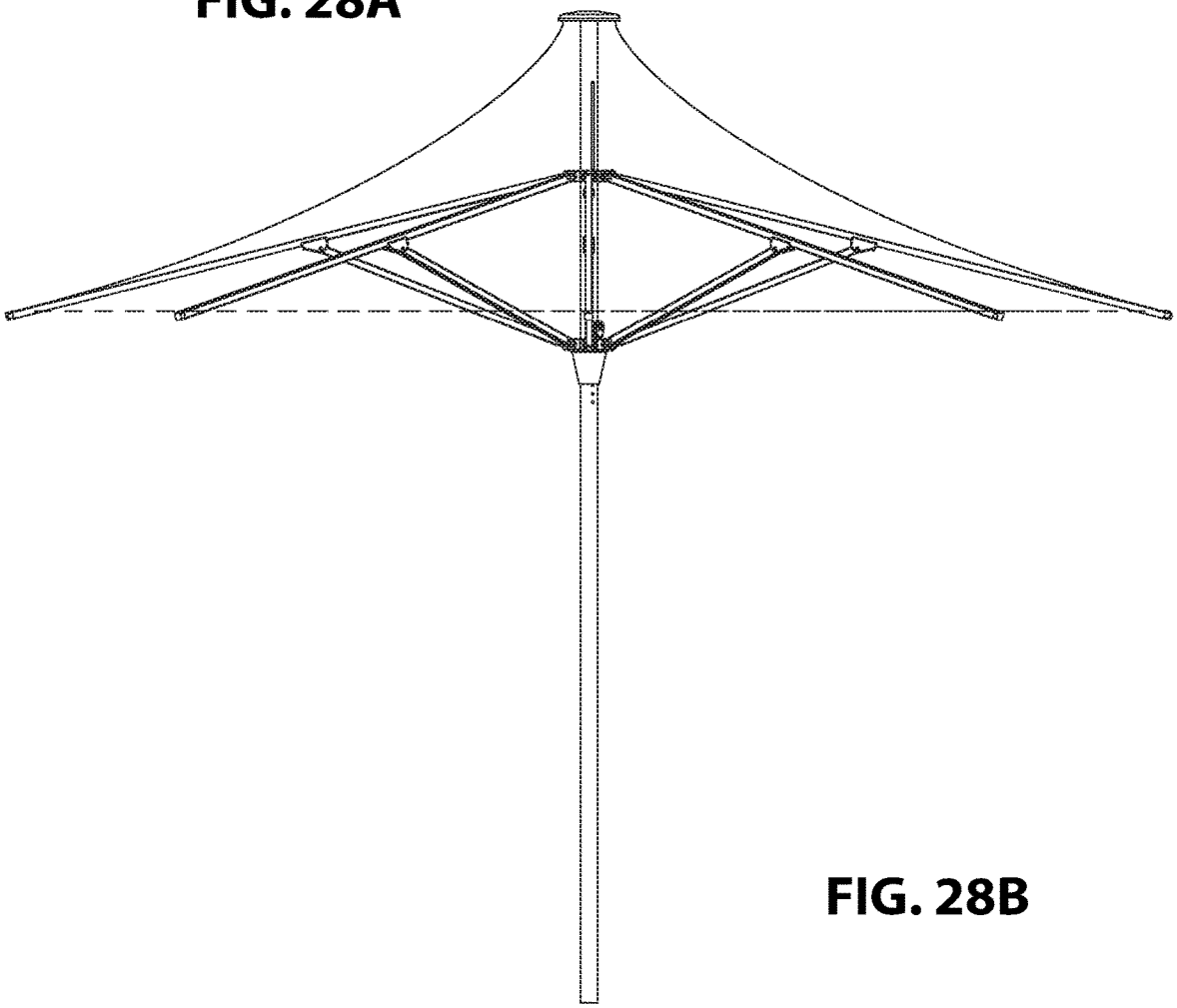
FIG. 28A, FIG. 28B, FIG. 28C, FIG. 28D, FIG. 28E, FIG. 28F, FIG. 28G, and FIG. 28H illustrate side and perspective views of equivalent variations of an umbrella canopy.
Figure 28B:
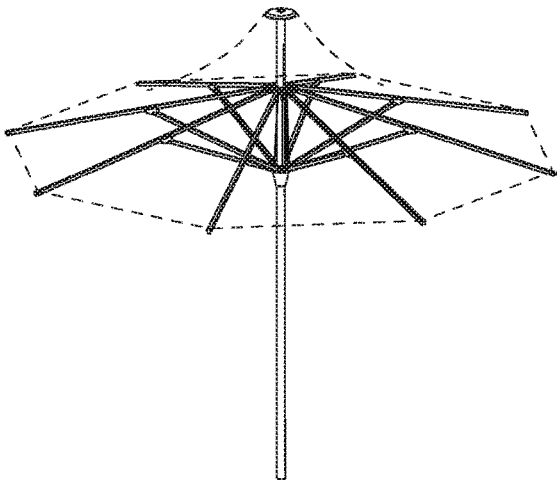
Figure 28C:
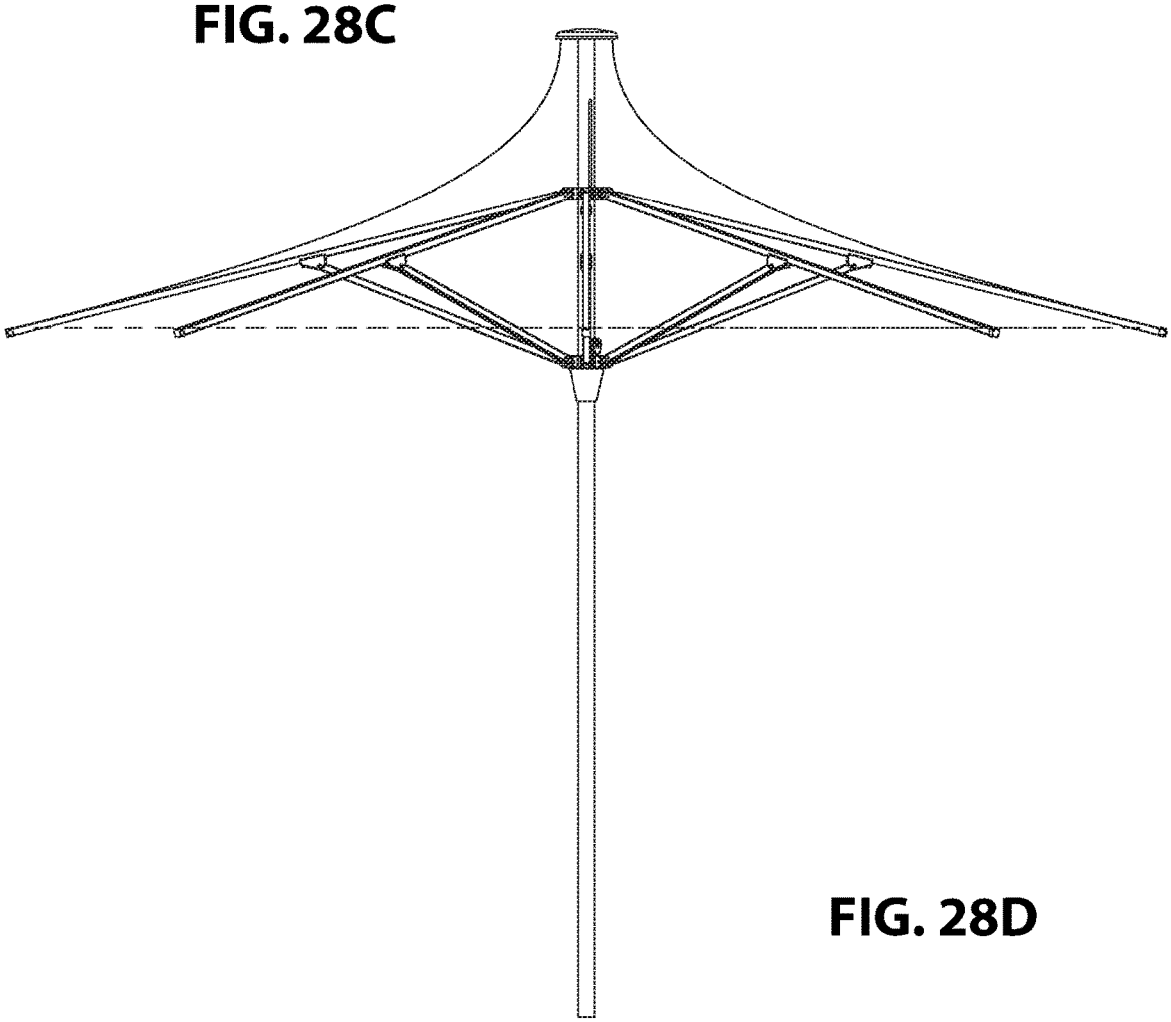
Figure 28D:
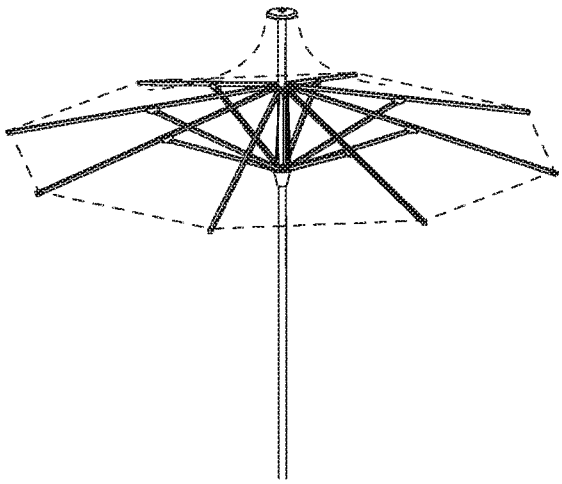
Figure 28E:
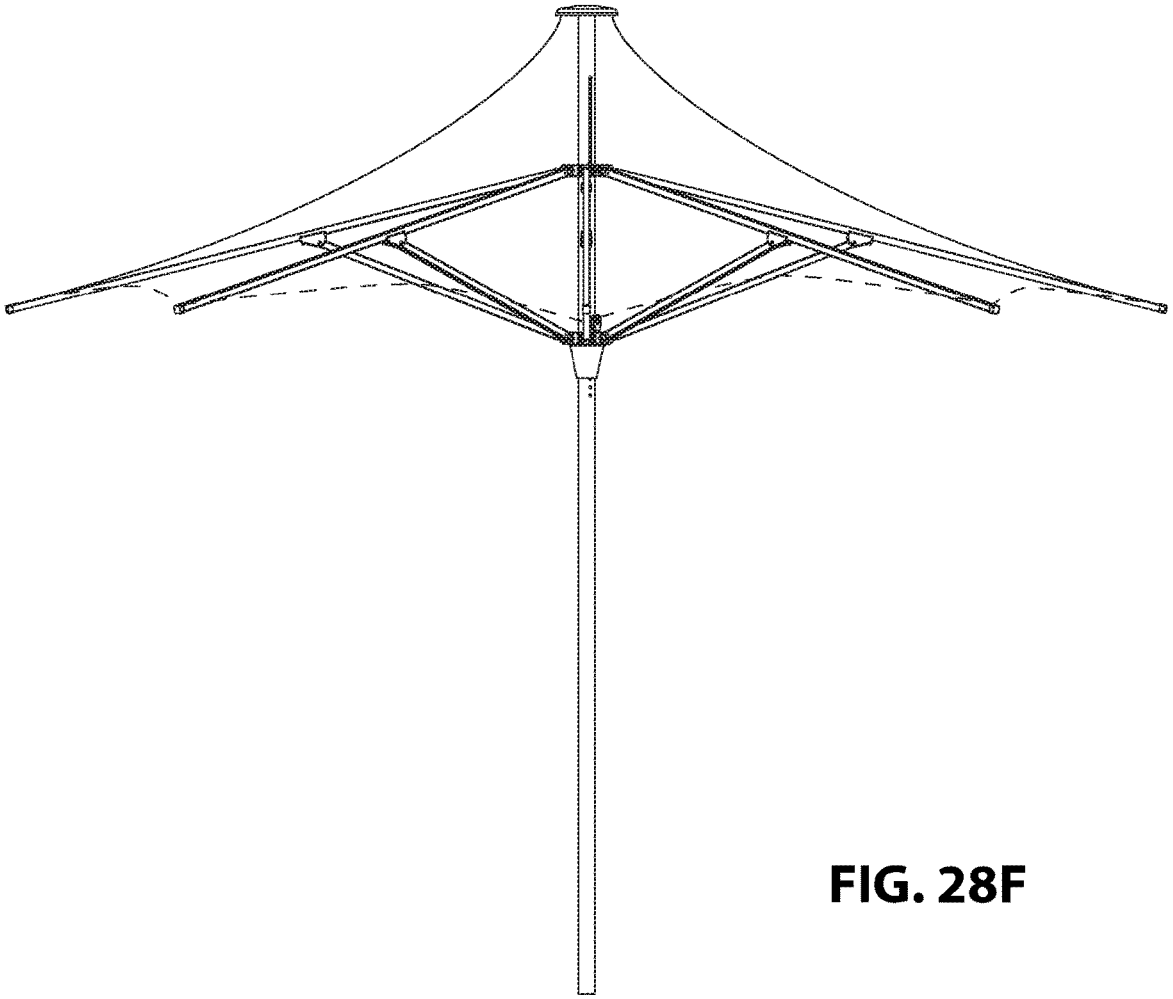
Figure 28F:
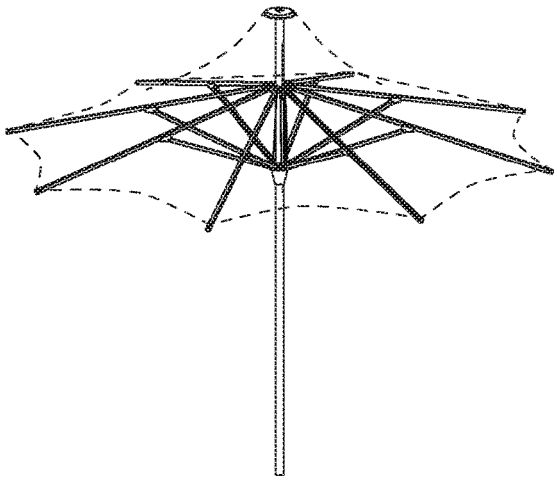
Figure 28G:
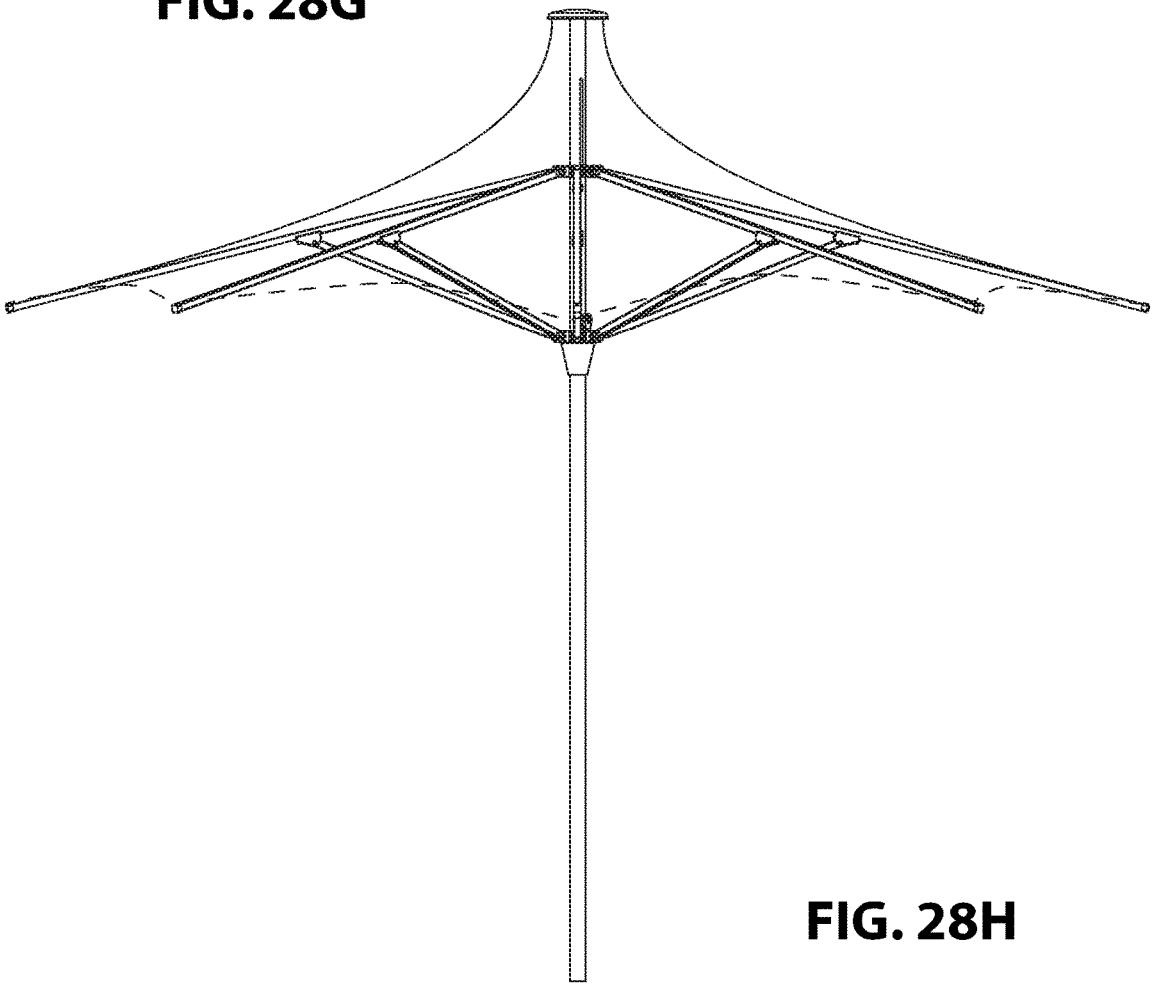
Figure 28H:
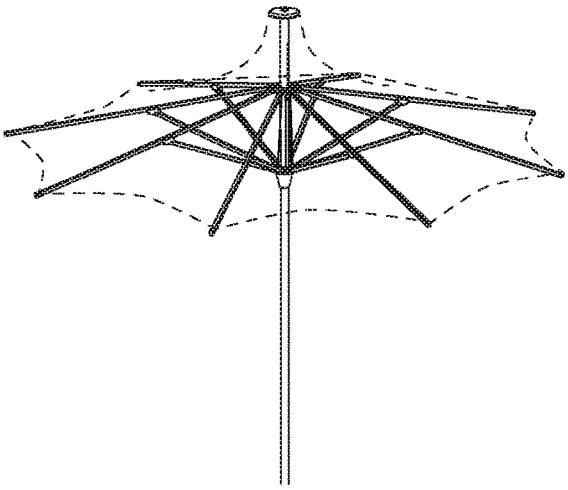

(see FIG. 26D).

35) Auditorily-snap-locking recess 135 is for:

a) Locking two of four auditorily-snap-locking nipples 139 therein, and b) Auditorily alerting that two of four auditorily-snap-locking nipples 139 are locked therein.

36) Two pin-centering pin-guiding plugs 136 respectively are for:

Centering and aligning two pin-centering pin-guiding tubes 137 with two umbrella-pole pin openings 131 inside umbrella pole 109.

37) Two pin-centering pin-guiding tubes 137 respectively are for:

Accurately and conveniently guiding locking pin 134 from one of two umbrella-pole pin openings 131 to another of two umbrella-pole pin openings 131.

38) Four auditorily-snap-locking leaf springs 138 respectively are for:

Springably pushing and auditorily snap-locking four auditorily-snap-locking nipples 139 inside auditorily-snap-locking recess 135, respectively in the opposite directions of arrows 168 and 169

(see FIG. 26A).

39) Four auditorily-snap-locking nipples 139 respectively are for:

Auditorily snap-locking locking pin 134 inside auditorily-snap-locking recess 135.

40) Four internally-taperedly-threaded flexible towers 140 respectively are for:

Springably being pushed outwardly by tower-locking screw 142 to releasably secure two pin-centering pin-guiding plugs 136, two pin-centering pin-guiding tubes 137, four auditorily-snap-locking leaf springs 138, four auditorily-snap-locking nipples 139, four internally-taperedly-threaded flexible towers 140, and twelve triangular tower leaf springs 141 inside umbrella pole 109 at a desire elevation.

41) Twelve triangular tower leaf springs 141 respectively are for:

Springably pushing four internally-taperedly-threaded flexible towers 140 toward the central axis therebetween when four internally-taperedly-threaded flexible towers 140 are pushed outward by tower-locking screw 142 in four directions of arrows 162*a*, 162*b*, 162*c* and 162*d* (see FIG. 26A).

42) Tower-locking screw 142 is for:

Threadedly pushing four internally-taperedly-threaded flexible towers 140 outward to releasably secure two pin-centering pin-guiding plugs 136, two pin-centering pin-guiding tubes 137, four auditorily-snap-locking leaf springs 138, four auditorily-snap-locking nipples 139, four internally-taperedly-threaded flexible towers 140, and twelve triangular tower leaf springs 141 inside umbrella pole 109 at a desire elevation.

43) Adjustable-wedging base system 143 is for performing the combined functions of its components.

44) Base 144 is for:

Providing a weighted base for pole receiver 146 to be inserted.

45) Wedging regulator 145 is for:

Securing pole receiver 146 within base 144.

46) Pole receiver 146 is for:

Securely allowing umbrella pole 109 to be attached to base 144.

47) Threaded screw-knob hole 147 is for:

Providing a location for pole-securing screw-knob 148 to threadedly insert.

48) Pole-securing screw-knob 148

Securing umbrella pole 109 to pole receiver 146 (which is optional).

49) Pole-receiver plate 149 is for:

Providing support for plate screw 150 to attach to pole receiver 146,

50) Plate screw 150 is for:

Securing base 144 to pole receiver 146.

Variation

Figure 29A:
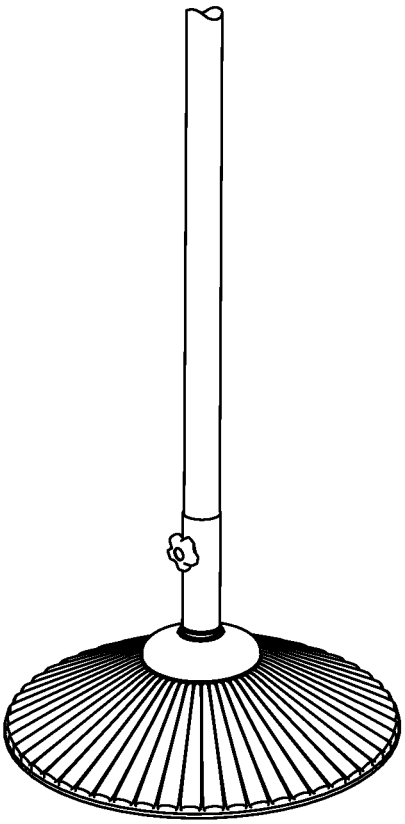
FIG. 29A and FIG. 29B illustrate perspective views of equivalent variations of pole receiver having two threaded screw-knob holes and two pole-securing screw-knobs installed.
Figure 29B:
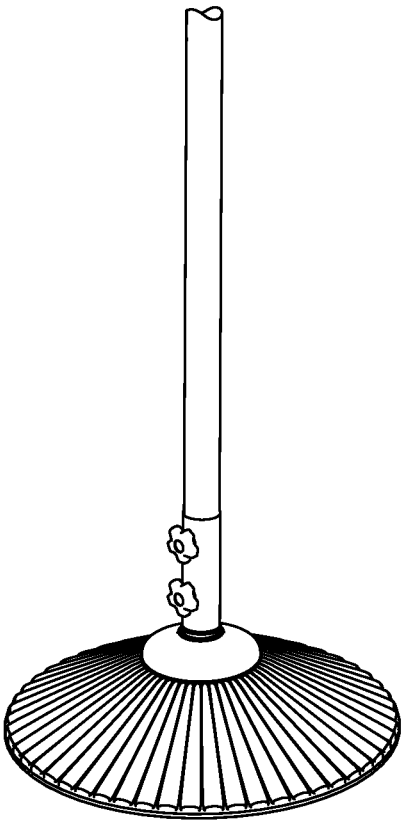
Figure 30A:
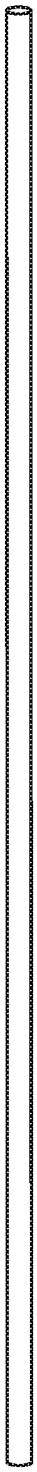
FIG. 30A illustrates a perspective view of equivalent variation of umbrella pole 109.
Figure 30B:
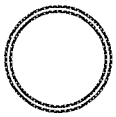
FIG. 30B, FIG. 30C, FIG. 30D, FIG. 30E, FIG. 30F, FIG. 30G, FIG. 30H, and FIG. 30I illustrate top views of equivalent variations of the cross-sectional shape of umbrella pole 109, which umbrella pole 109 could have.
Figure 30C:
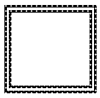
Figure 30D:
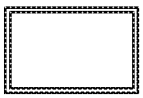
Figure 30E:
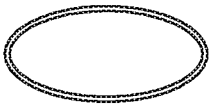
Figure 30F:
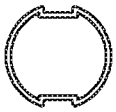
Figure 30G:
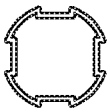
Figure 30H:
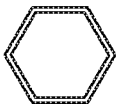
Figure 30I:
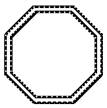
Figure 30J:
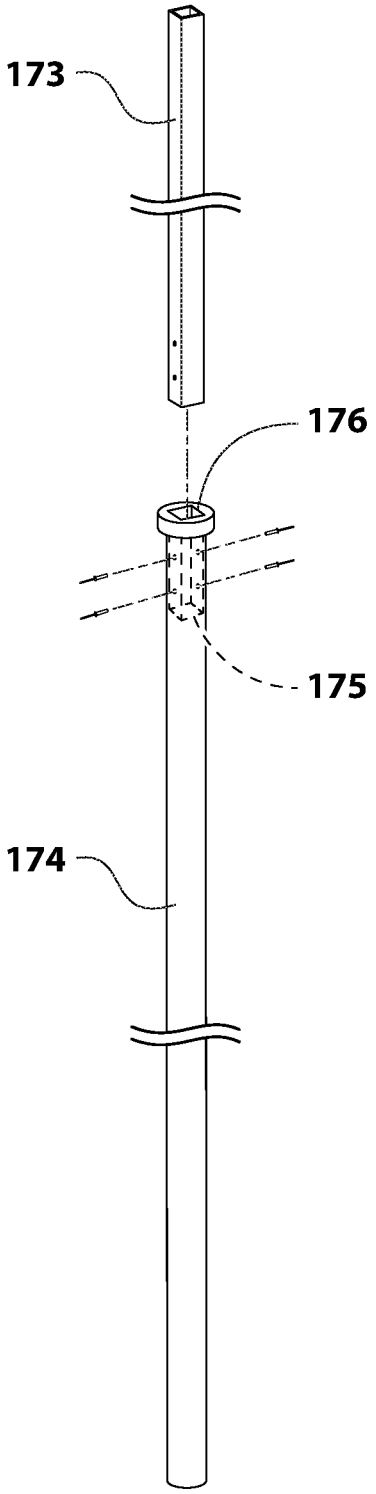
FIG. 30J illustrates a variation of umbrella pole 109 having an upper portion 173, a lower portion 174, a core 175, and connecting hole 176 for upper portion 173 to be inserted therein to connect upper portions 173 and lower portion 174 together with rivets or screws.
Figure 30K:
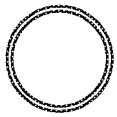
FIG. 30K, FIG. 30L, FIG. 30M, FIG. 30N, FIG. 30O, FIG. 30P, 30Q, and FIG. 30R illustrate the cross-sectional shapes, one of which each of upper portion 173, lower portion 174, core 175, and connecting hole 176 can have.
Figure 30L:
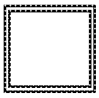
Figure 30M:
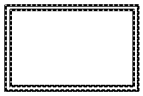
Figure 30N:
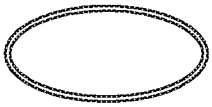
Figure 30O:
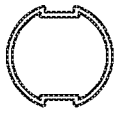
Figure 30P:
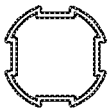
Figure 30Q:
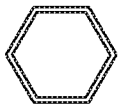
Figure 30R:
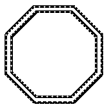
Figure 31A:
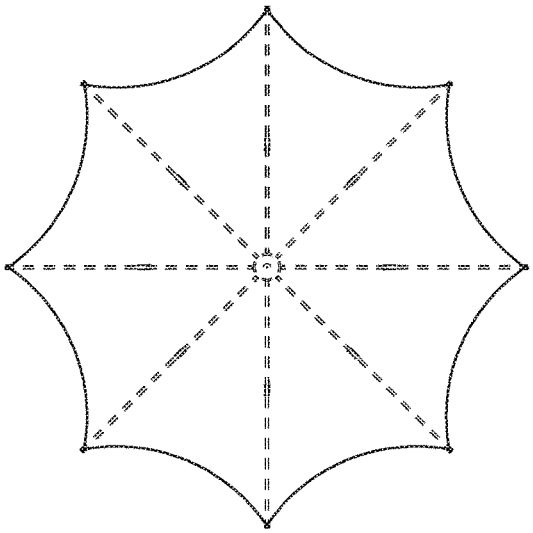
FIG. 31A, FIG. 31B, FIG. 31C, and FIG. 31D illustrate side and perspective views of equivalent variations of canopy variations.
Figure 31B:
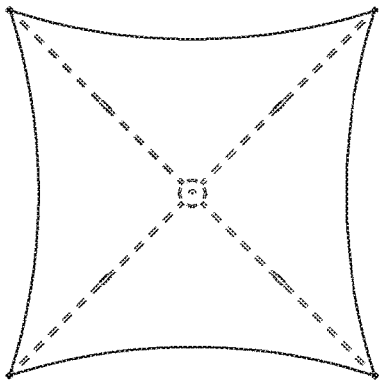
Figure 31C:
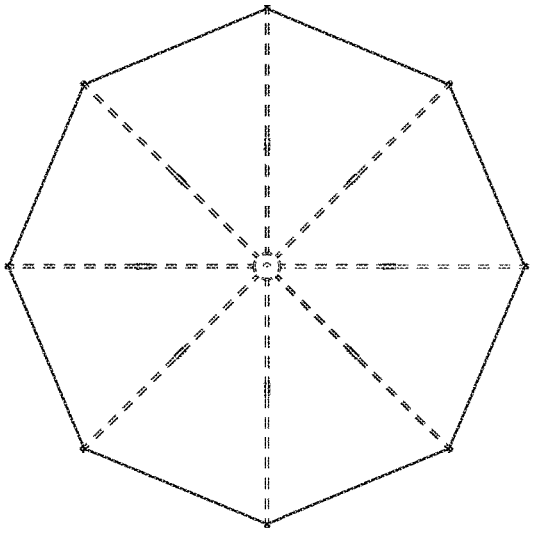
Figure 31D:
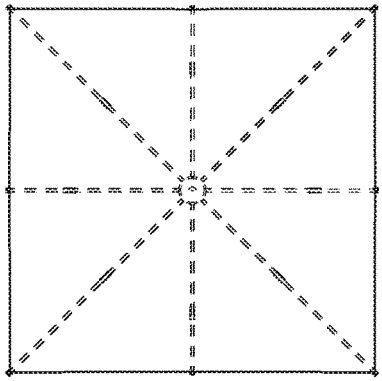
Figure 32:
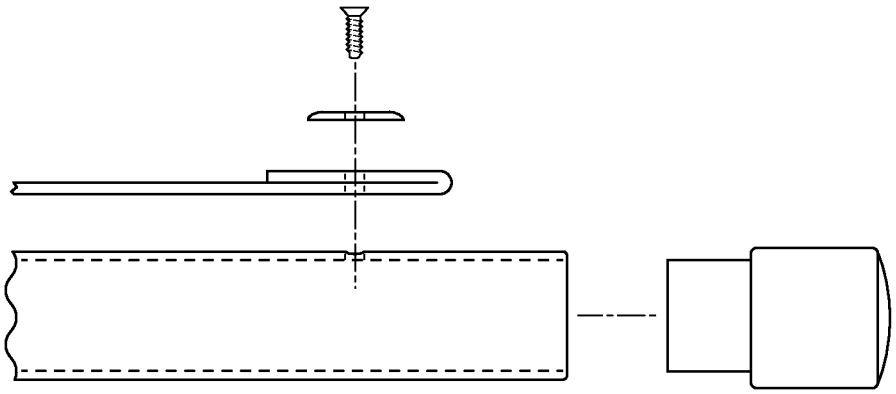
FIG. 32 illustrates a side view of an equivalent variation of an arthritic-aiding canopy-tension-adjusting system.
Figure 33A:
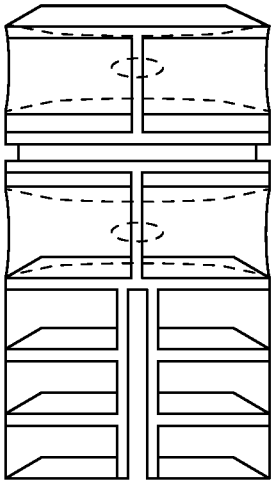
FIG. 33A and FIG. 33B illustrate equivalent variations of an arthritic-aiding pin-centering pin-guiding auditorily-snap-locking tower-locking system.
Figure 33B:
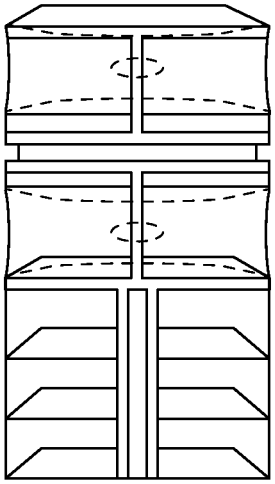
Figure 34A:
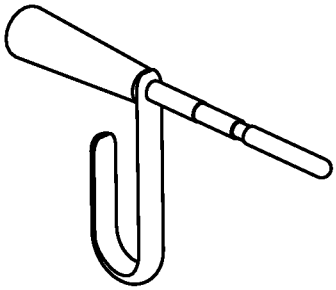
FIG. 34A and FIG. 34B illustrate equivalent variations of an arthritic-aiding cord-hook grip ring.
Figure 34B:
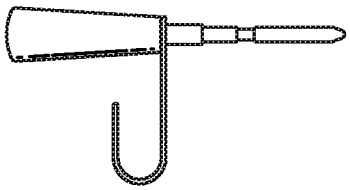
Figure 35:
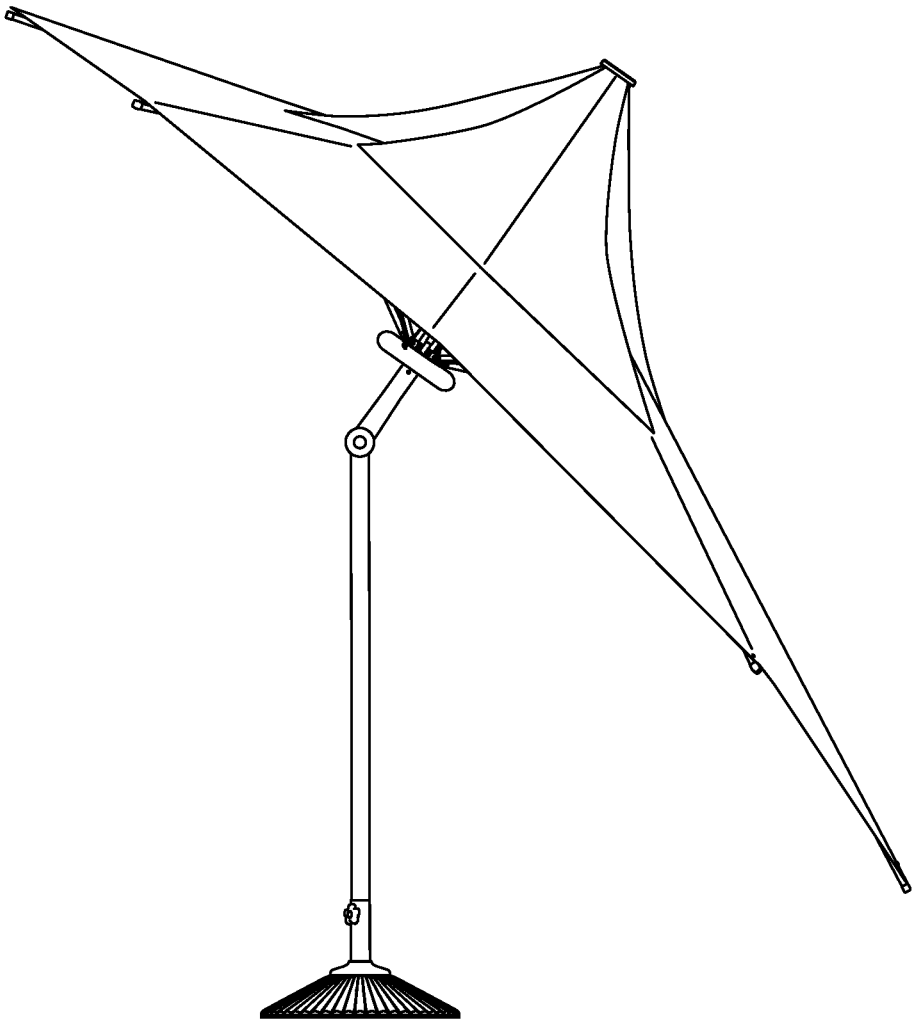
FIG. 35 illustrates a variation of the arthritic-aiding triple-sail wind-rotating wind-aligning auditory-pin-snap-locking-and-centering umbrella with its umbrella pole having joint, which allows its canopy to be deployed in an angle.

Referring to FIG. 27A, FIG. 27B, FIG. 27C, FIG. 27D, FIG. 27E, FIG. 27F, FIG. 27G, FIG. 28A, FIG. 28B, FIG. 28C, FIG. 28D, FIG. 28E, FIG. 28F, FIG. 28G, FIG. 28H, FIG. 29A, FIG. 29B, FIG. 30A, FIG. 30B, FIG. 30C, FIG. 30D, FIG. 30E, FIG. 30F, FIG. 30G, FIG. 30H, FIG. 30I, FIG. 30J, FIG. 30K, FIG. 30L, FIG. 30M, FIG. 30N, FIG. 30O, FIG. 30P, FIG. 30Q, FIG. 30OR, FIG. 31A, FIG. 31B, FIG. 31C, FIG. 31D, FIG. 32, FIG. 33A, FIG. 33B, FIG. 34A, FIG. 34B, and FIG. 35:

Any component of the arthritic-aiding triple-sail wind-rotating wind-aligning auditory-pin-snap-locking-and-centering umbrella can have any shape and size. Any component of the arthritic-aiding triple-sail wind-rotating wind-aligning auditory-pin-snap-locking-and-centering umbrella can be made of any material or any combination of any materials. Any component of the arthritic-aiding triple-sail wind-rotating wind-aligning auditory-pin-snap-locking-and-centering umbrella can be made of any flexible, semi-flexible, bendable, semi-bendable, rigid, or semi-rigid material(s). FIG. 27A, FIG. 27B, FIG. 27C, FIG. 27D, FIG. 27E, FIG. 27F, and FIG. 27G illustrate perspective, top, and side views of equivalent variations of the arthritic-aiding triple-sail wind-rotating wind-aligning auditory-pin-snap-locking-and-centering umbrella. FIG. 28A, FIG. 28B, FIG. 28C, FIG. 28D, FIG. 28E, FIG. 28F, FIG. 28G, and FIG. 28H illustrate side and perspective views of equivalent variations of the arthritic-aiding triple-sail wind-rotating wind-aligning auditory-pin-snap-locking-and-centering umbrella. FIG. 29B illustrates a perspective view of equivalent variations of pole receiver 146 having two threaded screw-knob holes and two pole-securing screw-knobs. FIG. 30A illustrates a perspective view of equivalent variation of umbrella pole 109. FIG. 30B, FIG. 30C, FIG. 30D, FIG. 30E, FIG. 30F, FIG. 30G, FIG. 30H, and FIG. 30I illustrate top views of equivalent variations of the cross-sectional shape of umbrella pole 109, which umbrella pole 109 could have. FIG. 30J illustrates a variation of umbrella pole 109 having an upper portion 173, a lower portion 174, a core 175, and connecting hole 176 for upper portion 173 to be inserted therein to connect upper portions 173 and lower portion 174 together with rivets or screws. Each of upper portion 173, lower portion 174, core 175, and connecting hole 176 can have a cross-sectional shape selected from the cross-sectional shapes from FIG. 30K, FIG. 30L, FIG. 30M, FIG. 30N, FIG. 30O, FIG. 30P, and FIG. 30Q and FIG. 30R. The arthritic-aiding triple-sail wind-rotating wind-aligning auditory-pin-snap-locking-and-centering umbrella can be operated without arthritic-aiding tri-pulley system 122 and anti-cable-fraying cable-locking gear-cam system 126. FIG. 31A, FIG. 31B, FIG. 31C, and FIG. 31D illustrate top views of equivalent variations of canopy 102. FIG. 32 illustrates a side view of an equivalent variation of arthritic-aiding canopy-tension-adjusting system 111. FIG. 33A and FIG. 33B illustrate equivalent variations of arthritic-aiding pin-centering pin-guiding auditorily-snap-locking tower-locking system 130. FIG. 34A and FIG. 34B illustrate equivalent variations of arthritic-aiding ergonomic cord-hook grip ring 132. FIG. 35 illustrates an equivalent variation of the arthritic-aiding triple-sail wind-rotating wind-aligning auditory-pin-snap-locking-and-centering umbrella with its umbrella pole having a joint, which allows its canopy to be deployed in an angle.

MAJOR ADVANTAGES OF THE INVENTION

The present invention substantially departs from the conventional concepts and designs of the prior art. In doing so, the present invention provides a (or an) arthritic-aiding triple-sail wind-rotating wind-aligning auditory-pin-snap-locking-and-centering umbrella, having many unique and significant features, functions, and advantages, which overcome all the disadvantages of the prior art, as follows:

1) It is an object of the new invention to provide an arthritic-aiding triple-sail wind-rotating wind-aligning auditory-pin-snap-locking-and-centering umbrella, having
   first arthritic-aiding canopy-rotating-and-aligning sail 103,
   second arthritic-aiding canopy-rotating-and-aligning sail 104, and
   third arthritic-aiding canopy-rotating-and-aligning sail 105.

Therefore, the arthritic-aiding triple-sail wind-rotating wind-aligning auditory-pin-snap-locking-and-centering umbrella:
   a) Can catch wind to use wind to automatically rotate canopy 102 and umbrella pole 109 to align with the direction of wind
      in the directions of arrows 151*a*, 151*b*, 151*c*, 151*d*, 151*e*, 151*f*, 152*a*, 152*b*, 152*c*, 152*d* and 152*e*
      (see FIG. 21A, FIG. 21B, FIG. 21C, FIG. 21D, FIG. 21E, and FIG. 21F),
   b) Can automatically align canopy 102 with the direction of wind to block wind from occupants (using the extended section of canopy 102)
      to protect occupants and belongings
      in the directions of arrows 151*a*, 151*b*, 151*c*, 151*d*, 151*e*, 151*f*, 152*a*, 152*b*, 152*c*, 152*d* and 152*e*
      (see FIG. 21A, FIG. 21B, FIG. 21C, FIG. 21D, FIG. 21E, and FIG. 21F),
   c) Can assist those with arthritis by automatically aligning canopy 102 with the direction of wind to block wind from occupants
      to prevent arthritic from having to use hands to adjust canopy 102
      in the directions of arrows 151*a*, 151*b*, 151*c*, 151*d*, 151*e*, 151*f*, 152*a*, 152*b*, 152*c*, 152*d* and 152*e*
      (see FIG. 21A, FIG. 21B, FIG. 21C, FIG. 21D, FIG. 21E, and FIG. 21F),
   d) Can prevent canopy 102 from blowing over by automatically aligning canopy 102 to the direction of wind
      to prevent injury to occupants and damage to property
      in the directions of arrows 151*a*, 151*b*, 151*c*, 151*d*, 151*e*, 151*f*, 152*a*, 152*b*, 152*c*, 152*d* and 152*e*
      (see FIG. 21A, FIG. 21B, FIG. 21C, FIG. 21D, FIG. 21E, and FIG. 21F),
   e) Can automatically and repeatedly adjust canopy 102 to the direction of wind when the direction of wind changes
      to provide ease of use for user
      in the directions of arrows 151*a*, 151*b*, 151*c*, 151*d*, 151*e*, 151*f*, 152*a*, 152*b*, 152*c*, 152*d* and 152*e*
      (see FIG. 21A, FIG. 21B, FIG. 21C, FIG. 21D, FIG. 21E, and FIG. 21F).

2) It is an object of the new invention to provide an arthritic-aiding triple-sail wind-rotating wind-aligning auditory-pin-snap-locking-and-centering umbrella, having
   adjustable hub-rotation-preventing slot 110, and
   adjustable hub-rotation-preventing peg 119.

Figure 9:
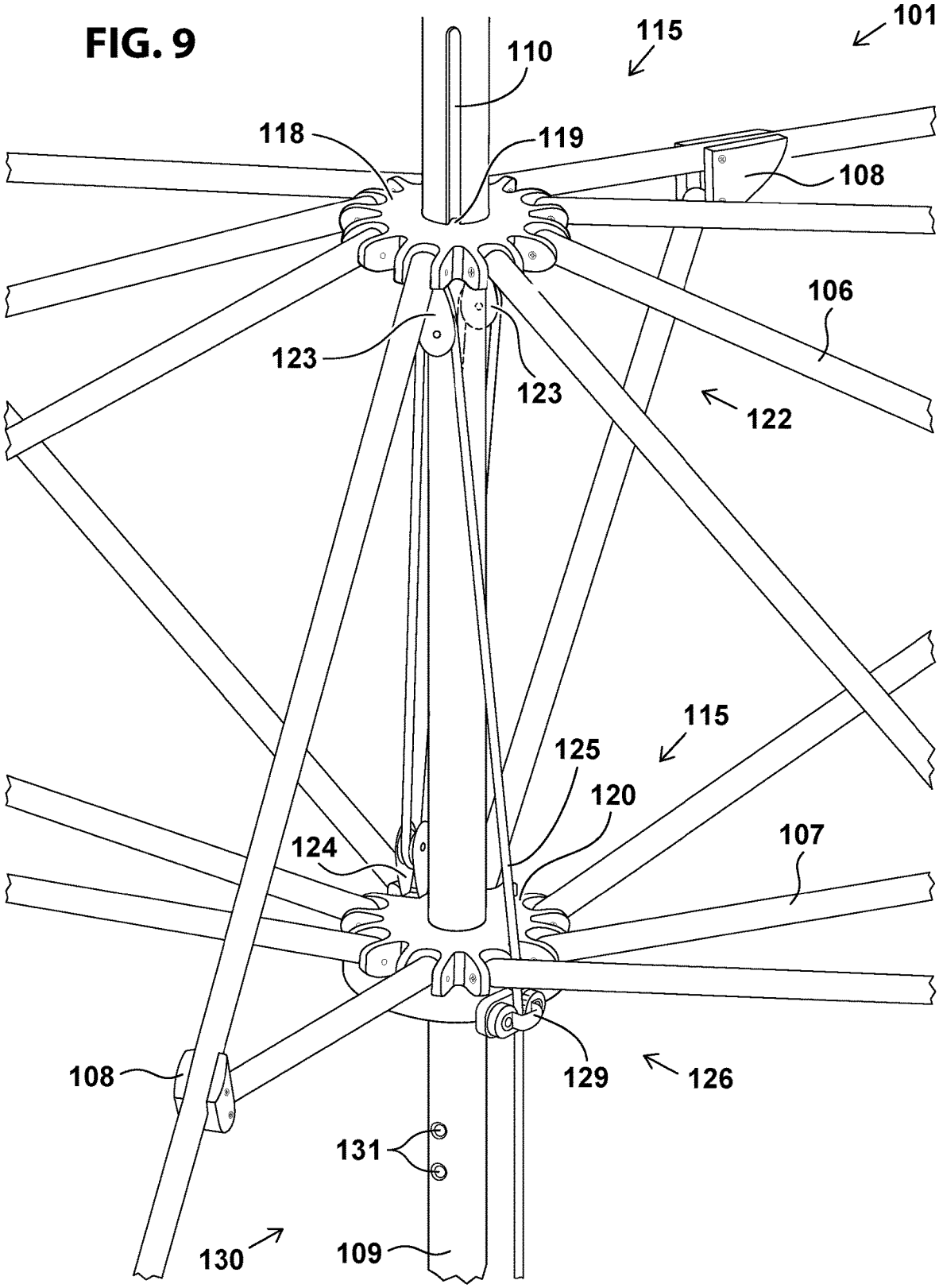
Figure 10:
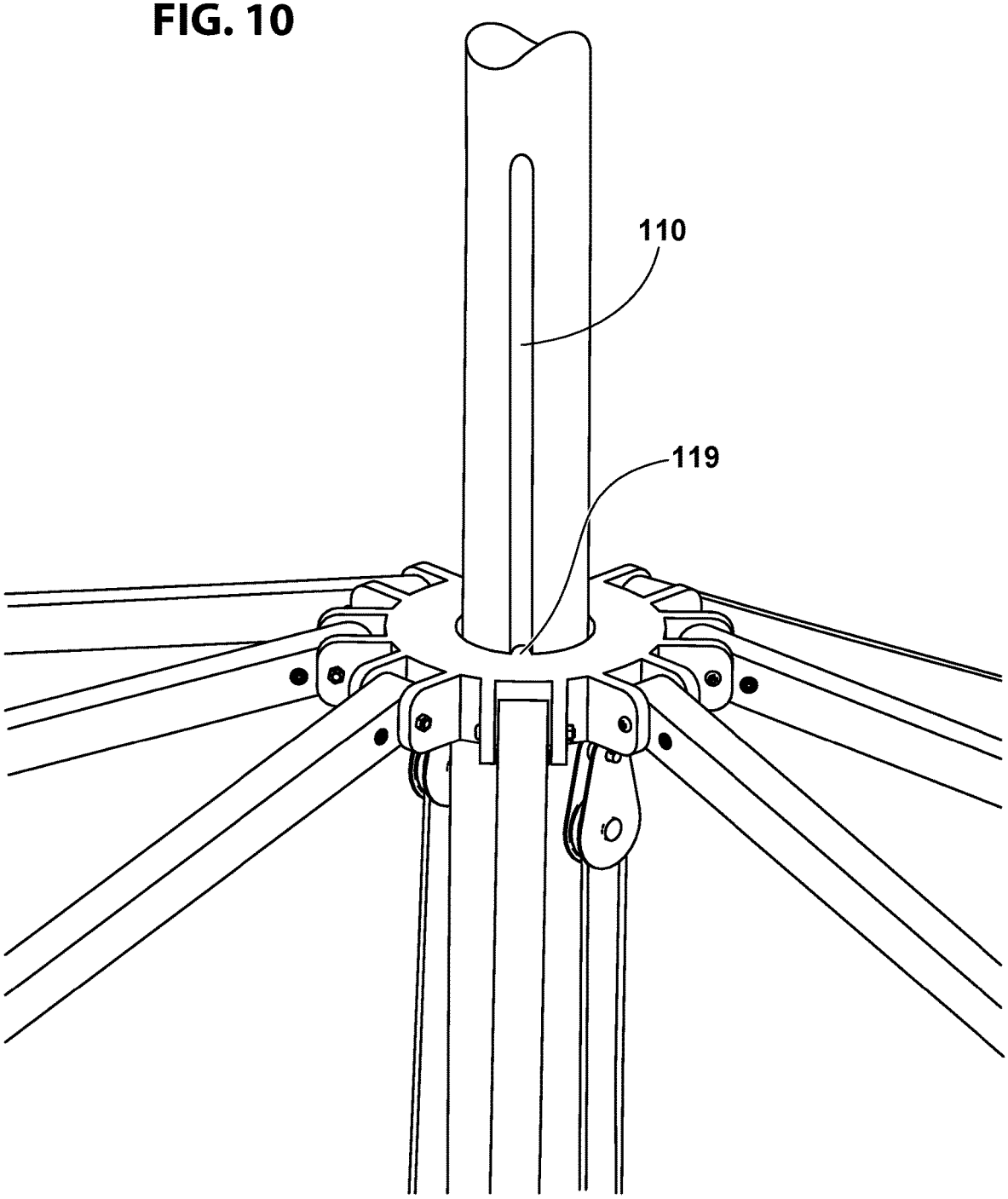
Figure 11:
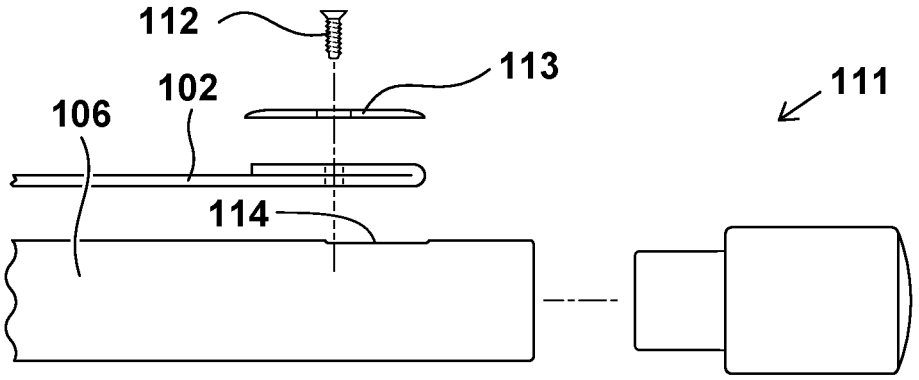
FIG. 11, FIG. 12, FIG. 13, and FIG. 14 illustrate side and top views of an arthritic-aiding canopy-tension-adjusting system and its varying components.
Figure 12:
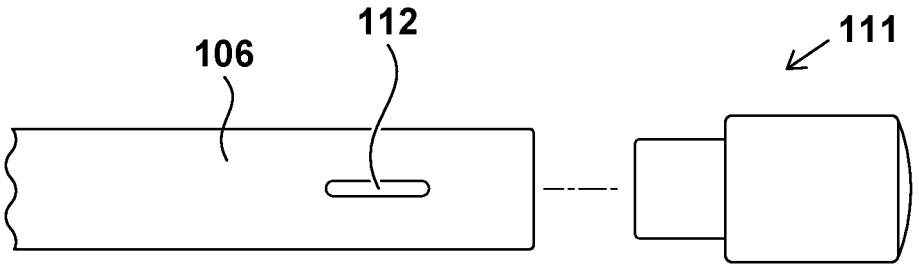
Figure 13:
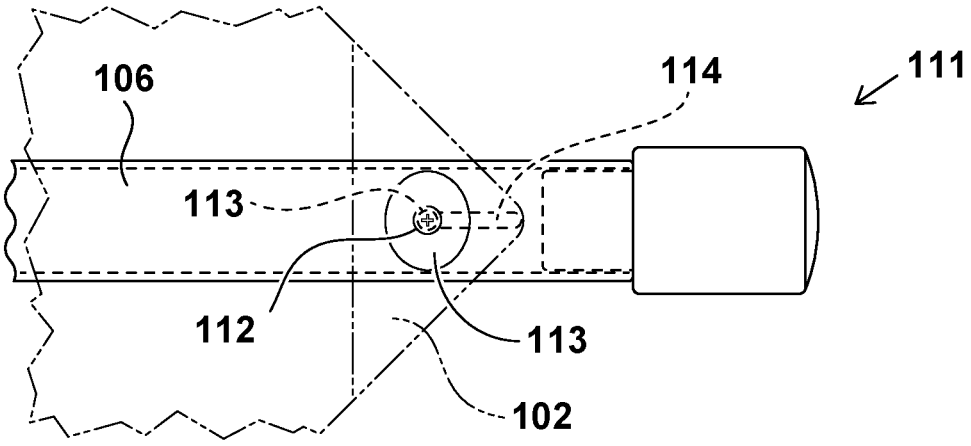
Figure 14:
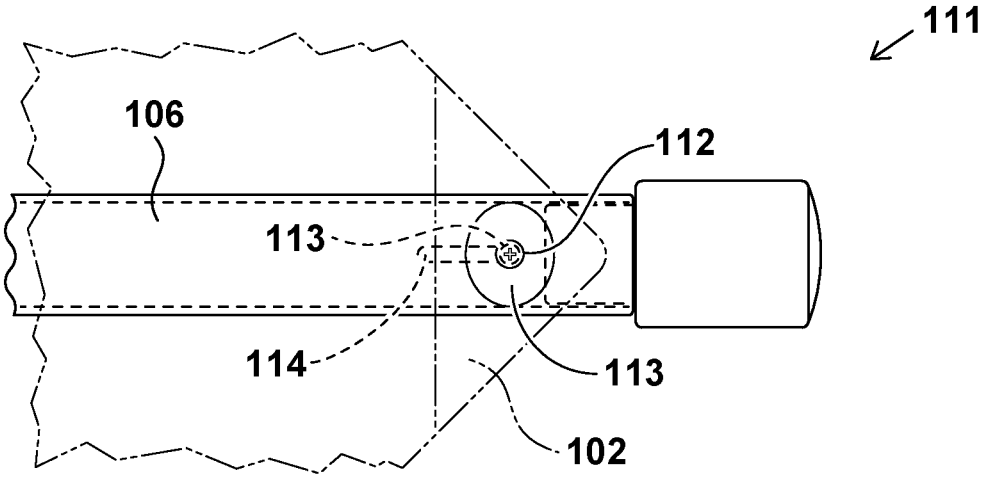

Therefore, the arthritic-aiding triple-sail wind-rotating wind-aligning auditory-pin-snap-locking-and-centering umbrella:
   a) Can secure adjustable hub-rotation-preventing peg 119 in adjustable hub-rotation-preventing slot 110 to prevent fixed hub 118 from turning radially (see FIG. 9 and FIG. 10);
   b) Can secure fixed hub 118 from spinning radially (see FIG. 9 and FIG. 10).

3) It is an object of the new invention to provide an arthritic-aiding triple-sail wind-rotating wind-aligning auditory-pin-snap-locking-and-centering umbrella, having arthritic-aiding ring elevator 121.

Figure 3:
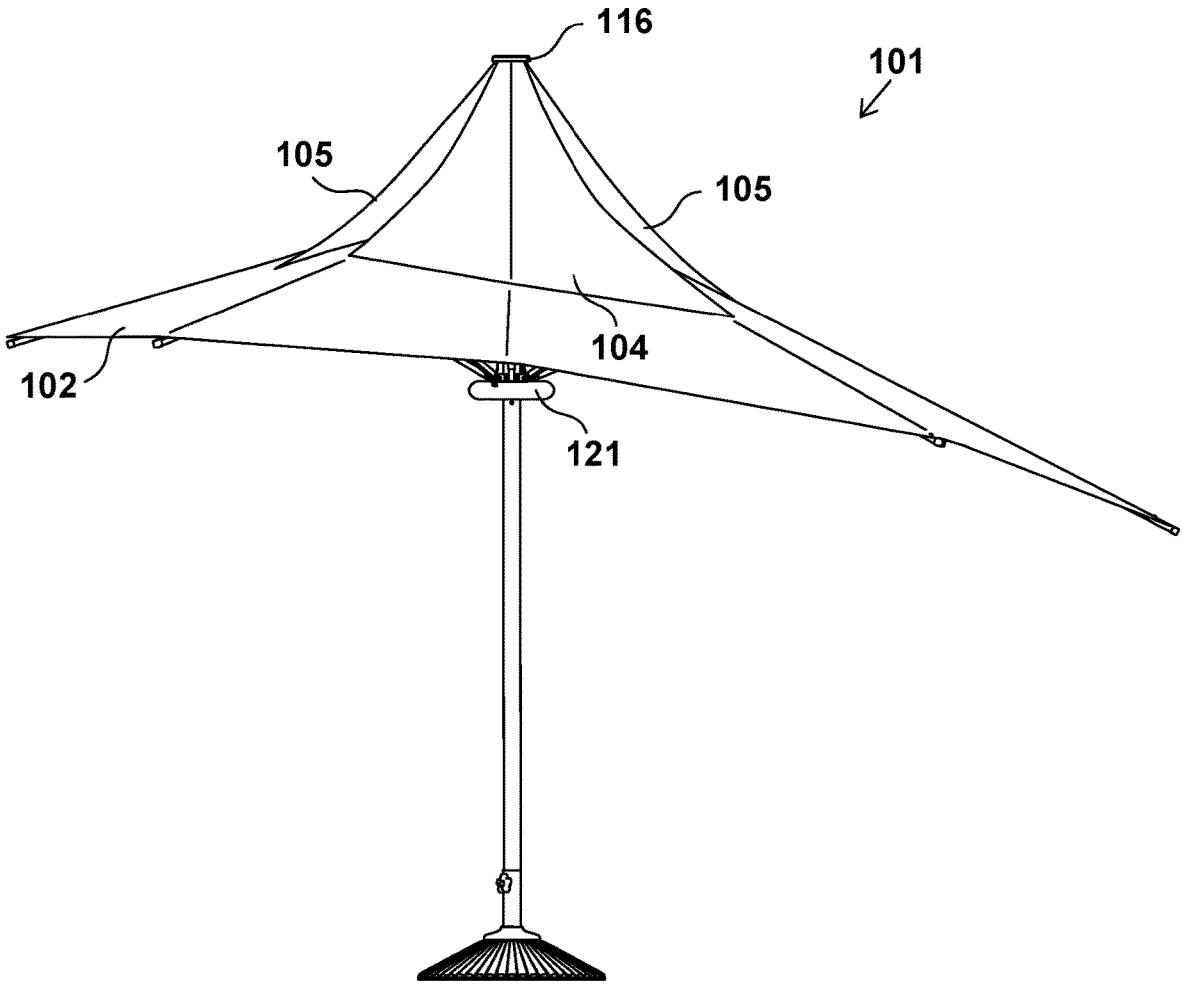
Figure 4:
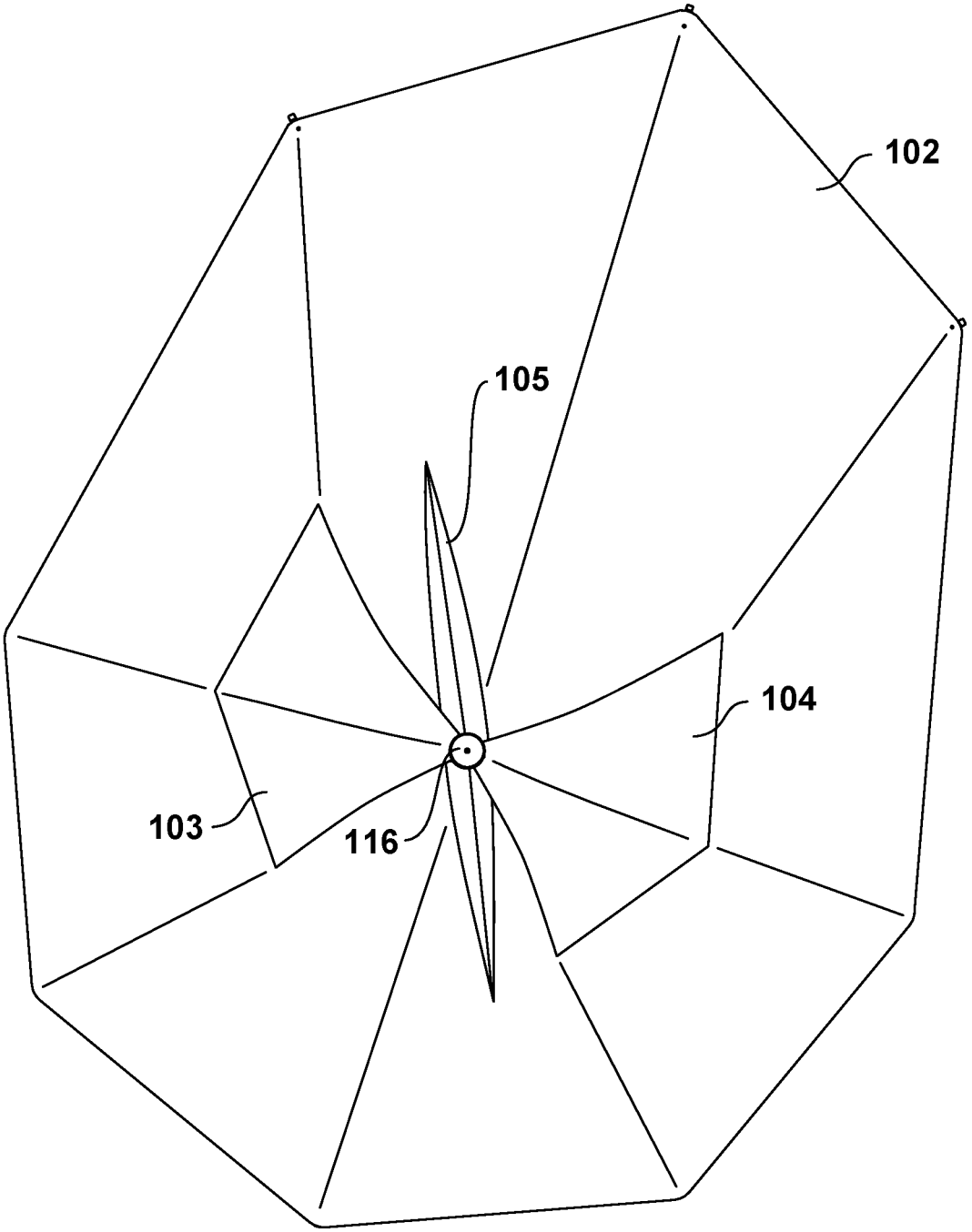
Figure 5:
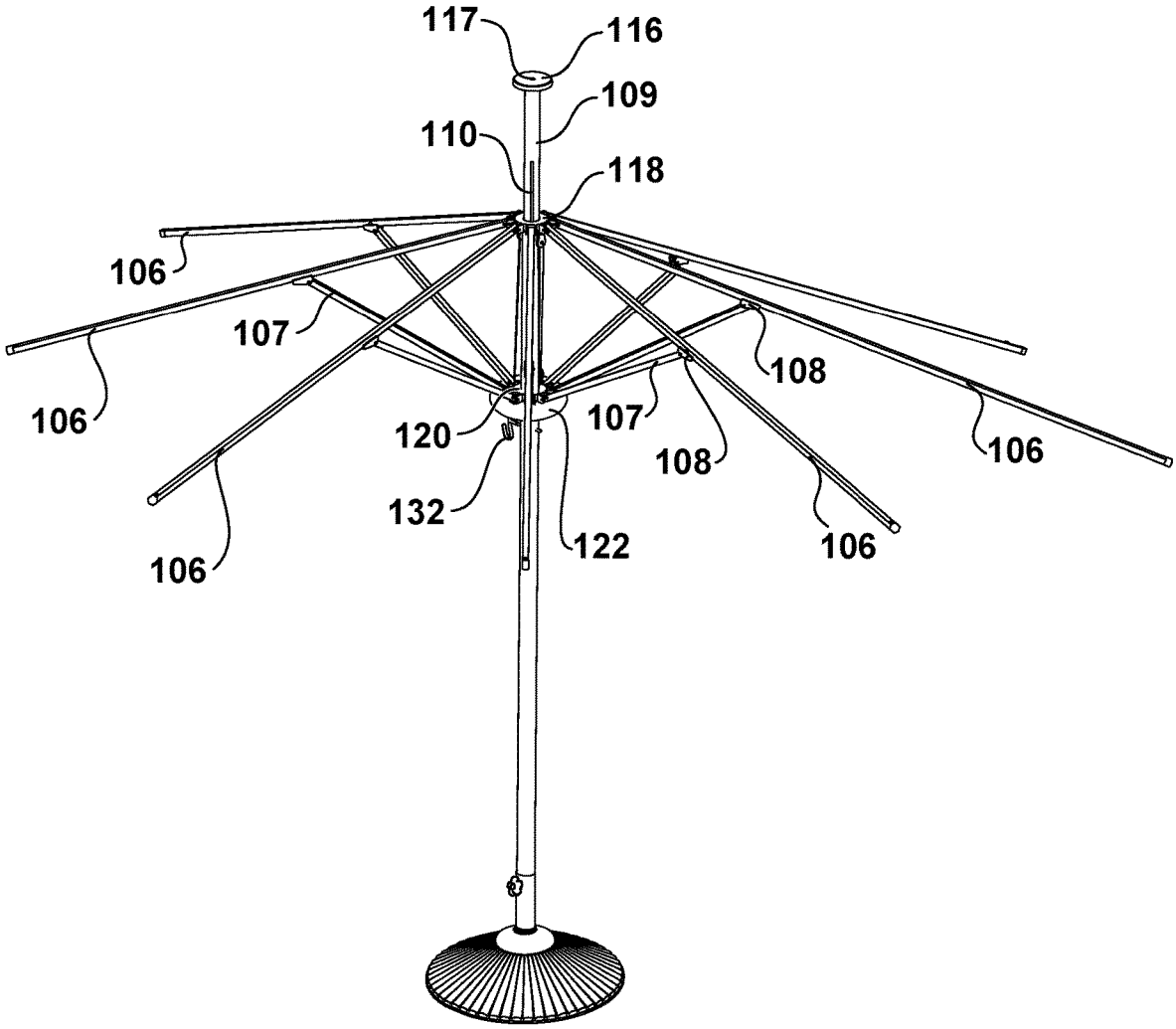
FIG. 5, FIG. 6, FIG. 7, FIG. 8, FIG. 9, and FIG. 10 illustrate perspective, side, and top views of the arthritic-aiding triple-sail wind-rotating wind-aligning auditory-pin-snap-locking-and-centering umbrella and its varying components.
Figure 6:
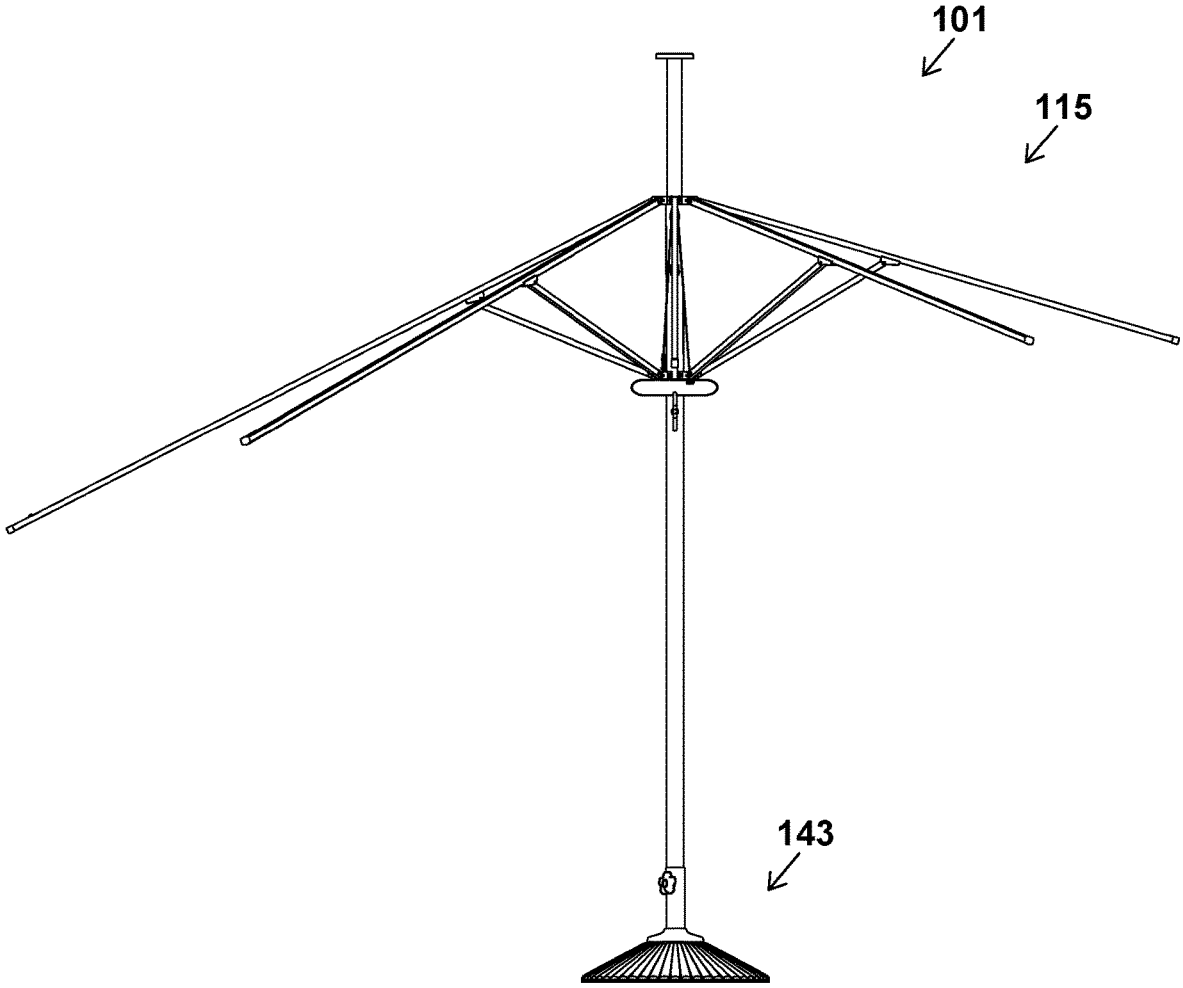
Figure 7:
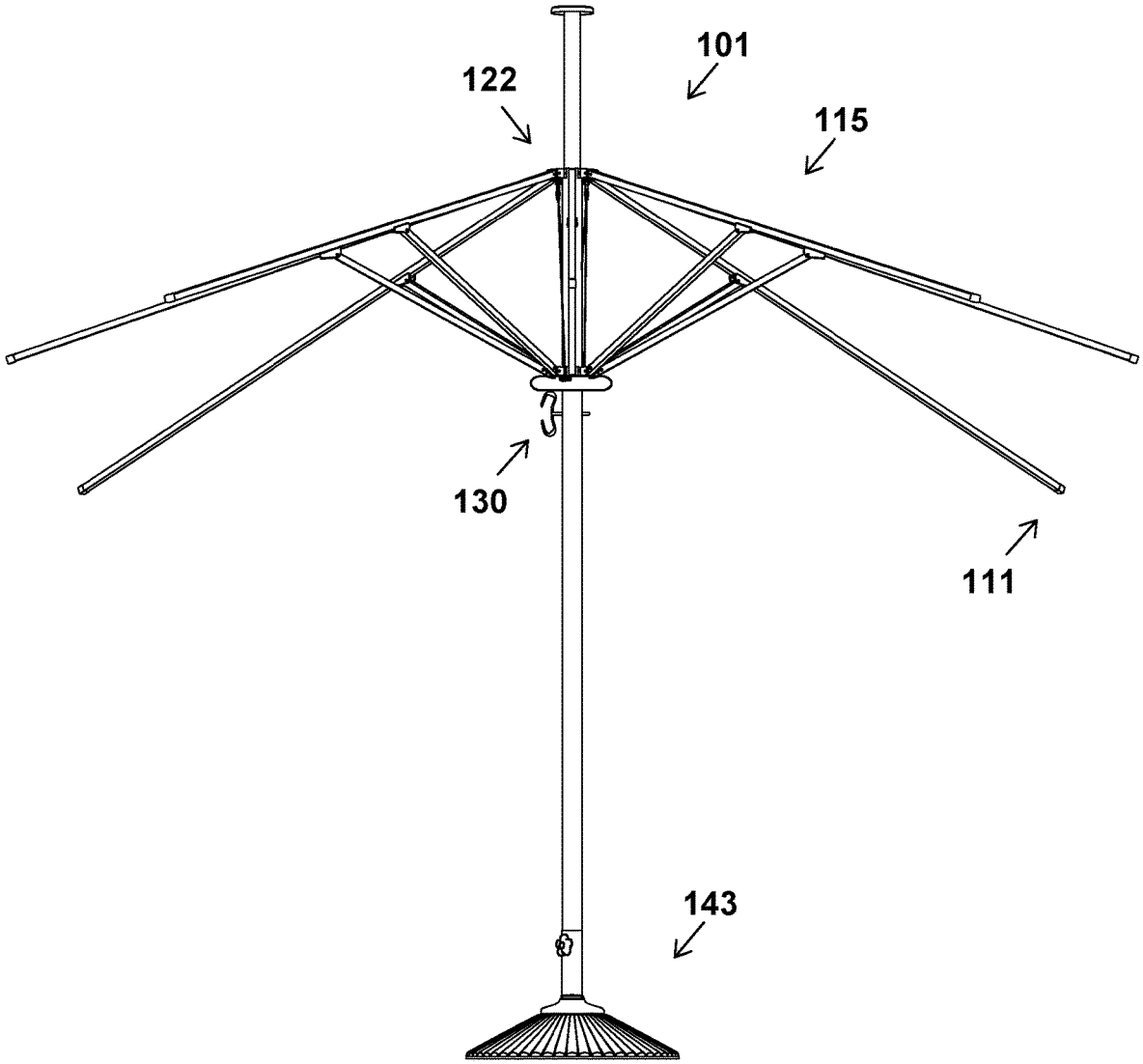
Figure 8:
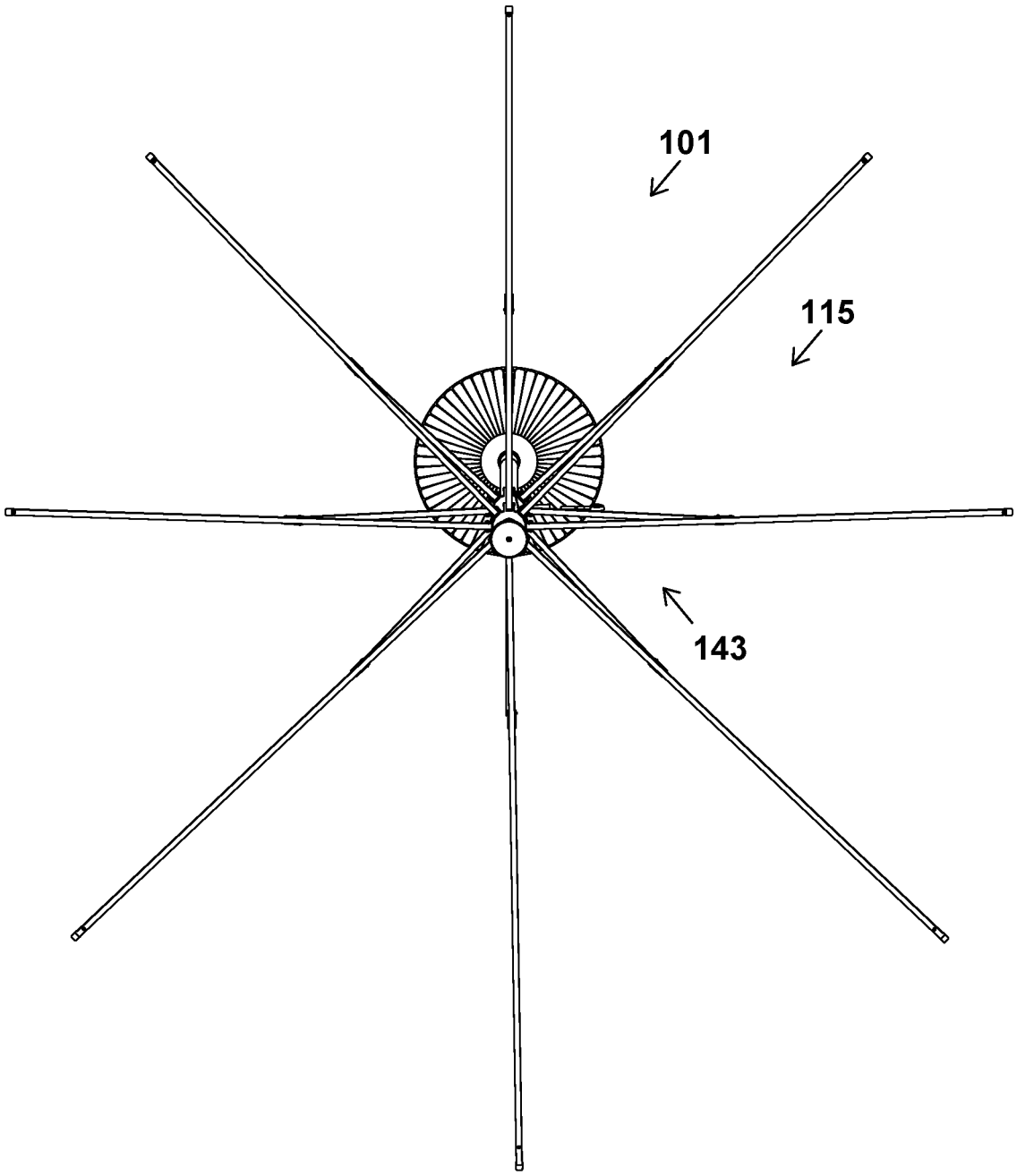
Figure 22A:
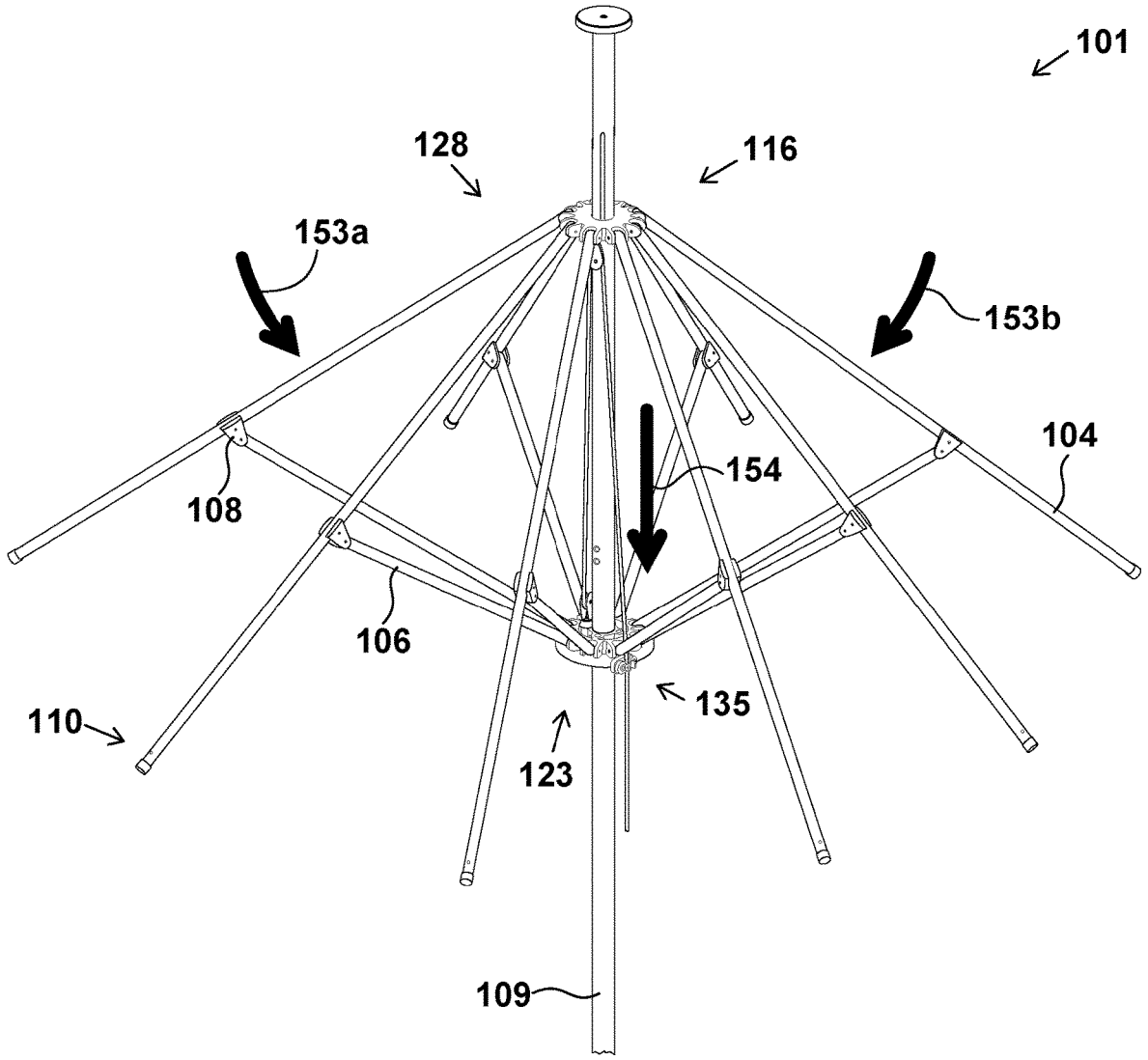
FIG. 22A, and FIG. 22B illustrate perspective views of the arthritic-aiding triple-sail wind-rotating wind-aligning auditory-pin-snap-locking-and-centering umbrella.
Figure 22B:
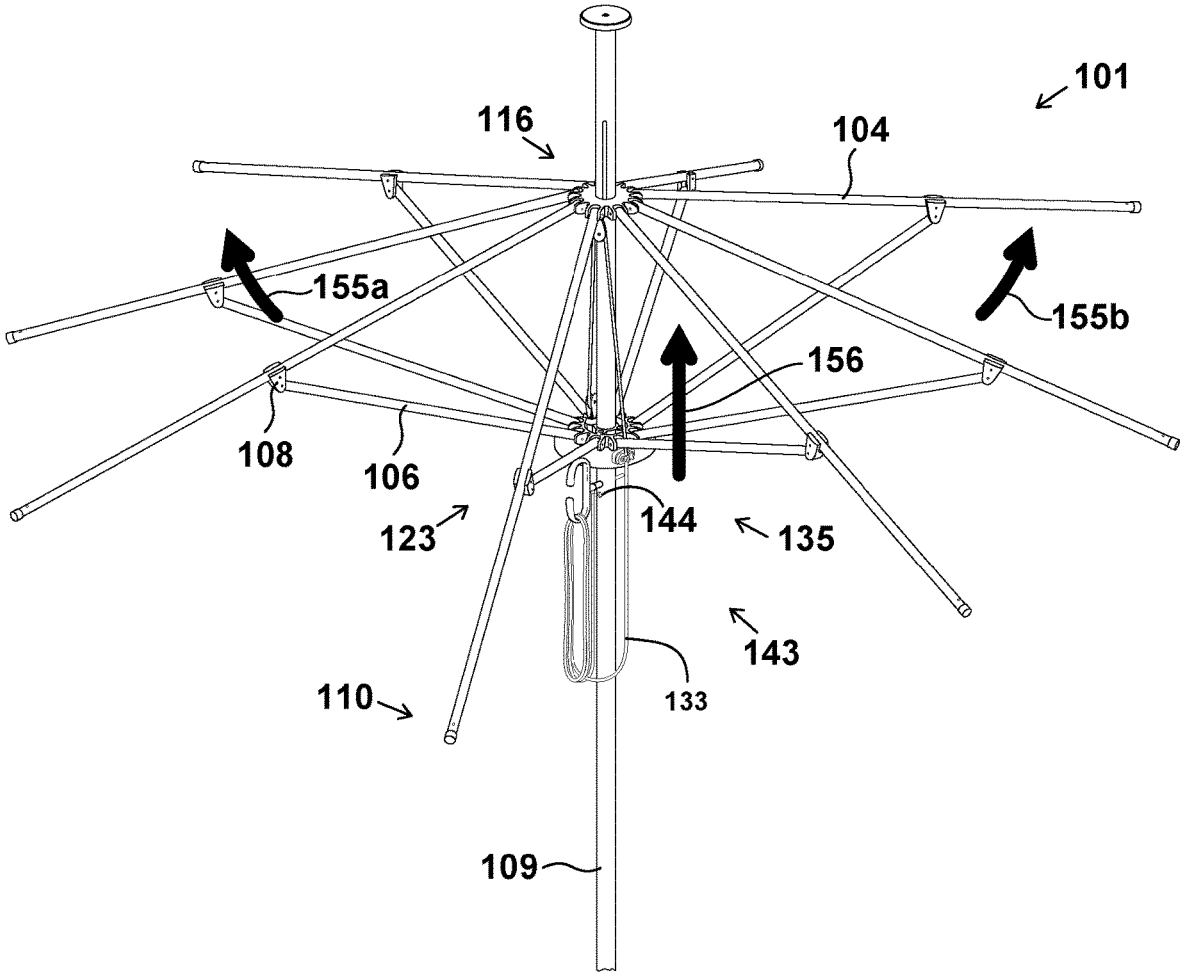
Figure 23A:
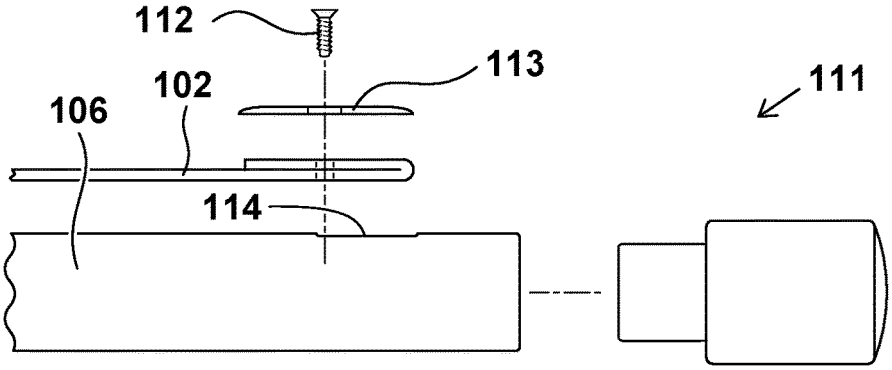
FIG. 23A, FIG. 23B, FIG. 23C, and FIG. 23D illustrate side and top views of an arthritic-aiding canopy-tension-adjusting system.
Figure 23B:
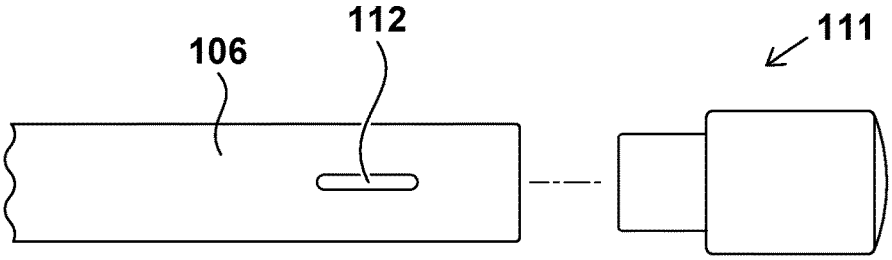
Figure 23C:
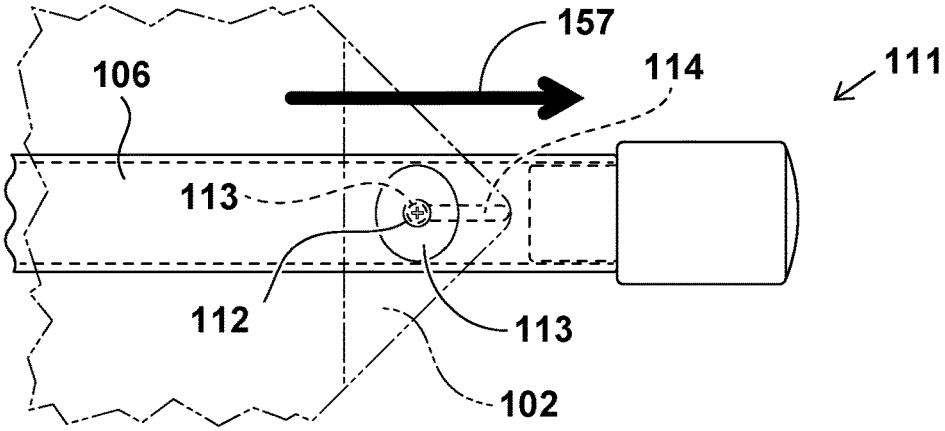
Figure 23D:
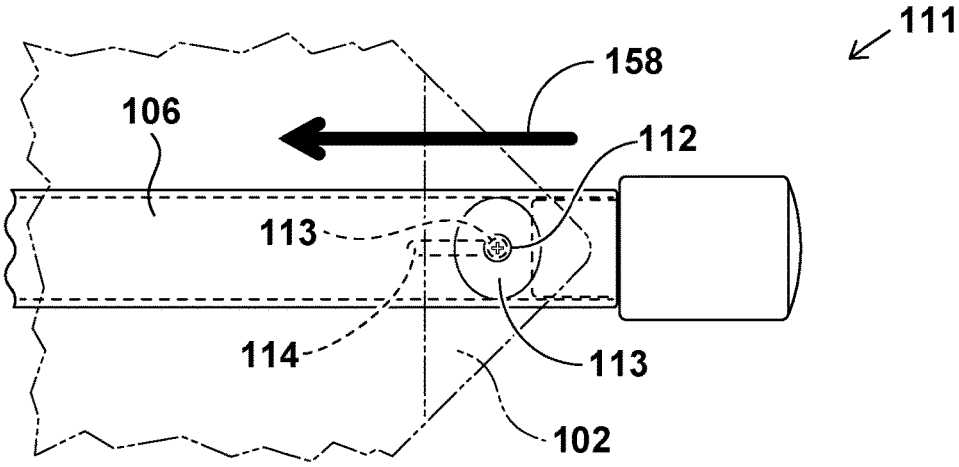

Therefore, the arthritic-aiding triple-sail wind-rotating wind-aligning auditory-pin-snap-locking-and-centering umbrella:

a) Can provide an arthritic-aiding slidable handle to push up and pull down movable hub 120 to deploy and retract upper ribs 106 and lower ribs 107, respectively
   to allow and assist those with arthritic hands to erect and retract umbrella without to need to bend the fingers or wrist
   in the directions of arrows 153*a*, 153*b*, 154, 155*a*, 155*b*, and 156
   (see FIG. 3, FIG. 22A, and FIG. 22B);

b) Can medicinally beneficially allow those with arthritic hands to keep their hands straight and to match the curvature of arthritic-aiding ring elevator 121 with the natural curvature of their hands
   to eliminate the needs for bending fingers and/or wrist, and
   to eliminate hand pain when operating arthritic-aiding ring elevator 121
   in the directions of arrows 154 and 156
   (see FIG. 22A, and FIG. 22B); and c) Can conveniently hook and store pulley cord 125 thereon
   (see FIG. 17)

4) It is another object of the new invention to provide an arthritic-aiding triple-sail wind-rotating wind-aligning auditory-pin-snap-locking-and-centering umbrella, having
arthritic-aiding ergonomic cord-hook grip ring 132 and
anti-finger-pinching spacer 133.

Therefore, the arthritic-aiding triple-sail wind-rotating wind-aligning auditory-pin-snap-locking-and-centering umbrella:

a) Can encircle the broad surface of the metacarpals of the palm of the hand or the broad surface of the union of the metacarpals with the base of the phalanges,
   to provide an enlarged surface area to engage with the palm of an open hand to insert a locking pin, providing greater comfort and availability to an arthritic suffering person
   (FIG. 18B, FIG. 25A, FIG. 25B, and FIG. 26A);

b) Can encircle the broad surface of the metacarpals of the back of the hand or the broad surface of the union of the metacarpals with the base of the phalanges,
   to provide an enlarged surface area; to engage with the back of an open hand; to extract a locking pin, providing greater comfort and availability to an arthritic suffering person
   (FIG. 18B, FIG. 25A, FIG. 25B, and FIG. 26A);

c) Can allow a user with an arthritic hand to keep his/her hand straight,
   to eliminate the needs to bend ones' fingers and wrist when holding and operating arthritic-aiding cord-hook grip ring
   (FIG. 18B, FIG. 25A, FIG. 25B, and FIG. 26A); and d) Can allow a user with an arthritic hand to keep his/her hand straight,
   to render access to the interior of the hook section, for conveniently storing a coiled excess portion of a pulley cord
   (FIG. 18B, FIG. 25A, FIG. 25B, and FIG. 26A).

5) It is another object of the new invention to provide an arthritic-aiding triple-sail wind-rotating wind-aligning auditory-pin-snap-locking-and-centering umbrella, having
auditorily-snap-locking recess 135,
four auditorily-snap-locking leaf springs 138, and
four auditorily-snap-locking nipples 139.

Therefore, the arthritic-aiding triple-sail wind-rotating wind-aligning auditory-pin-snap-locking-and-centering umbrella:

a) Can emit a snapping sound loud enough
   to allow a person to hear the sound and recognize the moment that a locking pin is fully engaged
   (FIG. 26A, FIG. 26B, FIG. 26C, and FIG. 26D);

b) Can transmit a vibration-emitting movement, projected by an interaction between two of four auditorily-snap-locking nipples,
   to allow a person, utilizing their tactile senses, to recognize the moment a locking pin has fully engaged
   (FIG. 26A, FIG. 26B, FIG. 26C, and FIG. 26D);

c) Can lock with one action,
   to eliminate the need to secondarily insert a cotter key, or split-wire ring, to secure pin in vertical post
   (FIG. 26A, FIG. 26B, FIG. 26C, and FIG. 26D); and d) Can easily and instantly be inserted and extracted with minimal effort,
   to eliminate pain experienced by an arthritic person
   (FIG. 26A, FIG. 26B, FIG. 26C, and FIG. 26D).

6) It is still another object of the new invention to provide an arthritic-aiding triple-sail wind-rotating wind-aligning auditory-pin-snap-locking-and-centering umbrella, having
arthritic-aiding canopy-tension-adjusting system 111.

Therefore, the arthritic-aiding triple-sail wind-rotating wind-aligning auditory-pin-snap-locking-and-centering umbrella:

a) Can easily adjust,
   to compensate for conditions resulting in canopy fabric being too small or too tight
   (FIG. 23A, FIG. 23B, FIG. 23C, and FIG. 23D);

b) Can easily adjust,
   to compensate for conditions which loosen the canopy fabric causing sagging
   (FIG. 23A, FIG. 23B, FIG. 23C, and FIG. 23D); and c) Can provide internally-threaded tension-adjusting knobs whose flat surface can be easily rotated open-handed, by an arthritic hand
   to eliminate the need to curl fingers to rotate, causing pain to an arthritic suffering person
   (FIG. 23A, FIG. 23B, FIG. 23C, and FIG. 23D).

7) It is yet still another object of the new invention to provide an arthritic-aiding triple-sail wind-rotating wind-aligning auditory-pin-snap-locking-and-centering umbrella, having
two pin-centering pin-guiding tubes 137.

Therefore, the arthritic-aiding triple-sail wind-rotating wind-aligning auditory-pin-snap-locking-and-centering umbrella:

a) Can provide two tapered cone-shaped receiving apertures, on opposing ends, acting as a funnel while an arthritic suffering person inserts a locking pin,
   to aid shaky arthritic hand to easily locate the tip of a locking pin to the inwardly tapered cone-shaped receiving apertures
   (FIG. 25A, FIG. 25B, FIG. 26A, FIG. 26B, FIG. 26C and FIG. 26D);

b) Can provide a conduit between two umbrella-pole pin openings,
to eliminate difficulty lining up common pin holes on either side for an arthritic hand
(FIG. 25A, FIG. 25B, FIG. 26A, FIG. 26B, FIG. 26C and FIG. 26D);

c) Can provide a very low-friction material and low-friction internal surface,
to aid a shaky arthritic hand to effortlessly slide a locking pin into and through the two pin-centering pin-guiding tubes
(FIG. 25A, FIG. 25B, FIG. 26A, FIG. 26B, FIG. 26C and FIG. 26D); and d) Can provide two inwardly tapered cone-shaped receiving apertures, on opposing ends,
to provide greater access to, and increase comfort for a painful arthritic hand
(FIG. 25A, FIG. 25B, FIG. 26A, FIG. 26B, FIG. 26C and FIG. 26D).

8) It is a further object of the new invention to provide an arthritic-aiding triple-sail wind-rotating wind-aligning auditory-pin-snap-locking-and-centering umbrella, having
four internally-taperedly-threaded flexible towers 140.
Therefore, the arthritic-aiding triple-sail wind-rotating wind-aligning auditory-pin-snap-locking-and-centering umbrella:

a) Can simply be inserted from the top or bottom of an umbrella pole,
to overcome the need to have special tooling and reduce costs, materials, and labor
(FIG. 19A, FIG. 19B, FIG. 19C, and FIG. 19D);

b) Can secure within an umbrella pole, by the turn of a tower-locking screw,
to lock them in position, using a simple method, designed to reduce costs, materials, and labor
(FIG. 19A, FIG. 19B, FIG. 19C, and FIG. 19D);

c) Can provide a cost-saving manufacturing method by being molded into a one-piece unit,
to reduce manufacturing costs and conserve molding materials
(FIG. 19A, FIG. 19B, FIG. 19C, and FIG. 19D); and d) Can provide a cost-saving manufacturing method by being molded into a one-piece unit,
to reduce labor during assembly
(FIG. 19A, FIG. 19B, FIG. 19C, and FIG. 19D).

9) It is still a further object of the new invention to provide an arthritic-aiding triple-sail wind-rotating wind-aligning auditory-pin-snap-locking-and-centering umbrella, having
twelve triangular tower leaf springs 141.
Therefore, the arthritic-aiding triple-sail wind-rotating wind-aligning auditory-pin-snap-locking-and-centering umbrella:

a) Can create a low-pressure friction fit within an umbrella pole, with respectively evenly-distributed pressure around the perimeter,
to securely position the arthritic-aiding pin-centering pin-guiding auditorily-snap-locking tower-locking system with minimal pressure being exerted against the internal structure of an umbrella pole
(FIG. 19A, FIG. 19B, FIG. 19C, and FIG. 19D);

b) Can create a low-pressure friction fit within an umbrella pole,
to prevent over-tightening of the four internally-taperedly-threaded flexible towers during assembly
(FIG. 19A, FIG. 19B, FIG. 19C, and FIG. 19D);

c) Can provide a cost-saving manufacturing technique,
to reduce manufacturing costs and conserve molding materials
(FIG. 19A, FIG. 19B, FIG. 19C, and FIG. 19D); and d) Can provide arched leaf springs, creating an evenly-distributed-pressure friction fit within an umbrella pole,
to exert adequate outward pressure, without exerting excessive pressure, and self-adjust as needed in response to environmental conditions
(FIG. 19A, FIG. 19B, FIG. 19C, and FIG. 19D).

10) It is yet still a further object of the new invention to provide an arthritic-aiding triple-sail wind-rotating wind-aligning auditory-pin-snap-locking-and-centering umbrella, having
anti-cable-fraying cable-locking gear-cam system 126.
Therefore, the arthritic-aiding triple-sail wind-rotating wind-aligning auditory-pin-snap-locking-and-centering umbrella:

a) Can overcome common impediments of prior art,
to allow an arthritic sufferer to utilize the umbrella system
(FIG. 24A, FIG. 24B, and FIG. 24C);

b) Can overcome the need required by prior art, to curl thumb and fingers of a single hand around a pole to engage the locking pin,
to insert or compress a spring activated pin, or a manually inserted pin, into vertical umbrella center pole pin hole
(FIG. 24A, FIG. 24B, and FIG. 24C);

c) Can allow opposing pressure from between thumb and fingers of a single hand around a pole to engage the locking pin,
to insert or compress a spring activated pin, or a manually inserted pin, into vertical umbrella center pole pin hole
(FIG. 24A, FIG. 24B, and FIG. 24C); and d) Can allow opposing pressure from another hand, such as an opposing left hand or an opposing right hand,
to insert or compress a spring activated pin, or a manually inserted pin, into vertical umbrella center pole pin hole
(FIG. 24A, FIG. 24B, and FIG. 24C).

What is claimed is:

1. An arthritic-aiding wind-rotating wind-aligning triple-sail pin-guiding auditorily-snap-locking umbrella comprising:

an arthritic-aiding triple-sail canopy and pole system comprising:

a canopy, said canopy having a plurality of canopy openings and a canopy top, a first arthritic-aiding canopy-rotating-and-aligning sail attached to
said canopy top
for catching wind to automatically rotate said canopy to align with said wind,
for automatically aligning said canopy with the direction of wind to block said wind,
for an assisting arthritic by automatically aligning said canopy with the direction of wind,
for preventing said canopy from blowing over by automatically aligning said canopy to the direction of wind, and for automatically and repeatedly adjusting said canopy to the direction of wind when said direction of wind changes, a second arthritic-aiding canopy-rotating-and-aligning sail attached to said canopy top and to said first arthritic-aiding canopy-rotating-and-aligning sail for catching wind to automatically rotate said canopy to align with said wind, for automatically aligning said canopy with the direction of wind to block said wind, for an assisting arthritic by automatically aligning said canopy with the direction of wind, for preventing said canopy from blowing over by automatically aligning said canopy to the direction of wind, and for automatically and repeatedly adjusting said canopy to the direction of wind when said direction of wind changes, a third arthritic-aiding canopy-rotating-and-aligning sail attached to said canopy top and to said first and said second arthritic-aiding canopy-rotating-and-aligning sails for catching wind to automatically rotate said canopy to align with said wind, for automatically aligning said canopy with the direction of wind to block said wind, for an assisting arthritic by automatically aligning said canopy with the direction of wind, for preventing said canopy from blowing over by automatically aligning said canopy to the direction of wind, and for automatically and repeatedly adjusting said canopy to the direction of wind when said direction of wind changes;

a plurality of upper ribs, each of said upper ribs having a rib tip, a plurality of lower ribs, a plurality of foldable rib joints respectively attached to said upper ribs and pivotably attached to said lower ribs, an umbrella pole having a pole top and a pole inner surface, and an adjustable hub-rotation-preventing slot formed in said umbrella pole;

an arthritic-aiding canopy-tension-adjusting system comprising:

a plurality of protracting-rod-locking washers, a plurality of tension-adjusting oval rib openings respectively drilled in said rib tips, and a plurality of protracting-rod-locking screws respectively screwed through said protracting-rod-locking washers, through said canopy openings, and through said tension-adjusting oval rib openings for tensioning said canopy;

an arthritic-aiding rib-hub system comprising:

a canopy-securing crown, a crown-securing screw attaching said crown to said canopy and said pole top, a fixed hub attached to said umbrella pole at a distance from said pole top and pivotably coupled to said upper ribs, a movable hub movably slid on said umbrella pole and pivotably coupled to said lower ribs, an adjustable hub-rotation-preventing peg attached to said fixed hub and inserted in said adjustable hub-rotation-preventing slot for preventing said fixed hub from rotating around said umbrella pole, and an arthritic-aiding ring elevator attached to said movable hub for medicinally beneficially aiding an arthritic to push and pull to eliminate the needs for bending fingers and to eliminate hand pain while folding or unfolding said arthritic-aiding wind-rotating wind-aligning triple-sail pin-guiding auditorily-snap-locking umbrella;

an arthritic-aiding tri-pulley system comprising:

two fixed-hub pulleys respectively screwed to said fixed hub, a movable-hub pulley screwed to said movable hub, and a pulley cord threaded on said two fixed-hub pulleys and said movable-hub pulley, and attached to said movable hub;

an anti-cable-fraying cable-locking gear-cam system comprising:

a gear-cam mount screwed to said arthritic-aiding ring elevator, two gear cams each having a tear-dropped shape, said two gear cams each rotatably attached to said gear-cam mount for clampingly securing said pulley cord therebetween and for allowing said pulley cord to move in only one direction therebetween, and a cord blocker having a U shape and two cord-blocker ends each shaped like a disc, said two cord-blocker ends respectively attached to said two gear cams for keeping said pulley cord between said two gear cams;

an arthritic-aiding pin-centering-and-guiding auditorily-snap-locking tower-locking system comprising:

at least one pin opening respectively drilled through said umbrella pole, an arthritic-aiding ergonomic grip ring for medicinally beneficially inserting an arthritic hand therein to eliminate the needs for bending fingers and to eliminate hand pain while locking or unlocking said arthritic-aiding wind-rotating wind-aligning triple-sail pin-guiding auditorily-snap-locking umbrella, and for hooking and storing said pulley cord thereon, an anti-finger-pinching spacer screwed on said arthritic-aiding ergonomic grip ring, a locking pin molded to said anti-finger-pinching spacer, an auditorily-snap-locking recess molded on said locking pin, at least one pin-centering-and-guiding plug inserted into said umbrella pole, at least one pin-centering-and-guiding tube molded inside said at least one pin-centering-and-guiding plug and aligned with said at least one pin opening for centering said locking pin inside said at least one pin-centering-and-guiding tube and for guiding said locking pin through said at least one pin opening, a plurality of auditorily-snap-locking leaf springs molded inside said at least one pin-centering-and-guiding tube, a plurality of auditorily-snap-locking nipples respectively molded on said auditorily-snap-locking leaf springs for auditorily snap-locking inside said auditorily-snap-locking recess, a plurality of threaded L-cross-sectional towers respectively molded to said at least one pin-centering-and-guiding plug, a plurality of tower leaf springs respectively molded to said threaded L-cross-sectional towers, and a tower-locking screw screwed between said threaded L-cross-sectional towers for pushing said threaded L-cross-sectional towers against said pole inner surface of said umbrella pole to lock said threaded L-cross-sectional towers and said at least one pin-centering-and-guiding tube inside said umbrella pole; and an adjustable-wedging base system comprising:

a base having a base hole and a base undersurface, a pole receiver having a pole-receiver bottom end, said pole receiver for said umbrella pole to be inserted therein, a wedging regulator inserted into said base hole for said pole receiver to be inserted therein to regulate a wedging force between said base and said pole receiver, a pole-receiver plate having a plate hole, said pole-receiver plate placed on said base undersurface, and a plate screw inserted through said plate hole and screwed on said pole-receiver bottom end.

2. The An arthritic-aiding wind-rotating wind-aligning triple-sail pin-guiding auditorily-snap-locking umbrella of claim 1, wherein said tower leaf springs each have a triangular shape.

3. The An arthritic-aiding wind-rotating wind-aligning triple-sail pin-guiding auditorily-snap-locking umbrella of claim 1, wherein said threaded L-cross-sectional towers comprise four threaded L-cross sectional towers.

4. The An arthritic-aiding wind-rotating wind-aligning triple-sail pin-guiding auditorily-snap-locking umbrella, of claim 1, wherein said at least one pin-centering-and-guiding plug comprises two pin-centering-and-guiding plugs.

5. The An arthritic-aiding wind-rotating wind-aligning triple-sail pin-guiding auditorily-snap-locking umbrella of claim 1, wherein said at least one pin-centering-and-guiding tube comprises two pin-centering-and guiding tubes.

6. The An arthritic-aiding wind-rotating wind-aligning triple-sail pin-guiding auditorily-snap-locking umbrella of claim 1, wherein said at least one pin opening comprises two pin openings.

7. The An arthritic-aiding wind-rotating wind-aligning triple-sail pin-guiding auditorily-snap-locking umbrella of claim 1, further comprising a handle screwed on said movable hub.

8. The An arthritic-aiding wind-rotating wind-aligning triple-sail pin-guiding auditorily-snap-locking umbrella of claim 1, wherein said arthritic-aiding ergonomic grip ring has a curved C shape.

9. The An arthritic-aiding wind-rotating wind-aligning triple-sail pin-guiding auditorily-snap-locking umbrella of claim 1, wherein said first, said second, and said third arthritic-aiding canopy-rotating-and-aligning sails each have a triangular shape.

10. An arthritic-aiding wind-rotating-and-aligning pin-guiding auditorily-snap-locking umbrella comprising:

an arthritic-aiding triple-sail canopy and pole system comprising:

a canopy, said canopy having a canopy-top opening edge, at least one arthritic-aiding canopy-rotating-and-aligning sail attached to said canopy-top opening edge and to each other for catching wind to automatically rotate said canopy to align with said wind, for automatically aligning said canopy with the direction of wind to block said wind, for an assisting arthritic by automatically aligning said canopy with the direction of wind, for preventing said canopy from blowing over by automatically aligning said canopy to the direction of wind, and for automatically and repeatedly adjusting said canopy to the direction of wind when said direction of wind changes;

a plurality of upper ribs, each of said upper ribs having a rib tip, a plurality of lower ribs, a plurality of foldable rib joints respectively attached to said upper ribs and pivotably attached to said lower ribs, an upper pole having a pole top and a pole inner surface, a core having a mushroom shape and a connecting hole, said upper pole inserted into said connecting hole, a lower pole, said core inserted into said lower pole, and an adjustable hub-rotation-preventing slot formed in said upper pole;

an arthritic-aiding canopy-tension-adjusting system comprising:

a plurality of protracting-rod-locking washers, a plurality of tension-adjusting oval rib openings respectively drilled in said rib tips, and a plurality of protracting-rod-locking screws respectively screwed through said protracting-rod-locking washers, through said canopy, and through said tension-adjusting oval rib openings for tensioning said canopy;

an arthritic-aiding rib-hub system comprising:

a canopy-securing crown, a crown-securing screw attaching said crown to said canopy and said pole top, a fixed hub attached to said upper pole at a distance from said pole top and pivotably coupled to said upper ribs, a movable hub movably slid on said upper pole and pivotably coupled to said lower ribs, an adjustable hub-rotation-preventing peg attached to said fixed hub and inserted in said adjustable hub-rotation-preventing slot for preventing said fixed hub from rotating around said upper pole, and an arthritic-aiding ring elevator attached to said movable hub for medicinally beneficially aiding an arthritic to push and pull to eliminate the needs for bending fingers and to eliminate hand pain while folding or unfolding said arthritic-aiding wind-rotating-and-aligning pin-guiding auditorily-snap-locking umbrella;

an arthritic-aiding tri-pulley system comprising:

two fixed-hub pulleys respectively screwed to said fixed hub, a movable-hub pulley screwed to said movable hub, and a pulley cord threaded on said two fixed-hub pulleys and said movable-hub pulley, and attached to said movable hub;

an anti-cable-fraying cable-locking gear-cam system comprising:

a gear-cam mount screwed to said arthritic-aiding ring elevator, two gear cams each having a tear-dropped shape, said two gear cams each rotatably attached to said gear-cam mount for clampingly securing said pulley cord therebetween and for allowing said pulley cord to move in only one direction therebetween, and a cord blocker having a U shape and two cord-blocker ends each shaped like a disc, said two cord-blocker ends respectively attached to said two gear cams for keeping said pulley cord between said two gear cams;

an arthritic-aiding pin-centering-and-guiding auditorily-snap-locking tower-locking system comprising:

at least one pin opening respectively drilled through said upper pole, an arthritic-aiding ergonomic grip ring for medicinally beneficially inserting an arthritic hand therein to eliminate the needs for bending fingers and to eliminate hand pain while locking or unlocking said arthritic-aiding wind-rotating-and-aligning pin-guiding auditorily-snap-locking umbrella, and for hooking and storing said pulley cord thereon, an anti-finger-pinching spacer screwed on said arthritic-aiding ergonomic grip ring, a locking pin molded to said anti-finger-pinching spacer, an auditorily-snap-locking recess molded on said locking pin, at least one pin-centering-and-guiding plug inserted into said upper pole, at least one pin-centering-and-guiding tube molded inside said at least one pin-centering-and-guiding plug and aligned with said at least one pin opening for centering said locking pin inside said at least one pin-centering-and-guiding tube and for guiding said locking pin through said at least one pin opening, a plurality of auditorily-snap-locking leaf springs molded inside said at least one pin-centering-and-guiding tube, a plurality of auditorily-snap-locking nipples respectively molded on said auditorily-snap-locking leaf springs for auditorily snap-locking inside said auditorily-snap-locking recess, a plurality of threaded L-cross-sectional towers respectively molded to said at least one pin-centering-and-guiding plug, a plurality of tower leaf springs respectively molded to said threaded L-cross-sectional towers, and a tower-locking screw screwed between said threaded L-cross-sectional towers for pushing said threaded L-cross-sectional towers against said pole inner surface of said upper pole to lock said threaded L-cross-sectional towers and said at least one pin-centering-and-guiding tube inside said upper pole; and an adjustable-wedging base system comprising:

a base having a base hole and a base undersurface, a pole receiver having a pole-receiver bottom end, said pole receiver for said umbrella pole to be inserted therein, a wedging regulator inserted into said base hole for said pole receiver to be inserted therein to regulate a wedging force between said base and said pole receiver, a pole-receiver plate having a plate hole, said pole-receiver plate placed on said base undersurface, and a plate screw inserted through said plate hole and screwed on said pole-receiver bottom end.

11. The arthritic-aiding wind-rotating-and-aligning pin-guiding auditorily-snap-locking umbrella of claim 10, wherein said tower leaf springs each have a triangular shape.

12. The arthritic-aiding wind-rotating-and-aligning pin-guiding auditorily-snap-locking Umbrella of claim 10, wherein said threaded L-cross-sectional towers comprise four threaded L-cross sectional towers.

13. The arthritic-aiding wind-rotating-and-aligning pin-guiding auditorily-snap-locking umbrella of claim 10, wherein said at least one pin-centering-and-guiding plug comprises two pin-centering-and-guiding plugs.

14. The arthritic-aiding wind-rotating-and-aligning pin-guiding auditorily-snap-locking umbrella of claim 10, wherein said at least one pin-centering-and-guiding tube comprises two pin-centering-and guiding tubes.

15. The arthritic-aiding wind-rotating-and-aligning pin-guiding auditorily-snap-locking umbrella of claim 10, wherein said at least one pin opening comprises two pin openings.

16. The arthritic-aiding wind-rotating-and-aligning pin-guiding auditorily-snap-locking umbrella of claim 10, further comprising a handle screwed on said movable hub.

17. The arthritic-aiding wind-rotating-and-aligning pin-guiding auditorily-snap-locking umbrella of claim 10, wherein said arthritic-aiding ergonomic grip ring has a curved C shape.

18. The arthritic-aiding wind-rotating-and-aligning pin-guiding auditorily-snap-locking umbrella of claim 10, wherein said at least one arthritic-aiding canopy-rotating-and-aligning sail each have a triangular shape.

19. An arthritic-aiding wind-aligning pin-guiding auditorily-snap-locking umbrella comprising:

an arthritic-aiding triple-sail canopy and pole system comprising:

a canopy, said canopy having a canopy-top opening edge, at least one arthritic-aiding canopy-rotating-and-aligning sail attached to said canopy-top opening edge and to each other, a plurality of upper ribs, each of said upper ribs having a rib tip, a plurality of lower ribs, a plurality of foldable rib joints respectively attached to said upper ribs and pivotably attached to said lower ribs, an umbrella pole having a pole top and a pole inner surface, and an adjustable hub-rotation-preventing slot formed in said umbrella pole;

an arthritic-aiding canopy-tension-adjusting system comprising:

a plurality of protracting-rod-locking washers, a plurality of tension-adjusting oval rib openings respectively drilled in said upper ribs, and a plurality of protracting-rod-locking screws respectively screwed through said protracting-rod-locking washers, through said canopy, and through said tension-adjusting oval rib openings for tensioning said canopy;

an arthritic-aiding rib-hub system comprising:

a canopy-securing crown, a crown-securing screw attaching said crown to said canopy and said pole top, a fixed hub attached to said umbrella pole at a distance from said pole top and pivotably coupled to said upper ribs, a movable hub movably slid on said umbrella pole and pivotably coupled to said lower ribs, an adjustable hub-rotation-preventing peg attached to said fixed hub and inserted in said adjustable hub-rotation-preventing slot for preventing said fixed hub from rotating around said umbrella pole, and an arthritic-aiding ring elevator attached to said movable hub for medicinally beneficially aiding an arthritic to push and pull to eliminate the needs for bending fingers and to eliminate hand pain while folding or unfolding said arthritic-aiding wind-rotating-and-aligning pin-guiding auditorily-snap-locking umbrella;

an arthritic-aiding tri-pulley system comprising:

two fixed-hub pulleys respectively screwed to said fixed hub, a movable-hub pulley screwed to said movable hub, and a pulley cord threaded on said two fixed-hub pulleys and said movable-hub pulley, and attached to said movable hub;

an anti-cable-fraying cable-locking gear-cam system comprising:

a gear-cam mount screwed to said arthritic-aiding ring elevator, two gear cams each having a tear-dropped shape, said two gear cams each rotatably attached to said gear-cam mount for clampingly securing said pulley cord therebetween and for allowing said pulley cord to move in only one direction therebetween, and a cord blocker having a U shape and two cord-blocker ends each shaped like a disc, said two cord-blocker ends respectively attached to said two gear cams for keeping said pulley cord between said two gear cams;

an arthritic-aiding pin-centering-and-guiding auditorily-snap-locking tower-locking system comprising:

at least one pin opening respectively drilled through said umbrella pole, an arthritic-aiding ergonomic grip ring for medicinally beneficially inserting an arthritic hand therein to eliminate the needs for bending fingers and to eliminate hand pain while locking or unlocking said arthritic-aiding wind-rotating-and-aligning pin-guiding auditorily-snap-locking umbrella, and for hooking and storing said pulley cord thereon, an anti-finger-pinching spacer screwed on said arthritic-aiding ergonomic grip ring, a locking pin molded to said anti-finger-pinching spacer, an auditorily-snap-locking recess molded on said locking pin, at least one pin-centering-and-guiding plug inserted into said umbrella pole, at least one pin-centering-and-guiding tube molded inside said at least one pin-centering-and-guiding plug and aligned with said at least one pin opening for centering said locking pin inside said at least one pin-centering-and-guiding tube and for guiding said locking pin through said at least one pin opening, a plurality of auditorily-snap-locking leaf springs molded inside said at least one pin-centering-and-guiding tube, a plurality of auditorily-snap-locking nipples respectively molded on said auditorily-snap-locking leaf springs for auditorily snap-locking inside said auditorily-snap-locking recess, a plurality of threaded L-cross-sectional towers respectively molded to said at least one pin-centering-and-guiding plug, a plurality of tower leaf springs respectively molded to said threaded L-cross-sectional towers, and a tower-locking screw screwed between said threaded L-cross-sectional towers for pushing said threaded L-cross-sectional towers against said pole inner surface of said umbrella pole to lock said threaded L-cross-sectional towers and said at least one pin-centering-and-guiding tube inside said umbrella pole; and an adjustable-wedging base system comprising:

a base having a base hole and a base undersurface, a pole receiver having a pole-receiver bottom end, said pole receiver for said umbrella pole to be inserted therein, a wedging regulator inserted into said base hole for said pole receiver to be inserted therein to regulate a wedging force between said base and said pole receiver, a pole-receiver plate having a plate hole, said pole-receiver plate placed on said base undersurface, and a plate screw inserted through said plate hole and screwed on said pole-receiver bottom end.

20. The arthritic-aiding wind-aligning pin-guiding auditorily-snap-locking umbrella of claim 19, wherein said tower leaf springs each have a triangular shape.

* * * * *